US006020869A

United States Patent [19]

Sasaki et al.

[11] Patent Number: 6,020,869

[45] Date of Patent: Feb. 1, 2000

[54] MULTI-GRAY LEVEL DISPLAY APPARATUS AND METHOD OF DISPLAYING AN IMAGE AT MANY GRAY LEVELS

[75] Inventors: Itsuo Sasaki, Tokyo; Yasoji Suzuki, Yokohama; Hirofumi Kato, Himeji; Isao Arita, Tokyo; Toshio Yanagisawa; Kazuyoshi Yamamoto, both of Hyogo-ken; Hiroyoshi Murata; Hiroyuki Hamagawa, both of Himeji, all of Japan

[73] Assignee: Kabushiki Kaisha Toshiba, Kawasaki, Japan

[21] Appl. No.: 08/841,389

[22] Filed: Apr. 30, 1997

Related U.S. Application Data

[63] Continuation of application No. 08/454,141, filed as application No. PCT/JP94/01688, Oct. 7, 1994, abandoned.

[30] Foreign Application Priority Data

| | | | |
|---|---|---|---|
| Oct. 8, 1993 | [JP] | Japan | 5-252922 |
| Jun. 9, 1994 | [JP] | Japan | 6-127405 |
| Jun. 9, 1994 | [JP] | Japan | 6-127406 |
| Jun. 9, 1994 | [JP] | Japan | 6-127407 |
| Jun. 9, 1994 | [JP] | Japan | 6-127408 |

[51] Int. Cl.[7] ..... G09G 3/28; G09G 3/30; G09G 3/36; G09G 5/10

[52] U.S. Cl. ..... 345/89; 345/63; 345/77; 345/147

[58] Field of Search ..... 345/89, 62, 63, 345/77, 90, 147, 148, 149, 150; 348/226, 285, 412, 413, 414–418, 668, 669

[56] References Cited

U.S. PATENT DOCUMENTS

| | | | |
|---|---|---|---|
| Re. 33,532 | 2/1991 | Ishii | 345/148 |
| 4,383,256 | 5/1983 | Kurahashi et al. | 345/148 |
| 4,808,991 | 2/1989 | Tachiuchi | 345/148 |
| 5,122,783 | 6/1992 | Bassett, Jr. | 345/148 |
| 5,309,170 | 5/1994 | Takashi et al. | 345/89 |
| 5,465,102 | 11/1995 | Usui et al. | 345/89 |

FOREIGN PATENT DOCUMENTS

| | | |
|---|---|---|
| 61-103199 | 5/1986 | Japan . |
| 63-74036 | 4/1988 | Japan . |
| 2-55392 | 2/1990 | Japan . |
| 2-81091 | 3/1990 | Japan . |
| 4345194 | 12/1992 | Japan . |
| 5-73008 | 3/1993 | Japan . |
| 5-333831 | 12/1993 | Japan . |

*Primary Examiner*—Vijay Shankar
*Attorney, Agent, or Firm*—Pillsbury Madison & Sutro LLP

[57] ABSTRACT

A multi-gray level display designed to display multi-gray level images free of flicker or the like, by using a small number of voltages. The display comprises a first gray-level pattern generating circuit 311 for generating a first gray-level pattern which acquires a gray level during m frame periods, a second gray-level pattern generating circuit 321 for generating a second gray-level pattern which acquires another gray level during n frame periods (n is a positive integer greater than m), and a selection circuit 341 for selecting and outputting one of the preset voltages, in accordance with an output from the first gray-level pattern generating circuit 311 or the second gray-level pattern generating circuit 321 when the input multi-gray level display data corresponds to a gray level of either the first gray-level pattern or the second gray-level pattern.

27 Claims, 32 Drawing Sheets

FIG. 8(a)
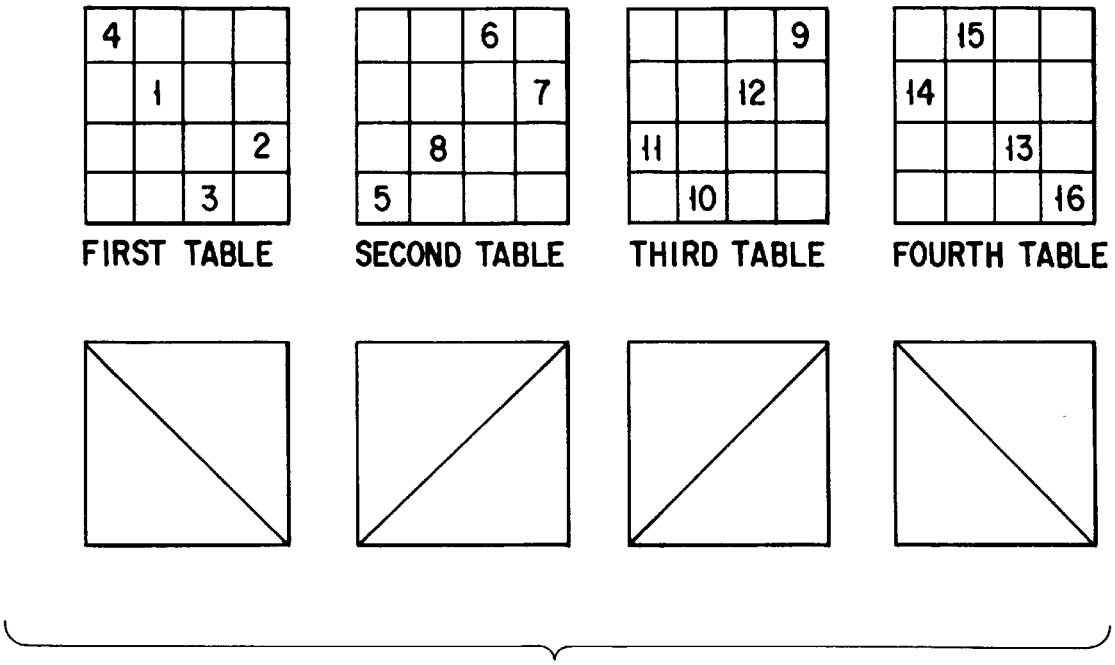
FIG. 8(b)
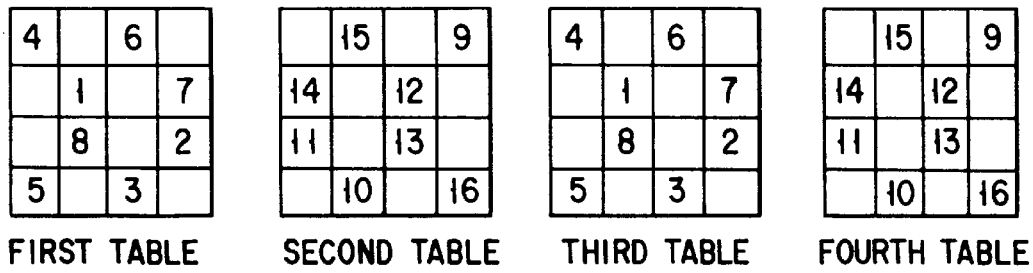
FIG. 9

FIRST TABLE

FIG. 10(a)

| | | | |
|---|---|---|---|
| 1 | 0 | 0 | 0 |
| 0 | 1 | 0 | 0 |
| 0 | 0 | 0 | 1 |
| 0 | 0 | 1 | 0 |

1/4

| | | | |
|---|---|---|---|
| 1 | 0 | 1 | 0 |
| 0 | 1 | 0 | 1 |
| 0 | 1 | 0 | 1 |
| 1 | 0 | 1 | 0 |

2/4

| | | | |
|---|---|---|---|
| 0 | 1 | 1 | 1 |
| 1 | 0 | 1 | 1 |
| 1 | 1 | 1 | 0 |
| 1 | 1 | 0 | 1 |

3/4

SECOND TABLE

FIG. 10(b)

| | | | |
|---|---|---|---|
| 0 | 0 | 1 | 0 |
| 0 | 0 | 0 | 1 |
| 0 | 1 | 0 | 0 |
| 1 | 0 | 0 | 0 |

1/4

| | | | |
|---|---|---|---|
| 0 | 1 | 0 | 1 |
| 1 | 0 | 1 | 0 |
| 1 | 0 | 1 | 0 |
| 0 | 1 | 0 | 1 |

2/4

| | | | |
|---|---|---|---|
| 1 | 1 | 0 | 1 |
| 1 | 1 | 1 | 0 |
| 1 | 0 | 1 | 1 |
| 0 | 1 | 1 | 1 |

3/4

THIRD TABLE

FIG. 10(c)

| | | | |
|---|---|---|---|
| 0 | 1 | 0 | 0 |
| 1 | 0 | 0 | 0 |
| 0 | 0 | 1 | 0 |
| 0 | 0 | 0 | 1 |

1/4

| | | | |
|---|---|---|---|
| 1 | 0 | 1 | 0 |
| 0 | 1 | 0 | 1 |
| 0 | 1 | 0 | 1 |
| 1 | 0 | 1 | 0 |

2/4

| | | | |
|---|---|---|---|
| 1 | 0 | 1 | 1 |
| 0 | 1 | 1 | 1 |
| 1 | 1 | 0 | 1 |
| 1 | 1 | 1 | 0 |

3/4

FOURTH TABLE

FIG. 10(d)

| | | | |
|---|---|---|---|
| 0 | 0 | 0 | 1 |
| 0 | 0 | 1 | 0 |
| 1 | 0 | 0 | 0 |
| 0 | 1 | 0 | 0 |

1/4

| | | | |
|---|---|---|---|
| 0 | 1 | 0 | 1 |
| 1 | 0 | 1 | 0 |
| 1 | 0 | 1 | 0 |
| 0 | 1 | 0 | 1 |

2/4

| | | | |
|---|---|---|---|
| 1 | 1 | 1 | 0 |
| 1 | 1 | 0 | 1 |
| 0 | 1 | 1 | 1 |
| 1 | 0 | 1 | 1 |

3/4

FIRST TABLE

| | | | | | |
|---|---|---|---|---|---|
| 0 | 0 | 1 | 0 | 0 | 1 |
| 0 | 1 | 0 | 0 | 1 | 0 |
| 1 | 0 | 0 | 1 | 0 | 0 |
| 0 | 0 | 0 | 1 | 0 | 1 |
| 1 | 0 | 0 | 0 | 1 | 0 |
| 0 | 1 | 1 | 0 | 0 | 0 |

2/6

| | | | | | |
|---|---|---|---|---|---|
| 1 | 1 | 1 | 1 | 1 | 0 |
| 1 | 1 | 0 | 1 | 1 | 1 |
| 1 | 0 | 1 | 1 | 1 | 1 |
| 0 | 1 | 1 | 1 | 0 | 1 |
| 1 | 1 | 1 | 0 | 1 | 1 |
| 1 | 0 | 0 | 1 | 1 | 1 |

4/6

FIG. 11(a)

SECOND TABLE

| | | | | | |
|---|---|---|---|---|---|
| 0 | 1 | 0 | 0 | 1 | 0 |
| 1 | 0 | 0 | 1 | 0 | 0 |
| 0 | 1 | 0 | 0 | 0 | 1 |
| 0 | 0 | 1 | 0 | 1 | 0 |
| 0 | 0 | 1 | 0 | 0 | 1 |
| 1 | 0 | 0 | 1 | 0 | 0 |

2/6

| | | | | | |
|---|---|---|---|---|---|
| 1 | 0 | 1 | 1 | 0 | 1 |
| 1 | 0 | 1 | 1 | 1 | 1 |
| 0 | 1 | 1 | 1 | 1 | 0 |
| 1 | 1 | 1 | 0 | 1 | 1 |
| 1 | 1 | 1 | 0 | 1 | 0 |
| 0 | 1 | 1 | 0 | 1 | 1 |

4/6

FIG. 11(b)

THIRD TABLE

| | | | | | |
|---|---|---|---|---|---|
| 1 | 0 | 0 | 1 | 0 | 0 |
| 0 | 0 | 1 | 0 | 0 | 1 |
| 0 | 0 | 1 | 0 | 1 | 0 |
| 1 | 1 | 0 | 0 | 0 | 0 |
| 0 | 1 | 0 | 1 | 0 | 0 |
| 0 | 0 | 0 | 0 | 1 | 1 |

2/6

| | | | | | |
|---|---|---|---|---|---|
| 0 | 1 | 1 | 0 | 1 | 1 |
| 1 | 1 | 0 | 1 | 1 | 0 |
| 1 | 1 | 1 | 0 | 1 | 1 |
| 0 | 0 | 1 | 1 | 1 | 1 |
| 1 | 0 | 1 | 0 | 1 | 1 |
| 1 | 1 | 1 | 1 | 0 | 0 |

4/6

FIG. 11(c)

FOURTH TABLE

| | | | | | |
|---|---|---|---|---|---|
| 0 | 0 | 1 | 0 | 0 | 1 |
| 0 | 1 | 0 | 0 | 1 | 0 |
| 1 | 0 | 0 | 1 | 0 | 0 |
| 0 | 0 | 0 | 1 | 0 | 1 |
| 1 | 0 | 0 | 0 | 1 | 0 |
| 0 | 1 | 1 | 0 | 0 | 0 |

2/6

| | | | | | |
|---|---|---|---|---|---|
| 1 | 1 | 1 | 1 | 1 | 0 |
| 1 | 1 | 0 | 1 | 1 | 1 |
| 1 | 0 | 1 | 1 | 1 | 1 |
| 0 | 1 | 1 | 1 | 0 | 1 |
| 1 | 1 | 1 | 0 | 1 | 1 |
| 1 | 0 | 0 | 1 | 1 | 1 |

4/6

FIG. 11(d)

FIFTH TABLE

| | | | | | |
|---|---|---|---|---|---|
| 0 | 1 | 0 | 0 | 1 | 0 |
| 1 | 0 | 0 | 1 | 0 | 0 |
| 0 | 1 | 0 | 0 | 0 | 1 |
| 0 | 0 | 1 | 0 | 1 | 0 |
| 0 | 0 | 1 | 0 | 0 | 1 |
| 1 | 0 | 0 | 1 | 0 | 0 |

2/6

| | | | | | |
|---|---|---|---|---|---|
| 1 | 0 | 1 | 1 | 0 | 1 |
| 1 | 0 | 1 | 1 | 1 | 1 |
| 0 | 1 | 1 | 1 | 1 | 0 |
| 1 | 1 | 1 | 0 | 1 | 1 |
| 1 | 1 | 1 | 0 | 1 | 0 |
| 0 | 1 | 1 | 0 | 1 | 1 |

4/6

FIG. 11(e)

SIXTH TABLE

| | | | | | |
|---|---|---|---|---|---|
| 1 | 0 | 0 | 1 | 0 | 0 |
| 0 | 0 | 1 | 0 | 0 | 1 |
| 0 | 0 | 1 | 0 | 1 | 0 |
| 1 | 1 | 0 | 0 | 0 | 0 |
| 0 | 1 | 0 | 1 | 0 | 0 |
| 0 | 0 | 0 | 0 | 1 | 1 |

2/6

| | | | | | |
|---|---|---|---|---|---|
| 0 | 1 | 1 | 0 | 1 | 1 |
| 1 | 1 | 0 | 1 | 1 | 0 |
| 1 | 1 | 1 | 0 | 1 | 1 |
| 0 | 0 | 1 | 1 | 1 | 1 |
| 1 | 0 | 1 | 0 | 1 | 1 |
| 1 | 1 | 1 | 1 | 0 | 0 |

4/6

FIG. 11(f)

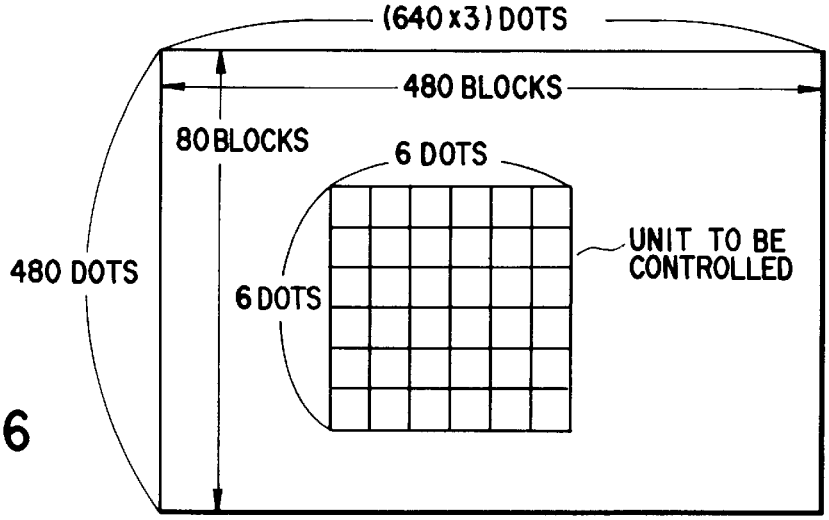
FIG. 16
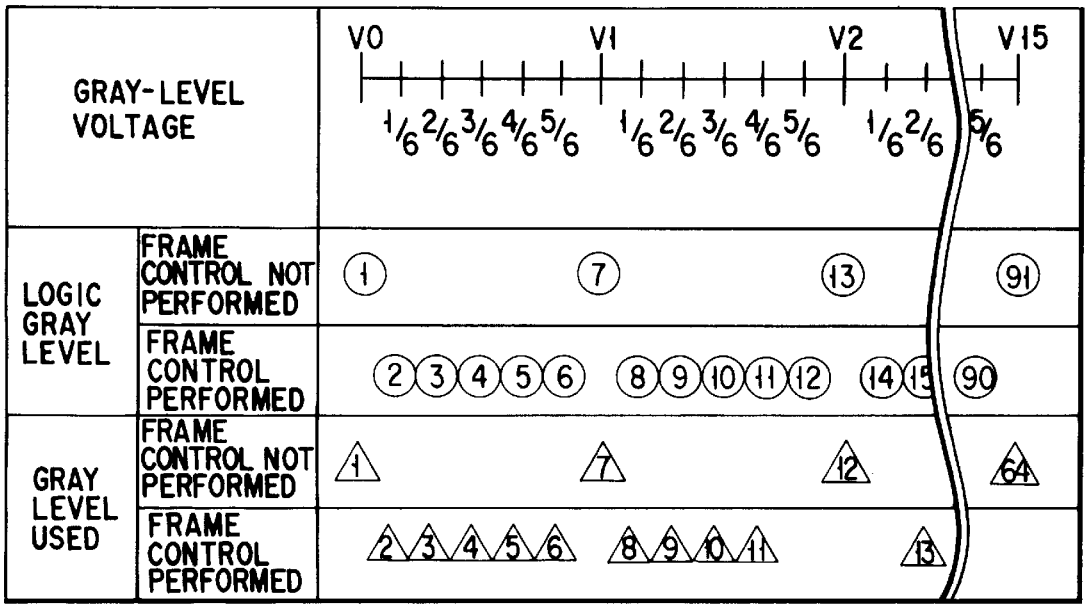
FIG. 17
| | | | | | |
|---|---|---|---|---|---|
| 1 | 2 | 4 | 6 | 5 | 3 |
| 3 | 5 | 2 | 4 | 1 | 6 |
| 6 | 3 | 5 | 1 | 2 | 4 |
| 4 | 1 | 6 | 2 | 3 | 5 |
| 2 | 6 | 3 | 5 | 4 | 1 |
| 5 | 4 | 1 | 3 | 6 | 2 |
FIG. 18

| | | | | | |
|---|---|---|---|---|---|
| 1 | 0 | 0 | 0 | 0 | 0 |
| 0 | 0 | 0 | 0 | 1 | 0 |
| 0 | 0 | 0 | 1 | 0 | 0 |
| 0 | 1 | 0 | 0 | 0 | 0 |
| 0 | 0 | 0 | 0 | 0 | 1 |
| 0 | 0 | 1 | 0 | 0 | 0 |

FIG. 19(a)

| | | | | | |
|---|---|---|---|---|---|
| 0 | 1 | 0 | 0 | 0 | 0 |
| 0 | 0 | 1 | 0 | 0 | 0 |
| 0 | 0 | 0 | 0 | 1 | 0 |
| 0 | 0 | 0 | 1 | 0 | 0 |
| 1 | 0 | 0 | 0 | 0 | 0 |
| 0 | 0 | 0 | 0 | 0 | 1 |

FIG. 19(b)

| | | | | | |
|---|---|---|---|---|---|
| 0 | 0 | 0 | 0 | 0 | 1 |
| 1 | 0 | 0 | 0 | 0 | 0 |
| 0 | 1 | 0 | 0 | 0 | 0 |
| 0 | 0 | 0 | 0 | 1 | 0 |
| 0 | 0 | 1 | 0 | 0 | 0 |
| 0 | 0 | 0 | 1 | 0 | 0 |

FIG. 19(c)

| | | | | | |
|---|---|---|---|---|---|
| 0 | 0 | 1 | 0 | 0 | 0 |
| 0 | 0 | 0 | 1 | 0 | 0 |
| 0 | 0 | 0 | 0 | 0 | 1 |
| 1 | 0 | 0 | 0 | 0 | 0 |
| 0 | 0 | 0 | 0 | 1 | 0 |
| 0 | 1 | 0 | 0 | 0 | 0 |

FIG. 19(d)

| | | | | | |
|---|---|---|---|---|---|
| 0 | 0 | 0 | 0 | 1 | 0 |
| 0 | 1 | 0 | 0 | 0 | 0 |
| 0 | 0 | 1 | 0 | 0 | 0 |
| 0 | 0 | 0 | 0 | 0 | 1 |
| 0 | 0 | 0 | 1 | 0 | 0 |
| 1 | 0 | 0 | 0 | 0 | 0 |

FIG. 19(e)

| | | | | | |
|---|---|---|---|---|---|
| 0 | 0 | 0 | 1 | 0 | 0 |
| 0 | 0 | 0 | 0 | 0 | 1 |
| 1 | 0 | 0 | 0 | 0 | 0 |
| 0 | 0 | 1 | 0 | 0 | 0 |
| 0 | 1 | 0 | 0 | 0 | 0 |
| 0 | 0 | 0 | 0 | 1 | 0 |

FIG. 19(f)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 1 |

FIG. 20(a)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 20(b)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 20(c)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 0 |

FIG. 20(d)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 20(e)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 20(f)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

(a)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

(b)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

(c)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

(d)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

(e)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

(f)

RANDOM NUMBER {0} :3/6

FIG. 21

| | | | | | |
|---|---|---|---|---|---|
| 1 | 1 | 1 | 0 | 0 | 1 |
| 1 | 0 | 1 | 1 | 1 | 0 |
| 0 | 1 | 0 | 1 | 1 | 1 |
| 1 | 1 | 0 | 1 | 1 | 0 |
| 1 | 0 | 1 | 0 | 1 | 1 |
| 0 | 1 | 1 | 1 | 0 | 1 |

(a)

| | | | | | |
|---|---|---|---|---|---|
| 1 | 1 | 0 | 1 | 1 | 0 |
| 0 | 1 | 1 | 0 | 1 | 1 |
| 1 | 0 | 1 | 1 | 1 | 0 |
| 0 | 1 | 1 | 1 | 0 | 1 |
| 1 | 1 | 0 | 1 | 0 | 1 |
| 1 | 0 | 1 | 0 | 1 | 1 |

(b)

| | | | | | |
|---|---|---|---|---|---|
| 0 | 0 | 1 | 1 | 1 | 1 |
| 1 | 1 | 0 | 1 | 0 | 1 |
| 1 | 1 | 1 | 0 | 0 | 1 |
| 1 | 0 | 1 | 0 | 1 | 1 |
| 0 | 1 | 1 | 1 | 1 | 0 |
| 1 | 1 | 0 | 1 | 1 | 0 |

(c)

| | | | | | |
|---|---|---|---|---|---|
| 1 | 1 | 1 | 0 | 0 | 1 |
| 1 | 0 | 1 | 1 | 1 | 0 |
| 0 | 1 | 0 | 1 | 1 | 1 |
| 1 | 1 | 0 | 1 | 1 | 0 |
| 1 | 0 | 1 | 0 | 1 | 1 |
| 0 | 1 | 1 | 1 | 0 | 1 |

(d)

| | | | | | |
|---|---|---|---|---|---|
| 1 | 1 | 0 | 1 | 1 | 0 |
| 0 | 1 | 1 | 0 | 1 | 1 |
| 1 | 0 | 1 | 1 | 1 | 0 |
| 0 | 1 | 1 | 1 | 0 | 1 |
| 1 | 1 | 0 | 1 | 0 | 1 |
| 1 | 0 | 1 | 0 | 1 | 1 |

(e)

| | | | | | |
|---|---|---|---|---|---|
| 0 | 0 | 1 | 1 | 1 | 1 |
| 1 | 1 | 0 | 1 | 0 | 1 |
| 1 | 1 | 1 | 0 | 0 | 1 |
| 1 | 0 | 1 | 0 | 1 | 1 |
| 0 | 1 | 1 | 1 | 1 | 0 |
| 1 | 1 | 0 | 1 | 1 | 0 |

(f)

RANDOM NUMBER {0} :4/6

FIG. 22

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

FIG. 21(a)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

FIG. 21(b)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

FIG. 21(c)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

FIG. 21(d)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

FIG. 21(e)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

FIG. 21(f)

| | | | | | |
|---|---|---|---|---|---|
| 1 | 1 | 1 | 0 | 0 | 1 |
| 1 | 0 | 1 | 1 | 1 | 0 |
| 0 | 1 | 0 | 1 | 1 | 1 |
| 1 | 1 | 0 | 1 | 1 | 0 |
| 1 | 0 | 1 | 0 | 1 | 1 |
| 0 | 1 | 1 | 1 | 0 | 1 |

FIG. 22(a)

| | | | | | |
|---|---|---|---|---|---|
| 1 | 1 | 0 | 1 | 1 | 0 |
| 0 | 1 | 1 | 0 | 1 | 1 |
| 1 | 0 | 1 | 1 | 1 | 0 |
| 0 | 1 | 1 | 1 | 0 | 1 |
| 1 | 1 | 0 | 1 | 0 | 1 |
| 1 | 0 | 1 | 0 | 1 | 1 |

FIG. 22(b)

| | | | | | |
|---|---|---|---|---|---|
| 0 | 0 | 1 | 1 | 1 | 1 |
| 1 | 1 | 0 | 1 | 0 | 1 |
| 1 | 1 | 1 | 0 | 0 | 1 |
| 1 | 0 | 1 | 0 | 1 | 1 |
| 0 | 1 | 1 | 1 | 1 | 0 |
| 1 | 1 | 0 | 1 | 1 | 0 |

FIG. 22(c)

| | | | | | |
|---|---|---|---|---|---|
| 1 | 1 | 1 | 0 | 0 | 1 |
| 1 | 0 | 1 | 1 | 1 | 0 |
| 0 | 1 | 0 | 1 | 1 | 1 |
| 1 | 1 | 0 | 1 | 1 | 0 |
| 1 | 0 | 1 | 0 | 1 | 1 |
| 0 | 1 | 1 | 1 | 0 | 1 |

FIG. 22(d)

| | | | | | |
|---|---|---|---|---|---|
| 1 | 1 | 0 | 1 | 1 | 0 |
| 0 | 1 | 1 | 0 | 1 | 1 |
| 1 | 0 | 1 | 1 | 1 | 0 |
| 0 | 1 | 1 | 1 | 0 | 1 |
| 1 | 1 | 0 | 1 | 0 | 1 |
| 1 | 0 | 1 | 0 | 1 | 1 |

FIG. 22(e)

| | | | | | |
|---|---|---|---|---|---|
| 0 | 0 | 1 | 1 | 1 | 1 |
| 1 | 1 | 0 | 1 | 0 | 1 |
| 1 | 1 | 1 | 0 | 0 | 1 |
| 1 | 0 | 1 | 0 | 1 | 1 |
| 0 | 1 | 1 | 1 | 1 | 0 |
| 1 | 1 | 0 | 1 | 1 | 0 |

FIG. 22(f)

| | | | | | |
|---|---|---|---|---|---|
| 1 | 1 | 1 | 0 | 1 | 1 |
| 1 | 1 | 1 | 1 | 1 | 0 |
| 0 | 1 | 1 | 1 | 1 | 1 |
| 1 | 1 | 0 | 1 | 1 | 1 |
| 1 | 0 | 1 | 1 | 1 | 1 |
| 1 | 1 | 1 | 1 | 0 | 1 |

FIG. 23(a)

| | | | | | |
|---|---|---|---|---|---|
| 1 | 1 | 1 | 1 | 0 | 1 |
| 1 | 0 | 1 | 1 | 1 | 1 |
| 1 | 1 | 0 | 1 | 1 | 1 |
| 1 | 1 | 1 | 1 | 1 | 0 |
| 1 | 1 | 1 | 0 | 1 | 1 |
| 0 | 1 | 1 | 1 | 1 | 1 |

FIG. 23(b)

| | | | | | |
|---|---|---|---|---|---|
| 1 | 1 | 0 | 1 | 1 | 1 |
| 1 | 1 | 1 | 0 | 1 | 1 |
| 1 | 1 | 1 | 1 | 1 | 0 |
| 0 | 1 | 1 | 1 | 1 | 1 |
| 1 | 1 | 1 | 1 | 0 | 1 |
| 1 | 0 | 1 | 1 | 1 | 1 |

FIG. 23(c)

| | | | | | |
|---|---|---|---|---|---|
| 1 | 1 | 1 | 1 | 1 | 0 |
| 0 | 1 | 1 | 1 | 1 | 1 |
| 1 | 0 | 1 | 1 | 1 | 1 |
| 1 | 1 | 1 | 1 | 0 | 1 |
| 1 | 1 | 0 | 1 | 1 | 1 |
| 1 | 1 | 1 | 0 | 1 | 1 |

FIG. 23(d)

| | | | | | |
|---|---|---|---|---|---|
| 1 | 0 | 1 | 1 | 1 | 1 |
| 1 | 1 | 0 | 1 | 1 | 1 |
| 1 | 1 | 1 | 1 | 0 | 1 |
| 1 | 1 | 1 | 0 | 1 | 1 |
| 0 | 1 | 1 | 1 | 1 | 1 |
| 1 | 1 | 1 | 1 | 1 | 0 |

FIG. 23(e)

| | | | | | |
|---|---|---|---|---|---|
| 0 | 1 | 1 | 1 | 1 | 1 |
| 1 | 1 | 1 | 1 | 0 | 1 |
| 1 | 1 | 1 | 0 | 1 | 1 |
| 1 | 0 | 1 | 1 | 1 | 1 |
| 1 | 1 | 1 | 1 | 1 | 0 |
| 1 | 1 | 0 | 1 | 1 | 1 |

FIG. 23(f)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 1 |

FIG. 24(a)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 0 | 0 | 1 |
| 1 | 0 | 0 | 0 | 1 | 0 |
| 0 | 0 | 1 | 0 | 1 | 0 |
| 0 | 1 | 0 | 1 | 0 | 0 |

FIG. 24(b)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 1 | 0 | 0 |
| 1 | 0 | 0 | 0 | 1 | 0 |

FIG. 24(c)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 1 |

FIG. 24(d)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 0 | 0 | 1 |
| 1 | 0 | 0 | 0 | 1 | 0 |
| 0 | 0 | 1 | 0 | 1 | 0 |
| 0 | 1 | 0 | 1 | 0 | 0 |

FIG. 24(e)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 0 |
| 0 | 1 | 0 | 1 | 0 | 1 |
| 1 | 0 | 0 | 0 | 1 | 0 |

FIG. 24(f)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 0 | 1 | 1 |
| 0 | 1 | 0 | 1 | 0 | 0 |
| 1 | 0 | 0 | 1 | 0 | 0 |
| 0 | 0 | 1 | 0 | 0 | 1 |

FIG. 25(a)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 25(b)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 25(c)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 0 | 1 | 1 |
| 0 | 1 | 0 | 1 | 0 | 0 |
| 1 | 0 | 0 | 1 | 0 | 0 |
| 0 | 0 | 1 | 0 | 0 | 1 |

FIG. 25(d)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 25(e)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 25(f)

| | | | | | |
|---|---|---|---|---|---|
| 0 | 0 | 1 | 1 | 0 | 0 |
| 0 | 0 | 1 | 0 | 0 | 0 |
| 1 | 0 | 0 | 0 | 1 | 1 |
| 1 | 1 | 0 | 0 | 0 | 1 |
| 0 | 0 | 0 | 1 | 0 | 0 |
| 0 | 0 | 1 | 1 | 0 | 0 |

FIG. 26(a)

| | | | | | |
|---|---|---|---|---|---|
| 1 | 1 | 0 | 0 | 1 | 0 |
| 1 | 0 | 0 | 0 | 0 | 1 |
| 0 | 0 | 0 | 1 | 0 | 0 |
| 0 | 0 | 1 | 0 | 0 | 0 |
| 1 | 0 | 0 | 0 | 1 | 1 |
| 0 | 1 | 0 | 0 | 1 | 0 |

FIG. 26(b)

| | | | | | |
|---|---|---|---|---|---|
| 0 | 0 | 0 | 0 | 0 | 1 |
| 0 | 1 | 0 | 1 | 1 | 0 |
| 0 | 1 | 1 | 0 | 0 | 0 |
| 0 | 0 | 0 | 1 | 1 | 0 |
| 0 | 1 | 1 | 0 | 0 | 0 |
| 1 | 0 | 0 | 0 | 0 | 1 |

FIG. 26(c)

| | | | | | |
|---|---|---|---|---|---|
| 0 | 0 | 1 | 1 | 1 | 0 |
| 0 | 1 | 0 | 0 | 0 | 1 |
| 1 | 0 | 0 | 0 | 0 | 0 |
| 0 | 0 | 1 | 1 | 0 | 0 |
| 0 | 0 | 0 | 0 | 1 | 0 |
| 1 | 1 | 0 | 0 | 0 | 1 |

FIG. 26(d)

| | | | | | |
|---|---|---|---|---|---|
| 0 | 0 | 0 | 0 | 0 | 1 |
| 1 | 0 | 1 | 0 | 1 | 0 |
| 0 | 1 | 0 | 1 | 0 | 0 |
| 1 | 0 | 0 | 0 | 1 | 0 |
| 0 | 1 | 0 | 1 | 0 | 1 |
| 0 | 0 | 1 | 0 | 0 | 0 |

FIG. 26(e)

| | | | | | |
|---|---|---|---|---|---|
| 1 | 1 | 0 | 0 | 0 | 0 |
| 0 | 0 | 0 | 1 | 0 | 0 |
| 0 | 0 | 1 | 0 | 1 | 1 |
| 0 | 1 | 0 | 0 | 0 | 1 |
| 1 | 0 | 1 | 0 | 0 | 0 |
| 0 | 0 | 0 | 1 | 1 | 0 |

FIG. 26(f)

| | | | | | |
|---|---|---|---|---|---|
| 1 | 0 | 0 | 0 | 0 | 0 |
| 0 | 0 | 0 | 0 | 1 | 0 |
| 0 | 0 | 0 | 1 | 0 | 0 |
| 0 | 1 | 0 | 0 | 0 | 0 |
| 0 | 0 | 0 | 0 | 0 | 1 |
| 0 | 0 | 1 | 0 | 0 | 0 |

FIG. 30(a)

| | | | | | |
|---|---|---|---|---|---|
| 0 | 1 | 0 | 0 | 0 | 0 |
| 0 | 0 | 1 | 0 | 0 | 0 |
| 0 | 0 | 0 | 0 | 1 | 0 |
| 0 | 0 | 0 | 1 | 0 | 0 |
| 1 | 0 | 0 | 0 | 0 | 0 |
| 0 | 0 | 0 | 0 | 0 | 1 |

FIG. 30(b)

| | | | | | |
|---|---|---|---|---|---|
| 0 | 0 | 0 | 0 | 0 | 1 |
| 1 | 0 | 0 | 0 | 0 | 0 |
| 0 | 1 | 0 | 0 | 0 | 0 |
| 0 | 0 | 0 | 0 | 1 | 0 |
| 0 | 0 | 1 | 0 | 0 | 0 |
| 0 | 0 | 0 | 1 | 0 | 0 |

FIG. 30(c)

| | | | | | |
|---|---|---|---|---|---|
| 0 | 0 | 1 | 0 | 0 | 0 |
| 0 | 0 | 0 | 1 | 0 | 0 |
| 0 | 0 | 0 | 0 | 0 | 1 |
| 1 | 0 | 0 | 0 | 0 | 0 |
| 0 | 0 | 0 | 0 | 1 | 0 |
| 0 | 1 | 0 | 0 | 0 | 0 |

FIG. 30(d)

| | | | | | |
|---|---|---|---|---|---|
| 0 | 0 | 0 | 0 | 1 | 0 |
| 0 | 1 | 0 | 0 | 0 | 0 |
| 0 | 0 | 1 | 0 | 0 | 0 |
| 0 | 0 | 0 | 0 | 0 | 1 |
| 0 | 0 | 0 | 1 | 0 | 0 |
| 1 | 0 | 0 | 0 | 0 | 0 |

FIG. 30(e)

| | | | | | |
|---|---|---|---|---|---|
| 0 | 0 | 0 | 1 | 0 | 0 |
| 0 | 0 | 0 | 0 | 0 | 1 |
| 1 | 0 | 0 | 0 | 0 | 0 |
| 0 | 0 | 1 | 0 | 0 | 0 |
| 0 | 1 | 0 | 0 | 0 | 0 |
| 0 | 0 | 0 | 0 | 1 | 0 |

FIG. 30(f)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 1 |

FIG. 31(a)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 31(b)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 31(c)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 0 |

FIG. 31(d)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 31(e)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 31(f)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

FIG. 32(a)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

FIG. 32(b)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

FIG. 32(c)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

FIG. 32(d)

| | | | | | |
|---|---|---|---|---|---|
| 1 | 1 | 0 | 0 | 0 | 1 |
| 1 | 0 | 1 | 0 | 1 | 0 |
| 0 | 1 | 0 | 1 | 1 | 0 |
| 0 | 1 | 0 | 1 | 1 | 0 |
| 1 | 0 | 1 | 0 | 0 | 1 |
| 0 | 0 | 1 | 1 | 0 | 1 |

FIG. 32(e)

| | | | | | |
|---|---|---|---|---|---|
| 0 | 0 | 1 | 1 | 1 | 0 |
| 0 | 1 | 0 | 1 | 0 | 1 |
| 1 | 0 | 1 | 0 | 0 | 1 |
| 1 | 0 | 1 | 0 | 0 | 1 |
| 0 | 1 | 0 | 1 | 1 | 0 |
| 1 | 1 | 0 | 0 | 1 | 0 |

FIG. 32(f)

| | | | | | |
|---|---|---|---|---|---|
| 1 | 1 | 1 | 0 | 0 | 1 |
| 1 | 0 | 1 | 1 | 1 | 0 |
| 0 | 1 | 0 | 1 | 1 | 1 |
| 1 | 1 | 0 | 1 | 1 | 0 |
| 1 | 0 | 1 | 0 | 1 | 1 |
| 0 | 1 | 1 | 1 | 0 | 1 |

FIG. 33(a)

| | | | | | |
|---|---|---|---|---|---|
| 1 | 1 | 0 | 1 | 1 | 0 |
| 0 | 1 | 1 | 0 | 1 | 1 |
| 1 | 0 | 1 | 1 | 1 | 0 |
| 0 | 1 | 1 | 1 | 0 | 1 |
| 1 | 1 | 0 | 1 | 0 | 1 |
| 1 | 0 | 1 | 0 | 1 | 1 |

FIG. 33(b)

| | | | | | |
|---|---|---|---|---|---|
| 0 | 0 | 1 | 1 | 1 | 1 |
| 1 | 1 | 0 | 1 | 0 | 1 |
| 1 | 1 | 1 | 0 | 0 | 1 |
| 1 | 0 | 1 | 0 | 1 | 1 |
| 0 | 1 | 1 | 1 | 1 | 0 |
| 1 | 1 | 0 | 1 | 1 | 0 |

FIG. 33(c)

| | | | | | |
|---|---|---|---|---|---|
| 1 | 1 | 1 | 0 | 0 | 1 |
| 1 | 0 | 1 | 1 | 1 | 0 |
| 0 | 1 | 0 | 1 | 1 | 1 |
| 1 | 1 | 0 | 1 | 1 | 0 |
| 1 | 0 | 1 | 0 | 1 | 1 |
| 0 | 1 | 1 | 1 | 0 | 1 |

FIG. 33(d)

| | | | | | |
|---|---|---|---|---|---|
| 1 | 1 | 0 | 1 | 1 | 0 |
| 0 | 1 | 1 | 0 | 1 | 1 |
| 1 | 0 | 1 | 1 | 1 | 0 |
| 0 | 1 | 1 | 1 | 0 | 1 |
| 1 | 1 | 0 | 1 | 0 | 1 |
| 1 | 0 | 1 | 0 | 1 | 1 |

FIG. 33(e)

| | | | | | |
|---|---|---|---|---|---|
| 0 | 0 | 1 | 1 | 1 | 1 |
| 1 | 1 | 0 | 1 | 0 | 1 |
| 1 | 1 | 1 | 0 | 0 | 1 |
| 1 | 0 | 1 | 0 | 1 | 1 |
| 0 | 1 | 1 | 1 | 1 | 0 |
| 1 | 1 | 0 | 1 | 1 | 0 |

FIG. 33(f)

| | | | | | |
|---|---|---|---|---|---|
| 1 | 1 | 1 | 0 | 1 | 1 |
| 1 | 1 | 1 | 1 | 1 | 0 |
| 0 | 1 | 1 | 1 | 1 | 1 |
| 1 | 1 | 0 | 1 | 1 | 1 |
| 1 | 0 | 1 | 1 | 1 | 1 |
| 1 | 1 | 1 | 1 | 0 | 1 |

FIG. 34(a)

| | | | | | |
|---|---|---|---|---|---|
| 1 | 1 | 1 | 1 | 0 | 1 |
| 1 | 0 | 1 | 1 | 1 | 1 |
| 1 | 1 | 0 | 1 | 1 | 1 |
| 1 | 1 | 1 | 1 | 1 | 0 |
| 1 | 1 | 1 | 0 | 1 | 1 |
| 0 | 1 | 1 | 1 | 1 | 1 |

FIG. 34(b)

| | | | | | |
|---|---|---|---|---|---|
| 1 | 1 | 0 | 1 | 1 | 1 |
| 1 | 1 | 1 | 0 | 1 | 1 |
| 1 | 1 | 1 | 1 | 1 | 0 |
| 0 | 1 | 1 | 1 | 1 | 1 |
| 1 | 1 | 1 | 1 | 0 | 1 |
| 1 | 0 | 1 | 1 | 1 | 1 |

FIG. 34(c)

| | | | | | |
|---|---|---|---|---|---|
| 1 | 1 | 1 | 1 | 1 | 0 |
| 0 | 1 | 1 | 1 | 1 | 1 |
| 1 | 0 | 1 | 1 | 1 | 1 |
| 1 | 1 | 1 | 1 | 0 | 1 |
| 1 | 1 | 0 | 1 | 1 | 1 |
| 1 | 1 | 1 | 0 | 1 | 1 |

FIG. 34(d)

| | | | | | |
|---|---|---|---|---|---|
| 1 | 0 | 1 | 1 | 1 | 1 |
| 1 | 1 | 0 | 1 | 1 | 1 |
| 1 | 1 | 1 | 1 | 0 | 1 |
| 1 | 1 | 1 | 0 | 1 | 1 |
| 0 | 1 | 1 | 1 | 1 | 1 |
| 1 | 1 | 1 | 1 | 1 | 0 |

FIG. 34(e)

| | | | | | |
|---|---|---|---|---|---|
| 0 | 1 | 1 | 1 | 1 | 1 |
| 1 | 1 | 1 | 1 | 0 | 1 |
| 1 | 1 | 1 | 0 | 1 | 1 |
| 1 | 0 | 1 | 1 | 1 | 1 |
| 1 | 1 | 1 | 1 | 1 | 0 |
| 1 | 1 | 0 | 1 | 1 | 1 |

FIG. 34(f)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 0 | 1 | 1 |
| 0 | 1 | 0 | 1 | 0 | 0 |
| 1 | 0 | 0 | 1 | 0 | 0 |
| 0 | 0 | 1 | 0 | 0 | 1 |

FIG. 35(a)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 35(b)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 35(c)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 0 | 1 | 1 |
| 0 | 1 | 0 | 1 | 0 | 0 |
| 1 | 0 | 0 | 1 | 0 | 0 |
| 0 | 0 | 1 | 0 | 0 | 1 |

FIG. 35(d)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 1 | 0 | 0 |
| 1 | 0 | 0 | 0 | 1 | 0 |
| 0 | 0 | 1 | 0 | 0 | 1 |
| 0 | 1 | 0 | 0 | 1 | 0 |

FIG. 35(e)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 0 | 1 | 0 |
| 1 | 0 | 0 | 1 | 0 | 0 |

FIG. 35(f)

| | | | | | |
|---|---|---|---|---|---|
| 0 | 0 | 1 | 1 | 0 | 0 |
| 0 | 0 | 1 | 0 | 0 | 0 |
| 1 | 0 | 0 | 0 | 1 | 1 |
| 1 | 1 | 0 | 0 | 0 | 1 |
| 0 | 0 | 0 | 1 | 0 | 0 |
| 0 | 0 | 1 | 1 | 0 | 0 |

FIG. 36(a)

| | | | | | |
|---|---|---|---|---|---|
| 1 | 1 | 0 | 0 | 1 | 0 |
| 1 | 0 | 0 | 0 | 0 | 1 |
| 0 | 0 | 0 | 1 | 0 | 0 |
| 0 | 0 | 1 | 0 | 0 | 0 |
| 1 | 0 | 0 | 0 | 1 | 1 |
| 0 | 1 | 0 | 0 | 1 | 0 |

FIG. 36(b)

| | | | | | |
|---|---|---|---|---|---|
| 0 | 0 | 0 | 0 | 0 | 1 |
| 0 | 1 | 0 | 1 | 1 | 0 |
| 0 | 1 | 1 | 0 | 0 | 0 |
| 0 | 0 | 0 | 1 | 1 | 0 |
| 0 | 1 | 1 | 0 | 0 | 0 |
| 1 | 0 | 0 | 0 | 0 | 1 |

FIG. 36(c)

| | | | | | |
|---|---|---|---|---|---|
| 0 | 0 | 1 | 1 | 1 | 0 |
| 0 | 1 | 0 | 0 | 0 | 1 |
| 1 | 0 | 0 | 0 | 0 | 0 |
| 0 | 0 | 1 | 1 | 0 | 0 |
| 0 | 0 | 0 | 0 | 1 | 0 |
| 1 | 1 | 0 | 0 | 0 | 1 |

FIG. 36(d)

| | | | | | |
|---|---|---|---|---|---|
| 0 | 0 | 0 | 0 | 0 | 1 |
| 1 | 0 | 1 | 0 | 1 | 0 |
| 0 | 1 | 0 | 1 | 0 | 0 |
| 1 | 0 | 0 | 0 | 1 | 0 |
| 0 | 1 | 0 | 1 | 0 | 1 |
| 0 | 0 | 1 | 0 | 0 | 0 |

FIG. 36(e)

| | | | | | |
|---|---|---|---|---|---|
| 1 | 1 | 0 | 0 | 0 | 0 |
| 0 | 0 | 0 | 1 | 0 | 0 |
| 0 | 0 | 1 | 0 | 1 | 1 |
| 0 | 1 | 0 | 0 | 0 | 1 |
| 1 | 0 | 1 | 0 | 0 | 0 |
| 0 | 0 | 0 | 1 | 1 | 0 |

FIG. 36(f)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 1 |

FIG. 37(a)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 0 | 0 | 1 |
| 1 | 0 | 0 | 0 | 1 | 0 |
| 0 | 0 | 1 | 0 | 1 | 0 |
| 0 | 1 | 0 | 1 | 0 | 0 |

FIG. 37(b)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 1 |
| 0 | 1 | 0 | 1 | 0 | 0 |
| 1 | 0 | 0 | 0 | 1 | 0 |

FIG. 37(c)

| | | | | | |
|---|---|---|---|---|---|
| 1 | 1 | 0 | 0 | 0 | 0 |
| 0 | 0 | 1 | 0 | 1 | 0 |
| 0 | 0 | 0 | 1 | 1 | 0 |
| 0 | 1 | 0 | 1 | 0 | 0 |
| 1 | 0 | 0 | 0 | 0 | 1 |
| 0 | 0 | 1 | 0 | 0 | 1 |

FIG. 37(d)

| | | | | | |
|---|---|---|---|---|---|
| 0 | 0 | 1 | 0 | 0 | 1 |
| 1 | 0 | 0 | 1 | 0 | 0 |
| 0 | 1 | 0 | 0 | 0 | 1 |
| 1 | 0 | 0 | 0 | 1 | 0 |
| 0 | 0 | 1 | 0 | 1 | 0 |
| 0 | 1 | 0 | 1 | 0 | 0 |

FIG. 37(e)

| | | | | | |
|---|---|---|---|---|---|
| 0 | 0 | 0 | 1 | 1 | 0 |
| 0 | 1 | 0 | 0 | 0 | 1 |
| 1 | 0 | 1 | 0 | 0 | 0 |
| 0 | 0 | 1 | 0 | 0 | 0 |
| 0 | 1 | 0 | 1 | 0 | 1 |
| 1 | 0 | 0 | 0 | 1 | 0 |

FIG. 37(f)

| | | | |
|---|---|---|---|
| 01 | 00 | 00 | 00 |
| 00 | 01 | 00 | 00 |
| 00 | 00 | 00 | 01 |
| 00 | 00 | 01 | 00 |

1/4

| | | | |
|---|---|---|---|
| 01 | 00 | 01 | 00 |
| 00 | 01 | 00 | 01 |
| 00 | 01 | 00 | 01 |
| 01 | 00 | 01 | 00 |

2/4

| | | | |
|---|---|---|---|
| 00 | 01 | 01 | 01 |
| 01 | 00 | 01 | 01 |
| 01 | 01 | 01 | 00 |
| 01 | 01 | 00 | 01 |

3/4

FIG. 44(a)
FIRST TABLE

| | | | |
|---|---|---|---|
| 00 | 00 | 01 | 00 |
| 00 | 00 | 00 | 01 |
| 00 | 01 | 00 | 00 |
| 01 | 00 | 00 | 00 |

1/4

| | | | |
|---|---|---|---|
| 00 | 01 | 00 | 01 |
| 01 | 00 | 01 | 00 |
| 01 | 00 | 01 | 00 |
| 00 | 01 | 00 | 01 |

2/4

| | | | |
|---|---|---|---|
| 01 | 01 | 00 | 01 |
| 01 | 01 | 01 | 00 |
| 01 | 00 | 01 | 01 |
| 00 | 01 | 01 | 01 |

3/4

FIG. 44(b)
SECOND TABLE

| | | | |
|---|---|---|---|
| 00 | 01 | 00 | 00 |
| 01 | 00 | 00 | 00 |
| 00 | 00 | 01 | 00 |
| 00 | 00 | 00 | 01 |

1/4

| | | | |
|---|---|---|---|
| 01 | 00 | 01 | 00 |
| 00 | 01 | 00 | 01 |
| 00 | 01 | 00 | 01 |
| 01 | 00 | 01 | 00 |

2/4

| | | | |
|---|---|---|---|
| 01 | 00 | 01 | 01 |
| 00 | 01 | 01 | 01 |
| 01 | 01 | 00 | 01 |
| 01 | 01 | 01 | 00 |

3/4

FIG. 44(c)
THIRD TABLE

| | | | |
|---|---|---|---|
| 00 | 00 | 01 | 01 |
| 01 | 00 | 01 | 01 |
| 01 | 00 | 01 | 00 |
| 00 | 01 | 01 | 01 |

1/4

| | | | |
|---|---|---|---|
| 00 | 01 | 00 | 01 |
| 01 | 00 | 01 | 00 |
| 01 | 00 | 01 | 00 |
| 00 | 01 | 00 | 01 |

2/4

| | | | |
|---|---|---|---|
| 01 | 01 | 01 | 00 |
| 01 | 01 | 00 | 01 |
| 00 | 01 | 01 | 01 |
| 01 | 00 | 01 | 01 |

3/4

FIG. 44(d)
FOURTH TABLE

FIG. 45(a)

| | | | |
|---|---|---|---|
| 11 | 00 | 11 | 00 |
| 00 | 11 | 00 | 11 |
| 00 | 11 | 00 | 11 |
| 11 | 00 | 11 | 00 |

20TH GRAY LEVEL
25TH GRAY LEVEL

| | | | |
|---|---|---|---|
| 10 | 00 | 10 | 00 |
| 00 | 10 | 00 | 10 |
| 00 | 10 | 00 | 10 |
| 10 | 00 | 10 | 00 |

28TH GRAY LEVEL

FIG. 45(b)

| | | | |
|---|---|---|---|
| 00 | 11 | 00 | 11 |
| 11 | 00 | 11 | 00 |
| 11 | 00 | 11 | 00 |
| 00 | 11 | 00 | 11 |

20TH GRAY LEVEL
25TH GRAY LEVEL

| | | | |
|---|---|---|---|
| 00 | 10 | 00 | 10 |
| 10 | 00 | 10 | 00 |
| 10 | 00 | 10 | 00 |
| 00 | 10 | 00 | 10 |

28TH GRAY LEVEL

FIG. 45(c)

| | | | |
|---|---|---|---|
| 11 | 00 | 11 | 00 |
| 00 | 11 | 00 | 11 |
| 00 | 11 | 00 | 11 |
| 11 | 00 | 11 | 00 |

20TH GRAY LEVEL
25TH GRAY LEVEL

| | | | |
|---|---|---|---|
| 10 | 00 | 10 | 00 |
| 00 | 10 | 00 | 10 |
| 00 | 10 | 00 | 10 |
| 10 | 00 | 10 | 00 |

28TH GRAY LEVEL

FIG. 45(d)

| | | | |
|---|---|---|---|
| 00 | 11 | 00 | 11 |
| 11 | 00 | 11 | 00 |
| 11 | 00 | 11 | 00 |
| 00 | 11 | 00 | 11 |

20TH GRAY LEVEL
25TH GRAY LEVEL

| | | | |
|---|---|---|---|
| 00 | 10 | 00 | 10 |
| 10 | 00 | 10 | 00 |
| 10 | 00 | 10 | 00 |
| 00 | 10 | 00 | 10 |

28TH GRAY LEVEL

MULTI-GRAY LEVEL DISPLAY APPARATUS AND METHOD OF DISPLAYING AN IMAGE AT MANY GRAY LEVELS

This is a continuation of application Ser. No. 08/454,141, filed on Jun. 8, 1995, now abandoned, which is a 371 of PCT/JP94/01688, filed on Oct, 7, 1994.

BACKGROUND OF THE INVENTION

1. Field of the Invention

This invention relates to a display apparatus such as a liquid crystal display and an electroluminescent (EL) display, and more particularly to a multi-gray level display apparatus and a method of displaying an image at many gray levels.

2. Description of the Related Art

In recent years, a demand has grown for a display apparatus represented by a liquid display, which can display images not only in high-resolution but also at various gray levels.

For example, an active-matrix display having a plurality of pixels and a plurality of switching elements such as thin-film transistors (TFTs), each provided for one pixel, comprises a plurality of pixel electrodes, a common electrode opposing the pixel electrodes, a cell of liquid crystal composition held between the common electrode, on the one hand, and the pixel electrodes, on the other. Generally, in a liquid crystal display of this type, a drive voltage is applied to selected ones of the pixel electrodes for each one-frame period, thereby to display an image.

In order to display an image at, for example, 64 ($=2^6$) gray levels, it is necessary to use as many as 64×2 different voltage levels. This is because the display needs to be AC-driven for the purpose of preventing deterioration of the liquid crystal composition used.

To provide a drive voltage having 64×2 different voltage levels is to increase power consumption in the drive-circuit IC incorporated in the display or the manufacturing cost of the display. Hence, this method of driving the display is not desirable.

Another display-driving method known is pulse-width modulation. In this method, the time for applying a drive voltage to a pixel, i.e., the pulse width of the drive voltage, not the level of the drive voltage, is changed in accordance with the gray level at which to display the pixel.

Pulse-width modulation, however, requires a complex drive circuit and is difficult to be controlled in order to display an image at as many as 64 ($=2^6$) gray levels.

To solve these problems to display multi-gray level images, frame-rate control (FRC) has been developed recently. This control method controls the number of consecutive frame (F) periods constituting one display period during which a drive voltage at a preset level is applied to the pixel electrode to turn on a pixel. Jpn. Pat. Appln. KOKAI Publication No. 2-115893 discloses a technique of preventing flicker on a liquid crystal display to which the FRC method is applied. In the technique, a block of neighboring pixels is determined as a unit to be controlled, and the number of frame (F) periods constituting one display period is variably set between the pixels to be turned on.

With the above-mentioned FRC method it is not necessary to change the level of the drive voltage, and it is possible to solve the problems inherent in the pulse-width modulation.

To display images at more different gray levels by means of the FRC method, however, it is necessary to further increase the number of frame (F) periods which constitute one display period. If an image is displayed at, for example, 64 ($=2^6$) gray levels, the number of frame (F) periods will increase so much that the image can no longer be recognized as a multi-gray level one or may be deteriorated with flicker.

The present invention has been made to solve the technical problems described above. The object of the present invention is to provide a display apparatus for displaying multi-gray level images without lowering their quality or causing flicker on them, and also a method of displaying an image at many gray levels.

SUMMARY OF THE INVENTION

A first aspect of this invention is a multi-gray level display apparatus which performs an image display by selecting one of preset voltage level in accordance with input multi-gray level display data. The apparatus comprises a display panel having a plurality of pixels; a first gray-level pattern generating circuit for generating a first gray-level pattern which acquires a gray level during m frame periods (m is a positive integer not less than 2); a second gray-level pattern generating circuit for generating a second gray-level pattern which acquires another gray level during n frame periods (n is a positive integer greater than m); and selection control means for selecting and outputting one of the preset voltage levels, based on an output from the first or second gray-level pattern generating circuit when the input multi-gray level display data corresponds to a gray level of either the first gray-level pattern or the second gray-level pattern.

A second aspect of the invention is a multi-gray level display apparatus which performs an image display in accordance with input k-bit multi-gray level display data (k is a positive integer greater than 2). The apparatus comprises a display panel having a plurality of pixels; a gray-level voltage generating circuit for generating $2^i$ gray-level voltages (i is a positive integer less than k+1); a first gray-level pattern generating circuit for generating a first gray-level pattern which acquires a gray level during m frame periods (m is an integer not less than 2); a second gray-level pattern generating circuit for generating a second gray-level pattern which acquires another gray level during n frame periods (where n is an integer greater than m); and selection control means for converting the k-bit multi-gray level display data to (i−1)-bit multi-gray level display data corresponding to one of the voltage levels, and outputting the (i−1)-bit multi-gray level display data, when the multi-gray level display data corresponds to the one voltage level.

A third aspect of the invention is a multi-gray level display apparatus which performs an image display in accordance with input k-bit multi-gray level display data (k is a positive integer greater than 2). The apparatus comprises a display panel having a plurality of pixels; a gray-level voltage generating circuit for generating a gray-level voltage of $2^i$ voltage levels (i is a positive integer less than k+1); a first gray-level pattern generating circuit for generating a first gray-level pattern which acquires a gray level during m frame periods (m is an integer not less than 2); a second gray-level pattern generating circuit for generating a second gray-level pattern which acquires another gray level during n frame periods (where n is an integer greater than m); and selection control means for converting the k-bit multi-gray level display data to (i−1)-bit multi-gray level display data corresponding to one of the voltage levels based on an output from the first or second gray-level pattern generating circuit, and outputting the (i−1)-bit multi-gray level display data, when the multi-gray level display data corresponds to a gray level of either the first gray-level pattern or the second gray-level pattern.

A fourth aspect of the invention is a multi-gray level display apparatus which comprises: a display panel having a plurality of pixels each of which is driven by a voltage selected from a group of voltages in accordance with multi-gray level display data; a first gray-level pattern generating circuit for generating a first gray-level pattern which acquires a gray level during m frame periods (m is an integer not less than 2); a second gray-level pattern generating circuit for generating a second gray-level pattern which acquires another gray level during n frame periods (where n is an integer greater than m); display data converting means for converting input k-bit multi-gray level display data (k is a positive integer greater than j) to j-bit multi-gray level display data; and an operation circuit for performing an operation on the j-bit multi-gray level display data in accordance with the first gray-level pattern when the k-bit multi-gray level display data corresponds to a display gray level based on the first gray-level pattern, and in accordance with the second gray-level pattern when the k-bit multi-gray level display data corresponds to a display gray level based on the second gray-level pattern, and for outputting a result of the operation thus performed.

A fifth aspect of this invention is a method of displaying multi-gray level images by selecting one of preset voltages in accordance with input multi-gray level display data, in which one of the preset voltages is selected and output in accordance with an output of a first gray-level pattern generating circuit for generating a first gray-level pattern which acquires a gray level during m frame periods (m is a positive integer not less than 2), or in accordance with an output of a second gray-level pattern generating circuit for generating a second gray-level pattern which acquires another gray level during n frame periods (n is a positive integer greater than m), when the input multi-gray level display data corresponds to a voltage between first and second of the preset levels, the second level being lower than the first.

A sixth aspect of the invention is a method of displaying multi-gray level images in accordance with input k-bit multi-gray level display data (k is a positive integer greater than 2). The k-bit multi-gray level display data corresponds to one of preset $2^i$ voltages (i is a positive integer less than k+l). The k-bit multi-gray level display data is converted to (i−1)-bit multi-gray level display data corresponding to the one of the preset voltages and the (i−1)-bit multi-gray level display data is output, and when the k-bit multi-gray level display data corresponds to none of the preset voltages, the k-bit multi-gray level display data is converted to (i−1)-bit multi-gray level display data in accordance with an output and the (i−1)-bit multi-gray level display data is output, the output being either of a first gray-level pattern generating circuit for generating a first gray-level pattern which acquires a gray level during m frame periods (m is an integer not less than 2) or a second gray-level pattern generating circuit for generating a second gray-level pattern which acquires another gray level during n frame periods (where n is an integer greater than m).

A seventh aspect of this invention is a multi-gray level display apparatus in which one of preset voltages is selected in accordance with input multi-gray level display data, thereby to display an image at gray levels. The apparatus comprises a display panel having a plurality of pixels; a first gray-level pattern generating circuit having a first gray-level pattern which acquires a gray level during m frame periods (m is a positive integer not less than 2); a second gray-level pattern generating circuit having a second gray-level pattern which acquires another gray level during m frame periods and which differs from the first gray-level pattern; and selection control means for selecting and outputting one of the preset voltages, in accordance with an output from the first or second gray-level pattern generating circuit when the input multi-gray level display data corresponds to a gray level of either the first gray-level pattern or the second gray-level pattern.

An eighth aspect of the invention is a multi-gray level display apparatus which comprises: a display panel having a plurality of pixels each of which is driven by a voltage selected from a group of voltages in accordance with multi-gray level display data; a first gray-level pattern generating circuit for generating a first gray-level pattern which acquires a gray level during m frame periods (m is an integer not less than 2); a second gray-level pattern generating circuit for generating a second gray-level pattern which acquires another gray level during m frame periods and which differs from the first gray-level pattern; display data converting means for converting input k-bit multi-gray level display data (k is a positive integer greater than j) to j-bit multi-gray level display data; and an operation circuit for performing an operation on the j-bit multi-gray level display data in accordance with the first or second gray-level pattern when the k-bit multi-gray level display data corresponds to a display gray level based on the first or second gray-level pattern, and for outputting a result of the operation thus performed.

A ninth aspect of this invention is a method of displaying multi-gray level images in accordance with input k-bit multi-gray level display data (k is a positive integer greater than 2). When the k-bit multi-gray level display data corresponds to a preset voltage, the k-bit multi-gray level display data is converted to i-bit multi-gray level display data (i is a positive integer less than k) corresponding to the preset voltage and the i-bit multi-gray level display data is output. When the k-bit multi-gray level display data corresponds to none of the preset voltages, the k-bit multi-gray level display data is converted to i-bit multi-gray level display data in accordance with an output and the i-bit multi-gray level display data is output. The output is either of a first gray-level pattern generating circuit for generating a first gray-level pattern which acquires a gray level during m frame periods (m is an integer not less than 2) or a second gray-level pattern generating circuit for generating a second gray-level pattern which acquires another gray level during m frame periods and which differs from the first gray-level pattern.

A tenth aspect of this invention is a multi-gray level display apparatus in which one of preset voltages is selected in accordance with input multi-gray level display data to display an image at gray levels. The apparatus comprises: a display panel having a plurality of pixels; a first gray-level pattern generating circuit for generating a first gray-level pattern which acquires a gray level during m frame periods (m is a positive integer not less than 2) and which is provided for a plurality of pixels controlled as a unit and arranged in a first pattern; a second gray-level pattern generating circuit for generating a second gray-level pattern which acquires a gray level during m frame periods and which is provided for a plurality of pixels controlled as another unit and arranged in a second pattern different from the first pattern; and selection control means for selecting and outputting one of the preset voltages in accordance with an output from the first or second gray-level pattern generating circuit when the input multi-gray level display data corresponds to a gray level of either the first gray-level pattern or the second gray-level pattern.

An eleventh aspect of this invention is a multi-gray level display apparatus in which one of preset voltages is selected in accordance with input multi-gray level display data, to display an image at gray levels. The apparatus comprises: a display panel having at least a plurality of red pixels, a plurality of blue pixels and a plurality of green pixels; a first gray-level pattern generating circuit for generating a first gray-level pattern which acquires a gray level during m frame periods (m is a positive integer not less than 2) and which is provided for the plurality of red pixels controlled as a first unit; a second gray-level pattern generating circuit for generating a second gray-level pattern which acquires a gray level during m frame periods and which is provided for the plurality of green pixels controlled as a second unit; a third gray-level pattern generating circuit for generating a third gray-level pattern which acquires a gray level during m frame periods and which is provided for the plurality of blue pixels controlled as a third unit; and selection control means for selecting and outputting one of the preset voltages in accordance with an output from the first, second or third gray-level pattern generating circuit when the input multi-gray level display data corresponds to a gray level of the first gray-level pattern, the second gray-level pattern or the third gray-level pattern.

A twelfth aspect of the invention is a multi-gray level display apparatus in which one of preset voltages is selected in accordance with input multi-gray level display data to display an image at gray levels. The apparatus comprises: a display panel having at least a plurality of red pixels, a plurality of blue pixels and a plurality of green pixels; a gray-level pattern generating circuit for generating a gray-level pattern which acquires a gray level during m frame periods (m is a positive integer not less than 2) and which is provided for a group of pixels, including red, blue and green pixels which are controlled as a unit; and selection control means for selecting and outputting one of the preset voltages in accordance with an output from the gray-level pattern generating circuit when the input multi-gray level display data corresponds to a gray level of the gray-level pattern.

A thirteenth aspect of the invention is a multi-gray level display apparatus in which one of preset voltages is selected in accordance with input multi-gray level display data, thereby to display an image at gray levels. The apparatus comprises: a display panel having a plurality of pixels; a first gray-level pattern generating circuit for generating a first gray-level pattern which acquires a gray level during m frame periods (m is a positive integer not less than 2); a second gray-level pattern generating circuit for generating a second gray-level pattern which acquires another gray level during m frame periods; and selection control means for selecting and outputting at least one of the preset voltages or a preset voltage adjacent thereto in accordance with the first gray-level pattern when the input multi-gray level display data corresponds to a gray level of the first gray-level pattern, and selecting and outputting at least one of the preset voltages or a preset voltage next to the preset voltage which is adjacent to the at least one of the preset voltage, in accordance with the second gray-level pattern when the input multi-gray level display data corresponds to a gray level of the second gray-level pattern.

A fourteenth aspect of the invention is a method of displaying multi-gray level images by using a plurality of pixels, in accordance with input multi-gray level display data, wherein when the input multi-gray level display data corresponds to a gray level of a first gray-level pattern which acquires a gray level during m frame periods (m is a positive integer not less than 2), at least one of the preset voltages or a preset voltage adjacent thereto is selected and output in accordance with the first gray-level pattern, and when the input multi-gray level display data corresponds to a gray level of a second gray-level pattern which acquires a gray level during m frame periods, at least one of the preset voltages or a preset voltage next to the preset voltage which is adjacent to the at least one of the preset voltage is selected and output in accordance with the second gray-level pattern.

A fifteenth aspect of the invention is a multi-gray level display apparatus in which one of preset voltages is selected in accordance with input multi-gray level display data, thereby to display an image at gray levels. The apparatus comprises: a display panel having a plurality of pixels; a gray-level pattern generating circuit for generating a gray-level pattern which acquires a gray level during m frame periods (m is a positive integer not less than 2); and selection control means for selecting and outputting one of the preset voltages in accordance with the gray-level pattern when the input multi-gray level display data corresponds to a gray level of the gray-level pattern.

In the apparatuses and methods according to the first to sixth aspects of the present invention, two gray-level pattern garnering circuits are used. The first circuit generates a first gray-level pattern which acquires a gray level during m frame periods (m is a positive integer not less than 2). The second circuit generates a second gray-level pattern which acquires another gray level during n frame periods (n is a positive integer greater than m).

Input multi-gray level display data is converted to correspond to a preset voltage in accordance with an output of the first or second gray-level pattern generating circuit when the input gray-level display data corresponds to the display gray level of either the first gray-level pattern or the second gray-level pattern. Therefore, it is possible to display an image having a gray level other than the preset voltage.

As described above, the preset voltage is selected in accordance with the multi-gray level data and also with the output of the first or second gray-level pattern generating circuit which are controlled during different frame (F) periods. The number of frame (F) periods to be controlled need not be greatly increased to display multi-gray level images. Hence, multi-gray level images can be displayed without lowering their quality or causing flicker on them.

As indicated above, in the apparatuses and methods according to the seventh to ninth aspects of the present invention, two gray-level pattern generating circuits are used. The first gray-level pattern generating circuit generates a first gray-level pattern which acquires a gray level during m frame periods (m is a positive integer not less than 2). The second gray-level pattern generating circuit generates a second gray-level pattern which differs from the first gray-level pattern.

Input multi-gray level display data is converted to correspond to a preset voltage in accordance with an output of the first or second gray-level pattern generating circuit when the input gray-level display data corresponds to the display gray level of either the first gray-level pattern or the second gray-level pattern. It is possible to display an image having a gray level other than the preset voltage.

Since a gray level is controlled in accordance with at least two different gray-level patterns, multi-gray level images can be displayed without lowering their quality or causing flicker on them.

As described above, in the apparatuses and methods according to the tenth to twelfth aspects of the invention, a plurality of pixels arranged in a first pattern are controlled as a unit during m frame periods (m is a positive integer not less than 2) to acquire a gray level, and a plurality of pixels arranged in a second pattern are controlled as a unit during m frame periods to acquire a gray level.

Since the pixels are controlled in two or more different units, the pixels of each unit can be controlled in the way best possible to display an image. This makes it possible to display a multi-gray level image by using less voltages than otherwise.

In a display apparatus which has at least red (R) pixels, green (G) pixels and blue (B) pixels and which can therefore display color images, pixels including red, blue and green pixels are controlled as a unit, or red pixels, green pixels and blue pixels are controlled as respective units. This makes it possible to display multi-gray level images of high quality by using less voltages than otherwise.

As described above, in the apparatuses and methods according to the thirteenth and fourteenth aspects of the invention, at least one of the preset voltages or a preset voltage adjacent thereto is selected and output in accordance with a first gray-level pattern when input multi-gray level display data corresponds to a gray level of the first gray-level pattern, and at least one of the preset voltages or a preset voltage next to the preset voltage which is adjacent to the at least one of the preset voltage is selected and output in accordance with a second gray-level pattern when the input multi-gray level display data corresponds to a gray level of the second gray-level pattern. The number of frame (F) periods to be controlled need not be greatly increased to display multi-gray level images. Multi-gray level images can therefore be displayed without lowering their quality or causing flicker on them.

As indicated above, the apparatus according to the fifteenth aspect of the present invention comprises, a gray-level pattern generating circuit for generating a gray-level pattern which acquires a gray level during m frame periods (m is a positive integer not less than 2).

Input multi-gray level display data is converted to correspond to a preset voltage in accordance with an output of the gray-level pattern generating circuit when the input gray-level display data corresponds to the display gray level of the gray-level pattern. It is possible to display an image having a gray level other than the preset voltage.

Since the preset voltage is selected in accordance the preset voltage is selected in accordance with the multi-gray level data and also with the output of the first or second gray-level pattern generating circuit which are controlled during different frame (F) periods. The number of frame (F) periods to be controlled need not be greatly increased to display multi-gray level images. Hence, multi-gray level images can be displayed without lowering their quality or causing flicker on them.

BRIEF DESCRIPTION OF THE DRAWINGS

FIGS. 8(*a*)–(*b*) are diagrams explaining a method of forming a gray-level pattern based on the perfect magic square shown in FIG. 6;

FIG. 9 is a diagram explaining a method of forming another gray-level pattern based on the perfect magic square shown in FIG. 6;

FIGS. 10(*a*)–(*d*) are diagrams illustrating the gray-level patterns for 4×4 matrix which have been formed based on the perfect magic square of FIG. 6 and which are stored in the first gray-level pattern generating circuit shown in FIG. 1;

FIGS. 11(*a*)–(*f*) are diagrams depicting gray-level patterns for 6×6 matrix which have been formed based on the perfect magic square and which are stored in the second gray-level pattern generating circuit shown in FIG. 1;

FIG. 16 is a diagram illustrating a unit to be controlled in the liquid crystal display shown in FIG. 15;

FIG. 17 is a diagram explaining the principle of a multi-gray level image display operation of the liquid crystal display shown in FIG. 15;

FIG. 18 is a diagram showing the auxiliary magic square formulated based on a magic square in the liquid crystal display shown in FIG. 15;

FIGS. 19(*a*)–(*f*) are diagrams illustrating the gray-level pattern stored in the first gray-level pattern generating circuit (FIG. 15) and used to provide a 1/6 gray level;

FIGS. 20(*a*)–(*f*) are diagrams illustrating the gray-level pattern stored in the first gray-level pattern generating circuit (FIG. 15) and used to provide a 2/6 gray level;

FIGS. 21(*a*)–(*f*) are diagrams illustrating the gray-level pattern stored in the first gray-level pattern generating circuit (FIG. 15) and used to provide a 3/6 gray level;

FIGS. 22(*a*)–(*f*) are diagrams illustrating the gray-level pattern stored in the first gray-level pattern generating circuit (FIG. 15) and used to provide a 4/6 gray level;

FIGS. 23(*a*)–(*f*) are diagrams illustrating the gray-level pattern stored in the first gray-level pattern generating circuit (FIG. 15) and used to provide a 5/6 gray level;

FIGS. 24(*a*)–(*f*) are diagrams illustrating the gray-level pattern stored in the second gray-level pattern generating circuit (FIG. 15) and used to provide a 2/6 gray level;

FIGS. 25(*a*)–(*f*) are diagrams illustrating the gray-level pattern stored in the third gray-level pattern generating circuit (FIG. 15) and used to provide a 2/6 gray level;

FIGS. 26(*a*)–(*f*) are diagrams illustrating the gray-level pattern stored in the fourth gray-level pattern generating circuit (FIG. 15) and used to provide a 2/6 gray level;

FIGS. 30(*a*)–(*f*) are diagrams illustrating the gray-level pattern stored in the red(R)-dot gray-level pattern generating circuit (FIG. 28) and used to provide a 1/6 gray level;

FIGS. 31(*a*)–(*f*) are diagrams illustrating the gray-level pattern stored in the red(R)-dot gray-level pattern generating circuit (FIG. 28) and used to provide a 2/6 gray level;

FIG. 32(*a*)–(*f*) are diagrams illustrating the gray-level pattern stored in the red(R)-dot gray-level pattern generating circuit (FIG. 28) and used to provide a 3/6 gray level;

FIG. 33(*a*)–(*f*) are diagrams illustrating the gray-level pattern stored in the red(R)-dot gray-level pattern generating circuit (FIG. 28) and used to provide a 4/6 gray level;

FIGS. 34(*a*)–(*f*) are diagrams illustrating the gray-level pattern stored in the red(R)-dot gray-level pattern generating circuit (FIG. 28) and used to provide a 5/6 gray level;

FIGS. 35(*a*)–(*b*) are diagrams illustrating the gray-level pattern stored in the green(G)-dot gray-level pattern generating circuit (FIG. 28) and used to provide a 2/6 gray level;

FIGS. 36(*a*)–(*f*) are diagrams illustrating the gray-level pattern stored in the blue(B)-dot gray-level pattern generating circuit (FIG. 28) and used to provide a 2/6 gray level;

FIGS. 37(*a*)–(*f*) are diagrams illustrating the gray-level pattern stored in the pixel gray-level pattern generating circuit (FIG. 28) and used to provide a 2/6 gray level;

FIGS. 44(*a*)–(*d*) are diagrams depicting the gray-level patterns for 4×4 matrix which have been formed based on the perfect magic square of FIG. 6 and which are stored in the first to third gray-level pattern generating circuits shown in FIG. 39;

FIGS. 45(*a*)–(*d*) are diagrams depicting the gray-level patterns for 4×4 matrix which have been formed based on the perfect magic square of FIG. 6 and which are stored in the fourth and fifth gray-level pattern generating circuits shown in FIG. 39;

DETAILED DESCRIPTION OF THE PREFERRED EMBODIMENTS

An active-matrix liquid crystal display according to the first embodiment of the present invention will be described below, with reference to the accompanying drawings. This liquid crystal display is designed to display an image at 64 ($=2^6$) gray levels.

Figure 1:
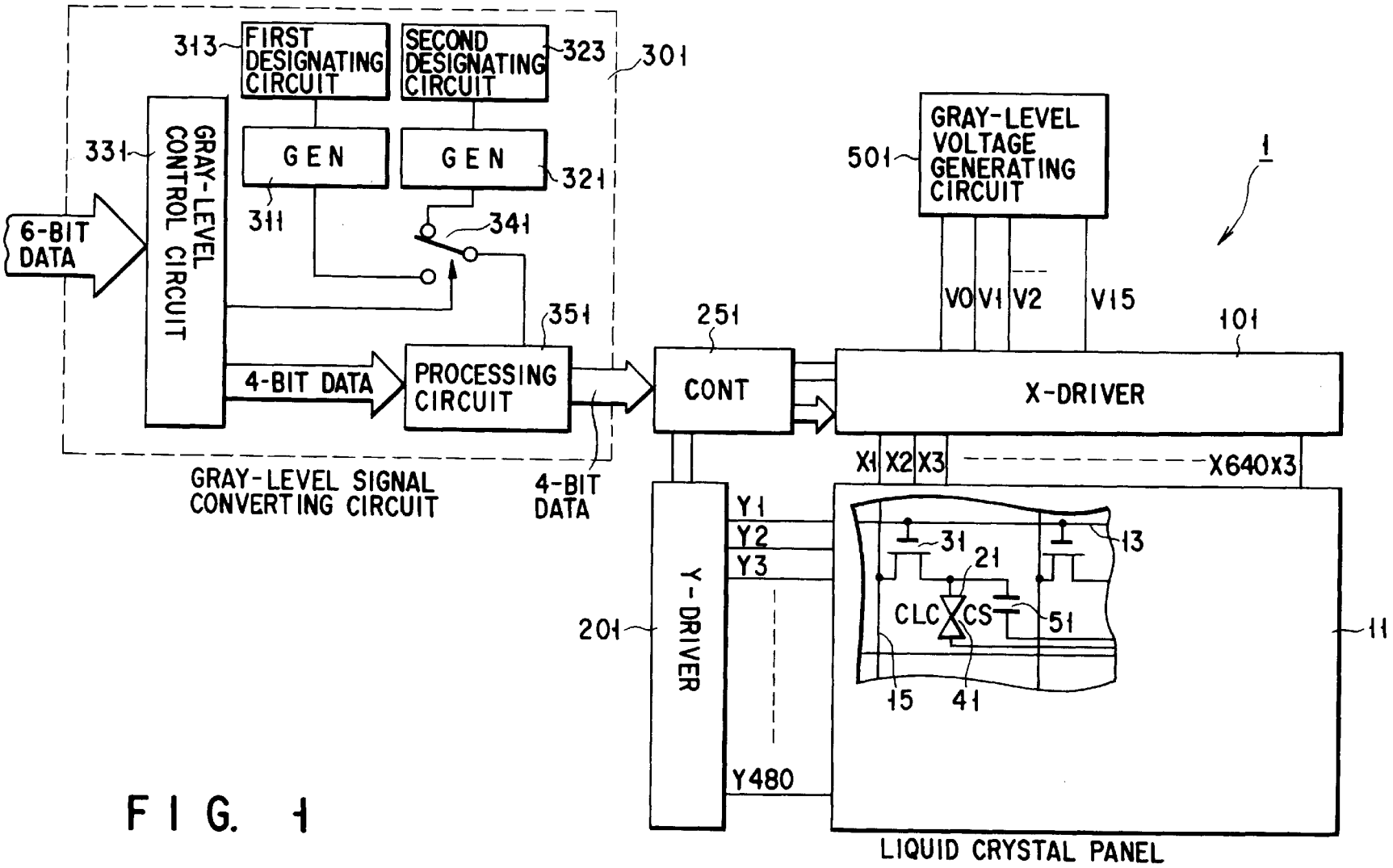
FIG. 1 is a diagram schematically showing a liquid crystal display according to a first embodiment of the present invention.
Figure 3:
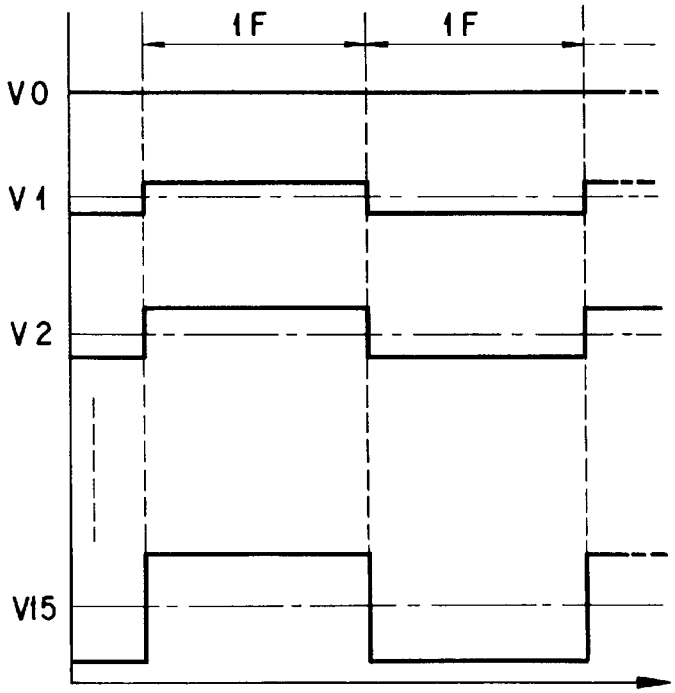
FIG. 3 is a diagram illustrating the waveforms of gray-level voltages generated by the gray-level voltage voltage generating circuit shown in FIG. 1.

As shown in FIG. 1, the liquid crystal display 1 comprises a liquid crystal panel 11 capable of displaying a color image and having a matrix of pixels arrayed in (640×3) rows and 480 columns, an X driver 101 and Y driver 201 electrically connected to the liquid crystal panel 11, a liquid crystal controller 251 for controlling the X driver 101 and the Y driver 201, a gray-level signal converting circuit 301 for converting 6-bit gray-level display data external input to a 4-bit gray-level display data and for outputting the 4-bit gray-level display data to the liquid crystal controller 251, and a gray-level voltage generating circuit 501 for generating 16 gray-level voltages (V0, V1, V2, . . . V15), each having a square waveform and inverted in polarity with respect to a reference voltage in every one-frame (F) period as shown in FIG. 3, and for outputting the 16 gray-level voltages to the X driver. In the first embodiment, frame-inversion driving is employed. Nonetheless, this driving scheme may be used in combination with line-inversion driving or the like in order to prevent flicker and the like. In this case, square-wave voltages, each inverted in polarity with respect to the reference voltage, not only in every one-frame (F) period but also in every horizontal scanning-line period, may be used as gray-level voltages (V0, V1, V2, . . . V15).

The liquid crystal panel 11 is of so-called active-matrix type. A TFT 31 is provided for each of its pixel electrodes 21. A scanning pulse (VG) is supplied from the Y driver 201 formed of a shift register to a scanning line 13 connected to the TFT 31, setting the TFT 31 in conducting state for a predetermined time. The gray-level voltage applied from a signal line 15 connected to the X driver 101 is transferred into the pixel electrode 21 through the TFT 31. The voltage is held for a one-frame (F) period in a liquid-crystal capacitance (Clc) and also in an auxiliary capacitance (Cs) juxtaposed with the liquid-crystal capacitance by virtue of a capacitance line 51, so as to form an image.

Figure 2:
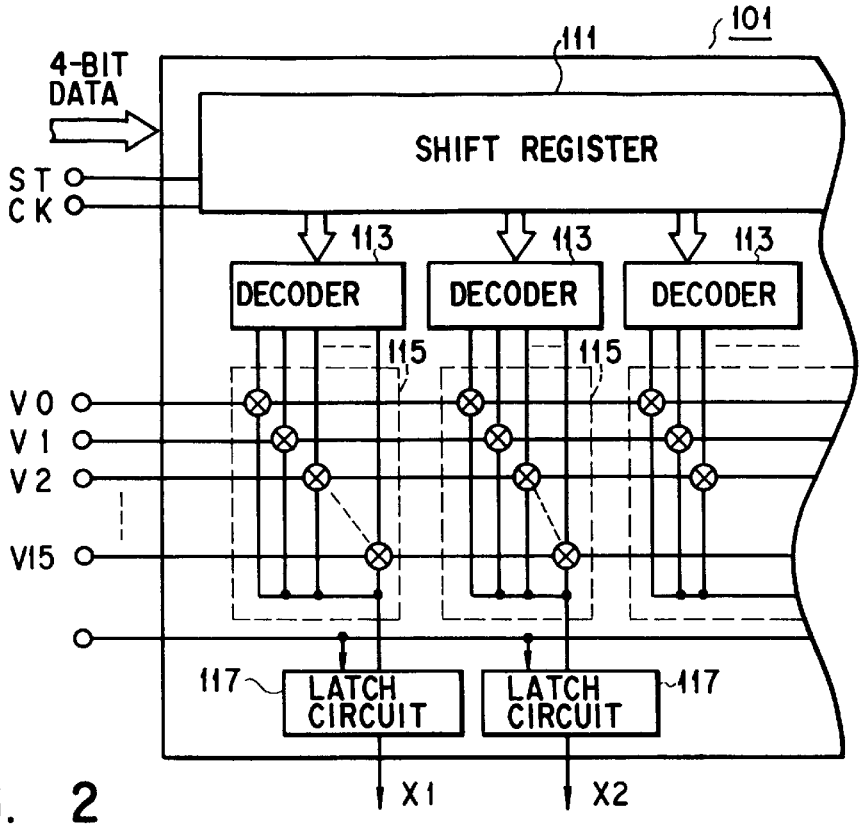
FIG. 2 is a diagram schematically illustrating the X driver shown in FIG. 1.

As shown in FIG. 2, the X driver 101 comprises a shift register 111 for sequentially transferring the 4-bit gray-level display data input to it, in response to a shift clock signal (CK) and a start pulse (ST), decoders 113 for converting an output from the shift register 111, selection circuits 115 for selecting and outputting one of the 16 gray-level voltages (V0, V1, . . . V15) in accordance with the outputs of the decoders 113, and latch circuits 117 for holding the outputs from the selection circuits 115 for a predetermined period of time.

The gray-level signal converting circuit 301 incorporated in the liquid crystal display 1 will now be described.

The gray-level signal converting circuit 301 comprises a gray-level control circuit 331 for converting the externally input 6-bit gray-level display data to a 4-bit gray-level display data, which will serve to select any one of the 16 gray-level voltages (V0, V1, . . . V15) preset in the gray-level voltage generating circuit 501.

The circuit 301 further comprises a processing circuit 351. If the 4-bit gray-level display data obtained by the conversion corresponds to one of the gray-level voltages preset in the gray-level voltage generating circuit 501, the circuit 351 will output the data without processing it. If the 4-bit gray-level display data corresponds a gray level intermediate between the gray-level voltages preset in the gray-level voltage generating circuit 501, the circuit 351 will process the data to obtain the intermediate gray level and will then output the data thus processed.

In the gray-level signal converting circuit 301, it is connected by a selection circuit 341 to a first gray-level pattern generating circuit 311 and a second gray-level pattern generating circuit 321 to process the 4-bit gray-level display data. The selection circuit 341 is designed to select either the first gray-level pattern generating circuit 311 or the second gray-level pattern generating circuit 321 in accordance with an output from the gray-level control circuit 331 when the externally input 6-bit gray-level display data corresponds to the gray level intermediate between the gray-level voltages preset in the gray-level voltage generating circuit 501.

Figure 4A:
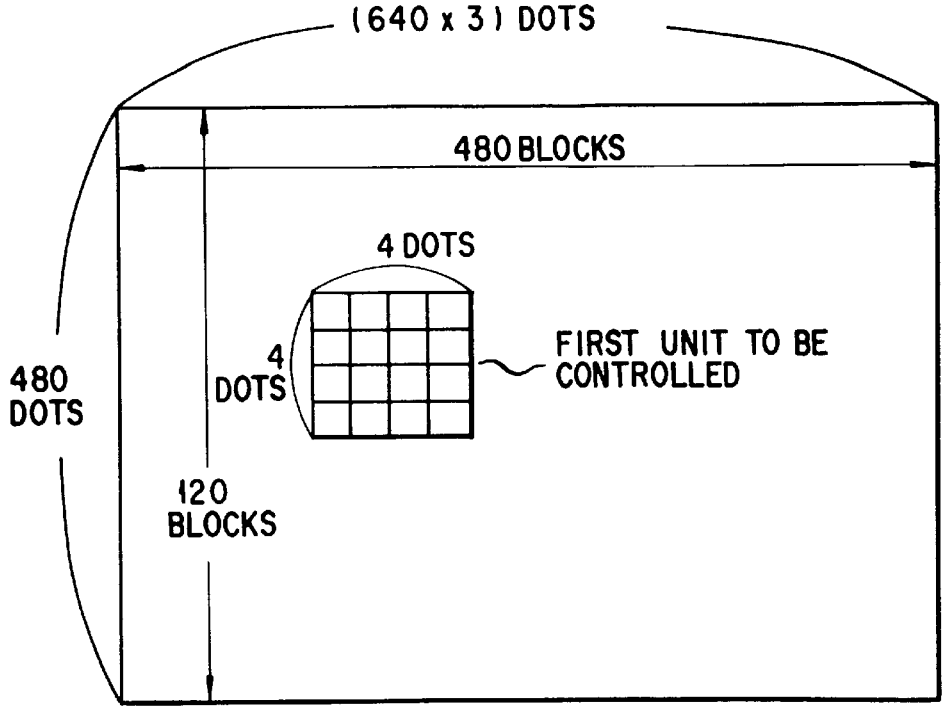
FIGS. 4(*a*)–(*b*) are diagrams representing a unit to be controlled by the gray-level pattern generating circuit shown in FIG. 1.
Figure 4B:
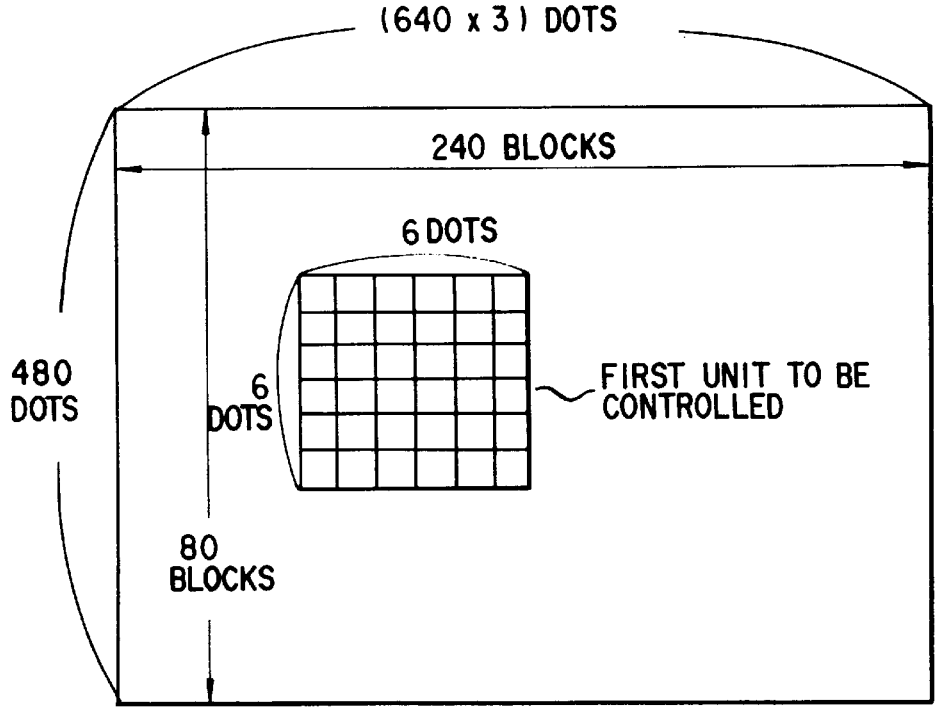

The first gray-level pattern generating circuit 311 serves to divide the display pixel region of the liquid crystal panel 11 into 120 (rows)×480 (columns) blocks, each of which is formed of adjacent 16 pixels arranged in four rows and four columns (forming a 4×4 square matrix) as shown in FIG. 4(*a*) and determines a first unit to be controlled. The first gray-level pattern generating circuit 311 controls each first unit of control during a first display period which consists of four consecutive frame (F) periods. As shown in FIG. 10(*a*), each gray-level pattern is therefore formed of four tables, each comprised of 16 gray-level auxiliary data items so as to represent one gray level. The first gray-level pattern generating circuit 311 stores three gray-level patterns of this type.

The second gray-level pattern generating circuit 321 serves to divide the display pixel region of the liquid crystal panel 11 into 80 (rows)×320 (columns) blocks, each of which is formed of adjacent 36 pixels arranged in six rows and six columns (forming a 6×6 square matrix) as shown in FIG. 4(*b*), and determined as a second unit to be controlled. The second gray-level pattern generating circuit 321 controls each first unit of control during a first display period which consists of six consecutive frame (F) periods. Hence, each gray-level pattern is formed of six tables shown in FIGS. 11(*a*)–(*f*), each comprised of 36 gray-level auxiliary data items to represent one gray level. The second gray-level pattern generating circuit 321 stores two gray-level patterns of this type.

The first gray-level pattern generating circuit 311 is connected to a first designating circuit 313 which comprises a 4-frame counter for selecting one of the first to fourth tables in each gray-level pattern shown in FIG. 10 and a 4-line counter and 4-column counter for obtaining gray-level auxiliary data items from the table, each data item corresponding to a pixel. The second gray-level pattern generating circuit 321 is connected to a second designating circuit 323 which comprises a 6-frame counter for selecting one of the first to sixth tables in each gray-level pattern shown in FIG. 11 and a 6-line counter and 6-column counter for obtaining gray-level auxiliary data items from each table, each data item corresponding to a pixel.

In the gray-level signal converting circuit 301, thus constructed, the gray-level control circuit 331 converts the externally input 6-bit gray-level display data to 4-bit gray-level display data. If the 4-bit display data corresponds to one of the gray-level voltages preset in the gray-level voltage generating circuit 501, it is output to the X driver 101 through the liquid crystal controller 251, without being processed by the processing circuit 351. If the 4-bit display data corresponds to an intermediate gray level between the gray-level voltages preset in the gray-level voltage generating circuit 501, the processing circuit 351 processes the data based on the gray-level auxiliary data items stored in one of the first gray-level pattern generating circuit 311 and the second gray-level pattern generating circuit 321 which is selected by the selection circuit 341 to obtain the intermediate gray level. The 4-bit gray-level display data, thus processed, is output to the X driver 101 through the liquid crystal controller 251.

A method of providing an intermediate gray level in the liquid crystal display 1 of the first embodiment will be explained in detail. In the liquid crystal display having 16 square-wave gray-level voltages (V0, V1, V2, . . . V15), an image can be displayed at 16-gray levels by selecting one of the gray-level voltages (V0, V1, V2, . . . V15). In order to display the image at 64 gray levels by using 16 square-wave gray-level voltages (V0, V1, V2, . . . V15), the liquid crystal display 1 operates as will be described below.

A ¼ gray level between a gray-level voltage (Vi) (i=0, 1, 2, . . . 14) and the next gray-level voltage (Vi+1) is provided by selecting the gray-level voltage (Vi) during three of four consecutive frame (F) periods and the next gray-level voltage (Vi+1) during the remaining one frame (F) period. A ¾ gray level between a gray-level voltage (Vi) and the next gray-level voltage (Vi+1) is provided by selecting the gray-level voltage (Vi) during two of four consecutive frame (F) periods and the next gray-level voltage (Vi+1) during the remaining two frame (F) periods. A ¾ gray level between a gray-level voltage (Vi) and the next gray-level voltage (Vi+1) is provided by selecting the gray-level voltage (Vi) during one of four consecutive frame (F) periods and the next gray-level voltage (Vi+1) during the remaining three frame (F) periods.

A ⅔ gray level between a gray-level voltage (Vi) and the next gray-level voltage (Vi+1) is provided by selecting the gray-level voltage (Vi) during four of six consecutive frame (F) periods and the next gray-level voltage (Vi+1) during the remaining two frame (F) periods. A ⅔ gray level between a gray-level voltage (Vi) and the next gray-level voltage (Vi+1) is provided by selecting the gray-level voltage (Vi) during two of six consecutive frame (F) periods, and by selecting the next gray-level voltage (Vi+1) during the remaining four frame (F) periods.

Figure 5:
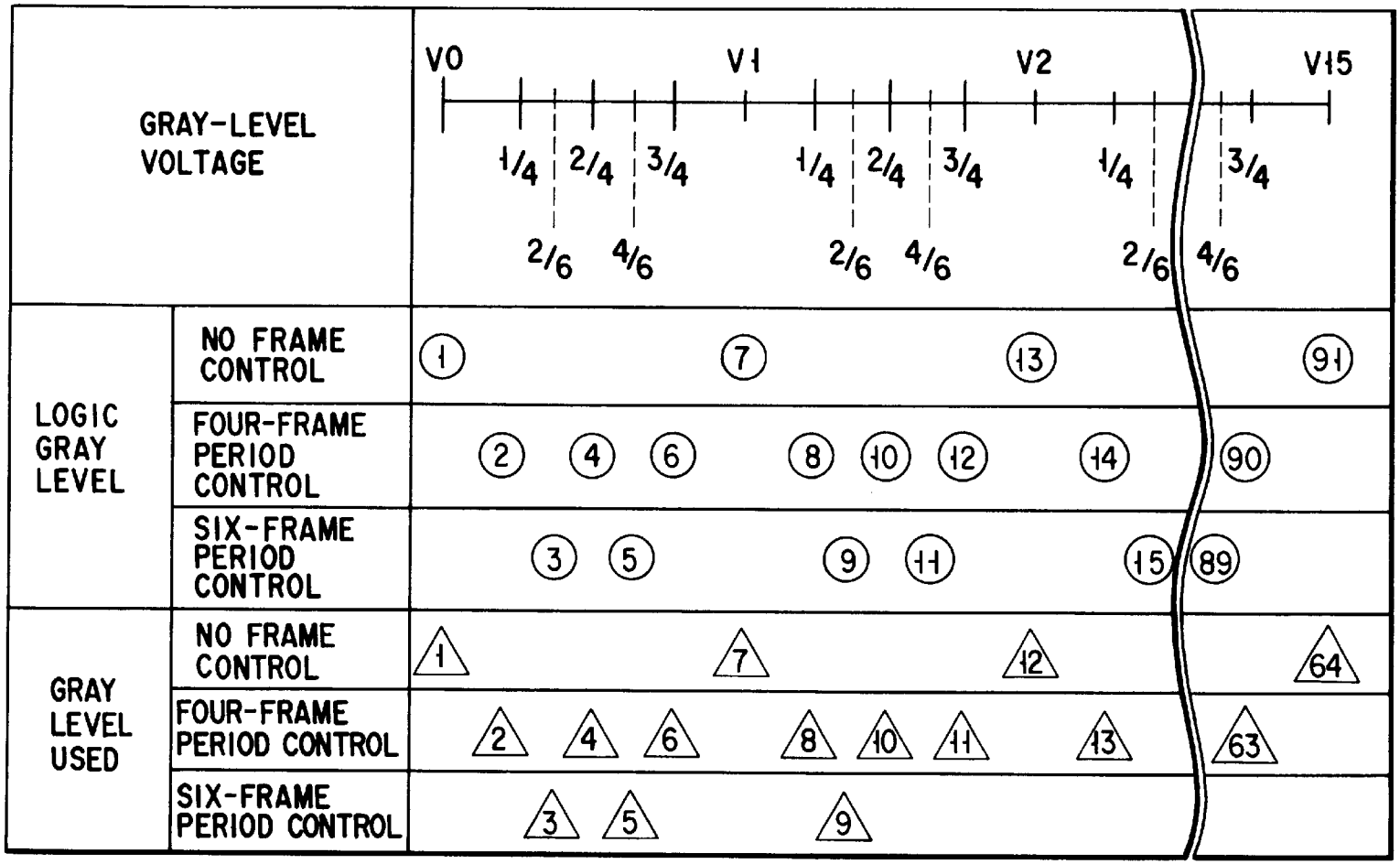
FIG. 5 is a diagram explaining the principle of a multi-gray level image display operation of the liquid crystal display shown in FIG. 1.

Since the control of the frame (F) periods is effected in combination with the 16 gray-level voltages (V0, V1, . . . V15), it is theoretically possible to provide 91 gray levels as shown in FIG. 5. Of these 91 gray levels, 64 gray levels which achieve particularly desirable display condition are selected in the first embodiment, thereby to display an image at 64 gray levels. The first embodiment uses the ⅔ and ⅔ gray levels (logic gray levels 3 and 5 shown in FIG. 5) between the gray-level voltage (V0) and the gray-level voltage (V1), and the ⅔ gray level (logic gray level 9 shown in FIG. 5) between the gray-level voltage (V1) and the gray level voltage (V2), for the purpose of displaying an image, and does not use the other ⅔ and ⅔ gray levels, which are between the other gray-level voltage (Vi) and the gray-level voltage (Vi+1), for the purpose of displaying an image.

Furthermore, each ⅙ gray level between the gray-level voltage (Vi) and the next gray-level voltage (Vi+1) may be provided by selecting the gray-level voltage (Vi) during the five of six consecutive frame (F) periods and the gray-level voltage (Vi+1) during the remaining one frame (F) period, for example. These gray levels may be combined with those described above, thereby to increase the number of gray levels. When levels lower than the ¼ gray level or gray levels higher than the ¾ gray level are utilized, flicker may be visually recognized, in some cases, on a part of the image displayed. This is why these gray level are not used in the first embodiment.

The gray-level patterns used in the first embodiment will be described in detail, one by one, with reference to FIGS. 6 to 11(*a*)–(*f*). Selection of a gray-level pattern is based on the concept of a perfect magic square or a magic square.

A perfect magic square is an N×N matrix of integers of 1 to $N^2$, where the sum of the integers of each row, each column, and each diagonal is the same. On the other hand, a magic square is an N×N matrix of integers of 1 to $N^2$, where the sum of the integers of each row and each column is the same.

Any matrix other than a (4r+2)×(4r+2) matrix (r is a positive integer greater than 0) can be a perfect magic square. Therefore, of the gray-level patterns used in the first embodiment, the 4×4 matrices are formulated based on a perfect magic square, while the 6×6 matrices based on a magic square.

Figure 6:
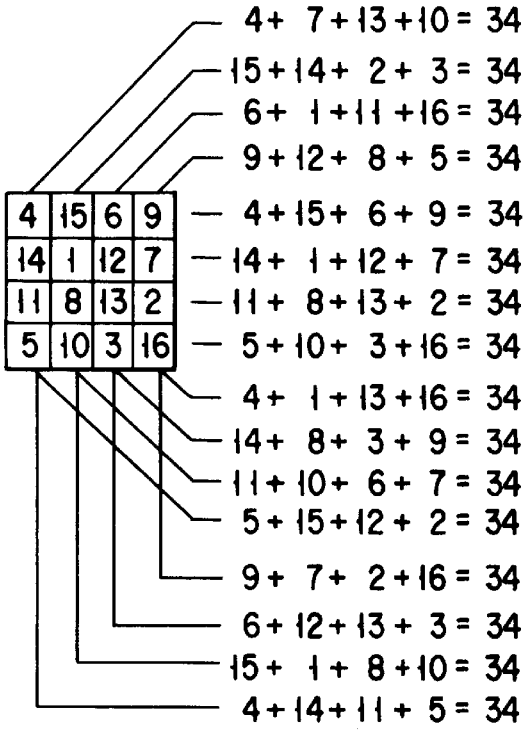
FIG. 6 is a diagram explaining a perfect magic square of 4×4 matrix.
Figure 7:
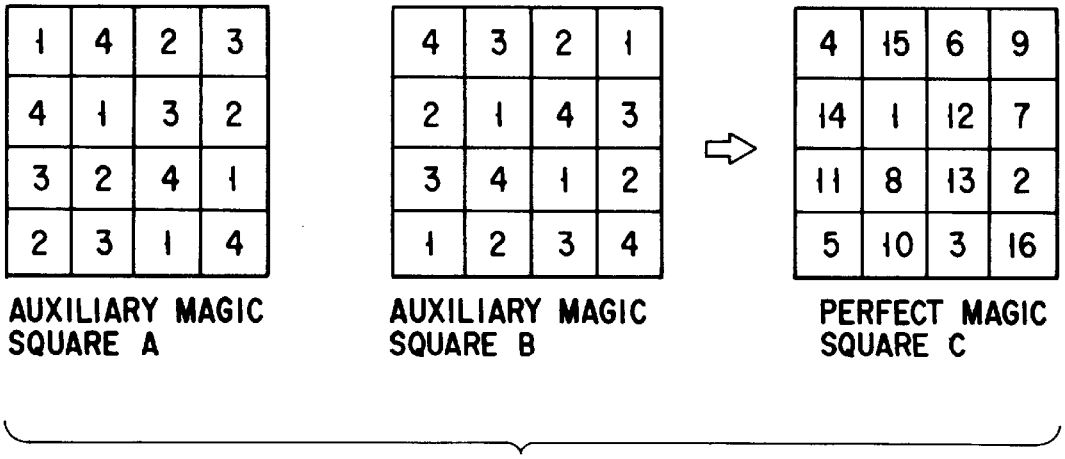
FIG. 7 is a diagram explaining a method of formulating the perfect magic square of 4×4 matrix, illustrated in FIG. 6.

FIG. 6 shows a perfect magic square of 4×4 matrix of different numbers of 1 to 16. This perfect magic square can be formulated from auxiliary magic squares each of which is a 4×4 matrix of integers of 1 to 4 and where the sum of the integers of each row, each column, and each diagonal is the same. More specifically, as shown in FIG. 7, it can be obtained from two different auxiliary magic squares A and B, by applying the equation of [4×(a−1)+B], where a and b are the numbers assuming the same position in the auxiliary magic squares A and B.

Each of the gray-level patterns is selected from the perfect magic square thus formulated, in the following way.

To set a pixel at a ¼ gray level between the gray-level voltage (Vi) and the next gray-level voltage (Vi+1), it suffices to select the gray-level voltage (Vi+1) during only one of four consecutive frame (F) periods and the gray-level voltage (Vi) during the remaining three frame (F) periods. Thus, as shown in FIG. 8(*a*), ON data {1} is allocated, as a gray-level auxiliary data item, to part of the matrix where numbers 1 to 4 are positioned, and OFF data {0} is allocated, as a gray-level auxiliary data item, to part of the matrix where the remaining numbers are positioned, thereby forming the first of the four tables which are required to provide a ¼ gray level of the first gray-level pattern. Also, as illustrated in FIG. 8(*a*), ON data {1} is allocated, as a gray-level auxiliary data item, to part of the matrix where numbers 5 to 8 are positioned, and OFF data {0} is allocated, as a gray-level auxiliary data item, to part of the matrix where the remaining numbers are positioned, thereby forming the second of the four tables which are required to provide a ¼ gray level of the first gray-level pattern. Further, ON data {1} is allocated, as a gray-level auxiliary data item, to part of the matrix where numbers 9 to 12 are positioned, and OFF data {0} is allocated, as a gray-level auxiliary data item, to part of the matrix where the remaining numbers are positioned, thereby forming the third of the four tables which are required to provide a ¼ gray level of the first gray-level pattern. Still further, ON data {1} is allocated, as a gray-level auxiliary data item, to part of the matrix where numbers 13 to 16 are positioned, and OFF data {0} is allocated, as a gray-level auxiliary data item, to part of the matrix where the remaining numbers are positioned, thereby forming the last of the four tables which are required to provide a ¼ gray level of the first gray-level pattern. Shown in FIG. 8(*b*) are diagonals approximated to the numbers to which ON data {1} has been allocated as a gray-level auxiliary data item.

The first to fourth tables, thus formed, are sequentially repeated during four frame (F) periods which define one display period, thereby providing a ¼ gray level between the gray-level voltage (Vi) and the next gray-level voltage (Vi+1). In the first embodiment, the table to be used is changed such that the axis of data group rotates 90° for each frame period. To be more precise, the table to be used is changed in the order of: the first table, the second table, the fourth table, and the third table. As a result, a gray-level pattern is generated which is required to provide a ¼ gray level between the gray-level voltage (Vi) and the next gray-level voltage (Vi+1). Since the order of selecting the tables is determined such that each table may have an axis different from that of the table which can be selected during the next frame (F) period, it is possible to effectively stabilize the gray level, and reduce the flicker on the displayed image.

To set a pixel at a ¾ gray level between the gray-level voltage (Vi) and the next gray-level voltage (Vi+1), it suffices to select the gray-level voltage (Vi+1) during two of four consecutive frame (F) periods and the gray-level voltage (Vi) during the remaining two frame (F) periods. Then, as shown in FIG. 9, ON data {1} is allocated, as a gray-level auxiliary data item, to part of the matrix where numbers 1 to 8 are positioned, and OFF data {0} is allocated, as a gray-level auxiliary data item, to part of the matrix where the remaining numbers are positioned, thereby forming the first of the four tables which are required to provide a ¾ gray level of the first gray-level pattern. Also, ON data {1} is allocated, as a gray-level auxiliary data item, to part of the matrix where numbers 9 to 15 are positioned, and OFF data {0} is allocated, as a gray-level auxiliary data item, to part of the matrix where the remaining numbers are positioned, thereby forming the second of the four tables which are required to provide a ¾ gray level of the first gray-level pattern. Similarly, the third and fourth of the four tables required to provided a ¾ gray level of the first gray-level pattern are formed. As a result, there is formed a gray-level pattern for providing a ¾ gray level between the gray-level voltage (Vi) and the next gray-level voltage (Vi+1). The first to fourth tables, thus formed, are sequentially repeated during four frame (F) periods which define one display period, thereby providing a ¾ gray level between the gray-level voltage (Vi) and the next gray-level voltage (Vi+1).

To set a pixel at a ¾ gray level between the gray-level voltage (Vi) and the next gray-level voltage (Vi+1), it suffices to select the gray-level voltage (Vi+1) during three of four consecutive frame (F) periods and the gray-level voltage (Vi) during the remaining one frame (F) period. Hence, a gray-level pattern is obtained by inverting the gray-level auxiliary data items of the four tables for providing a ¼ gray level, which are shown in FIGS. 10(*a*)–(*d*). The first to fourth tables, thus formed, are sequentially repeated during four frame (F) periods which define one display period, thereby providing a ¾ gray level between the gray-level voltage (Vi) and the next gray-level voltage (Vi+1).

Since the gray-level pattern consists of 4×4 matrices which are perfect magic squares, the frame (F) period or periods for selecting the gray-level voltage (Vi) and the frame (F) period or periods for selecting the next gray-level voltage (Vi+1) are uniformly dispersed even if a plurality of adjacent pixels are to be set at the same gray level intermediate between the gray-level voltage (Vi) and the next gray-level voltage (Vi+1). This prevents flicker and the like.

To set a pixel at a 2/6 gray level or a 4/6 gray level, either being between the gray-level voltage (Vi) and the next gray-level voltage (Vi+1), 6×6 matrices which are magic squares are used, forming a gray-level pattern comprised of six tables shown in FIGS. 11(*a*)–(*f*). This is because there are no perfect magic squares.

The gray-level patterns, thus formed, are stored in the gray-level pattern generating circuits 311 and 321 each of which is formed of a RAM. Although the gray-level pattern generating circuits 311 and 321 are formed of RAMs in the first embodiment, they may formed of ROMs instead.

Figure 12:
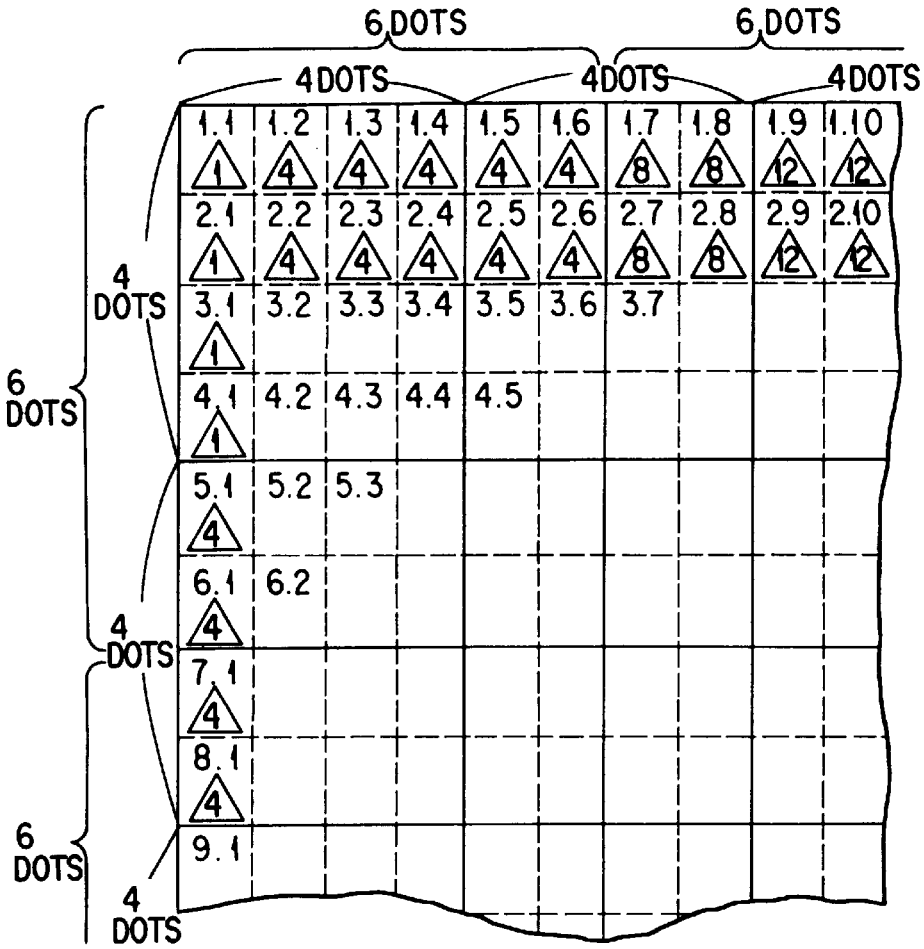
FIG. 12 is a diagram representing an example of a display state of the liquid crystal display shown in FIG. 1.

FIG. 12 is a diagram representing an example of a display state of the liquid crystal panel 11. How the liquid crystal display 1 operates to obtain the state will be explained.

To set the pixel (1,1) at the first gray level, 6-bit gray-level display data {000000} corresponding to the first gray level is input to the gray-level signal converting circuit 301. In the gray-level signal converting circuit 301, the gray-level control circuit 331 converts the 6-bit gray-level display data {000000} to 4-bit gray-level display data {0000} representing 16 gray-level voltages (V0, V1, . . . V15). The 6-bit gray-level display data {000000} for providing the first gray level corresponds to the gray-level voltage (V0), i.e., one of the 16 gray-level voltages (V0, V1, . . . V15). The 4-bit gray-level display data {0000} is output to the liquid crystal controller 251, without being processed by the processing circuit 351. The X driver selects the gray-level voltage (V0) in accordance with the 4-bit gray-level display data {0000}, whereby a drive voltage is applied to the pixel (1,1). The pixel (1,1) is thereby set at the first gray level.

To set the pixel (1,2) at the fourth gray level, 6-bit gray-level display data {000011} corresponding the fourth gray level is input to the gray-level signal converting circuit 301. The gray-level control circuit 331 converts the 6-bit gray-level display data {000011} to 4-bit gray-level display data {0000} representing 16 gray-level voltages (V0, V1, . . . V15). The 6-bit gray-level display data {000011} for providing the fourth gray level corresponds to a 2/4 gray level between the gray-level voltage (V0) and the next gray-level voltage (V1). This 6-bit gray-level display data therefore needs to be controlled by the first gray-level pattern generating circuit 311. The selection circuit 341 selects the first gray-level pattern generating circuit 311. The first designating circuit 313 reads OFF data {0} from the first table for 2/4 gray-level shown in FIG. 10(*a*). The OFF data {0} is the gray-level auxiliary data which corresponds to the pixel (1,2) and which designates the first line and the second column of the first table. The the processing circuit 351 adds the OFF data {0} read from the first gray-level pattern generating circuit 311, to the 4-bit gray-level display data {0000}. The 4-bit gray-level display data {0000} is supplied from the processing circuit 351 to the X driver 101 through the liquid crystal controller 251. The X driver 101 selects and outputs the gray-level voltage (V0) in accordance with the 4-bit gray-level display data {0000}.

To set the pixel (1,2) at the fourth gray level during the second frame (F) period, as in the first frame (F) period, ON data {1} is read from the second table for 2/4 gray-level shown in FIG. 10(*b*) and used as gray-level auxiliary data. The gray-level auxiliary data is added to the 4-bit gray-level display data {0000} by the processing circuit 351. In accordance with this 4-bit gray-level display data {0001} the X driver 101 selects and outputs the gray-level voltage (V1).

To set the pixel (1,2) at the fourth gray level during the third frame (F) period, as in the first frame (F) period, OFF data {0} is read from the third table for 2/4 gray-level shown in FIG. 10(*c*) and used as gray-level auxiliary data. The gray-level auxiliary data is added to the 4-bit gray-level display data {0000} by the processing circuit 351. In accordance with this 4-bit gray-level display data {0000} the X driver 101 selects and outputs the gray-level voltage (V0).

To set the pixel (1,2) at the fourth gray level during the fourth frame (F) period, as in the first frame (F) period, ON data {1} is read from the fourth table for 2/4 gray-level shown in FIG. 10(*d*) and used as gray-level auxiliary data. The gray-level auxiliary data is added to the 4-bit gray-level display data {0000} by the processing circuit 351. In accordance with this 4-bit gray-level display data {0001} the X driver 101 selects and outputs the gray-level voltage (V1).

In the case where 6-bit gray-level display data items {000011} for providing the fourth gray level are continuously input, four consecutive frame (F) periods are determined as one display period to set a pixel at the fourth gray level.

To set, for example, the pixel (1,3) adjacent to the pixel (1,2) at the fourth gray level, too, a gray-level pattern is selected such that the frame (F) period for selecting the gray-level voltage (V0) and the frame period for selecting the gray-level voltage (V1) are well balanced for adjacent pixels such as the pixel (2,1) and the pixel (1,3). This prevents flicker and the like.

In the case described above, the 6-bit gray-level display data {000011} is input for the four consecutive frame (F) periods in order to set the pixel (1,2) at the fourth gray level. Nonetheless, a different 6-bit gray-level display data may be input for each frame (F) period to display a moving image.

It will now be explained a case where 6-bit gray-level display data {000100} for providing the fifth gray level is input during the second frame (F) period. The gray-level control circuit 331 converts this 6-bit gray-level display data {000100} to 4-bit gray-level display data {0000} corresponding to 16 gray-level voltages (V0, V1, . . . V15), in the same way as described above. The 6-bit gray-level display data {0000100} is to provide the fifth gray level which is an intermediate gray level corresponding to none of the 16 gray-level voltages (V0, V1, . . . V15). It therefore needs to be controlled by the second gray-level pattern generating circuit 311. The processing circuit 351 adds the ON data {1} read as gray-level auxiliary data from the second table (FIG. 11) for the 2/6 gray level to the 4-bit gray-level display data {0000} obtained by converting the 6-bit gray-level display data. In accordance with the 4-bit gray-level display data, the X driver 101 outputs the gray-level voltage (V1).

When a moving image is displayed, the 6-bit gray-level display data input for one pixel is changed for each frame (F) period. In this case, some gray levels set by using the 16 gray-level voltages (V0, V1, . . . V15) will be incorrect. However, the incorrect gray levels can hardly be recognized visually. For this reason, as described above, the display control for each frame (F) period is effected based on the 6-bit gray-level display data input. In view of this, it is desirable to use the control in combination with 16 or more gray-level voltages (V0, V1, . . . V15).

It will now be explained how the pixel (1,5) is set at the fourth gray level as shown in FIG. 12. The 6-bit gray-level display data {000011} corresponding to the fourth gray level is converted to 4-bit gray-level display data {0000} in the same way as described above. Since the 4-bit gray-level display data is an intermediate gray level corresponding to none of the 16 gray-level voltages (V0, V1, . . . V15). It therefore needs to be controlled by the first gray-level pattern generating circuit 311. The processing circuit 351 adds ON data {1} to the 4-bit gray-level display data {0000}, the ON data {1} used as gray-level auxiliary data for the first line and the first column of the first table which forms the ¾ gray-level pattern shown in FIG. 6. The 4-bit gray-level display data {0001} generated by the circuit 351 is output to the X driver 101 through the liquid crystal controller 251. The X driver 101 selects and outputs the gray-level voltage (V1) based on the 4-bit gray-level display data {0001}.

To set the pixel (1,5) at the fifth gray level during the second frame (F) period, the processing circuit 351 adds OFF data {0} to the 4-bit gray-level display data {0000}. In this case, the OFF data {0} is used as gray-level auxiliary data for the first line and the fifth column of the second table which forms the ⅙ gray-level pattern shown in FIG. 11(*b*). The X driver 101 selects and outputs the gray-level voltage (V0) based on the 4-bit gray-level display data {0000}.

As can be seen from the above description, the liquid crystal display 1 of the first embodiment can provide 64 gray levels by using 32 voltage levels of 16 square-wave gray-level voltages (V0, V1, V2, . . . V15). Furthermore, in the first embodiment, each gray-level pattern is formed of tables in each of which 1-bit gray-level auxiliary data are allocated to the matrix thereof so that the ON/OFF control thereof is performed on the concept of a magic square or a perfect magic square. In addition, no intermediate gray levels are used which are either lower than the ¼ gray level or higher than the ¾ gray level. The first embodiment can, therefore, display multi-gray level images which have high quality and which have no flicker on them.

In the first embodiment described above, 16 gray-level voltages (V0, V1, . . . V15) are applied. This invention is not limited to this scheme. Rather, the 16 gray-level voltages may be used in combination with other various gray-level voltages.

Moreover, in the first embodiment, 16 gray-level voltages are used in combination with a display control for four or six consecutive frame (F) periods. The invention is not limited to this mode. They can be used in combination with a display control for five and seven consecutive frame (F) periods. Further, the display control can be effected not only for four and six consecutive frame (F) periods, but also for five consecutive frame (F) periods, for example, so as to provide 64 gray levels by using less gray-level voltages.

In the first embodiment describe above, the liquid crystal panel 11 has a square array of pixels. Needless to say, the square array of pixels may be replaced by a delta array of pixels.

In the first embodiment, either of two adjacent preset gray-level voltages is selected and output during consecutive frame (F) periods in order to provide a gray level intermediate between the two adjacent preset voltage levels. Nonetheless, two adjacent gray-level voltages need not always be selected. Rather, the gray-level voltages (V0) and (V2), the gray-level voltages (V0) and (V3), or the like may be selected to obtain an intermediate gray level between the gray-level voltages (V1) and (V2). Alternatively, the display control may be effected so as to select two or more gray-level voltages during a plurality of frame (F) periods.

This control can be easily accomplished by allocating to two or more-bit gray-level auxiliary data items to each matrix. Thus, an image can be displayed at a larger number of gray levels.

Figure 13:
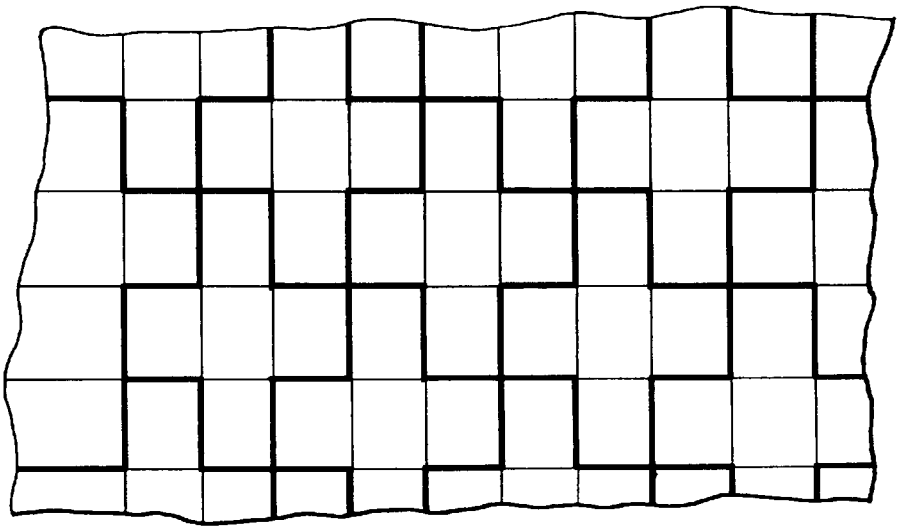
FIG. 13 is a diagram illustrating another unit to be controlled in the liquid crystal display shown in FIG. 1.

In the first embodiment, the first gray-level pattern generating circuit 311 controls the display pixel region of the liquid crystal panel 11, in units of 4×4 square matrices, each consisting of 16 pixels as shown in FIG. 4(*a*), and second gray-level pattern generating circuit 321 controls the display pixel region of the liquid crystal panel 11, in units of 6×6 square matrices, each consisting of 36 pixels as shown in FIG. 4(*b*). Each of these control units need not be a square array of pixels. Instead, it may be formed of pixels arranged in any other pattern, such as the one illustrated in FIG. 13.

In the first embodiment, the 6-bit gray-level display data externally input is converted to 4-bit gray-level display data by the gray-level signal converting circuit 301 before it is input to the liquid crystal controller 251. Alternatively, selector circuits 601 and 603 may be provided to input the gray-level display data externally input directly or indirectly through the gray-level signal converting circuit 301, to the liquid crystal controller 251.

This makes it unnecessary to design several types liquid crystal displays, each based on the number of bits constituting the externally input gray-level display data.

Figure 14A:
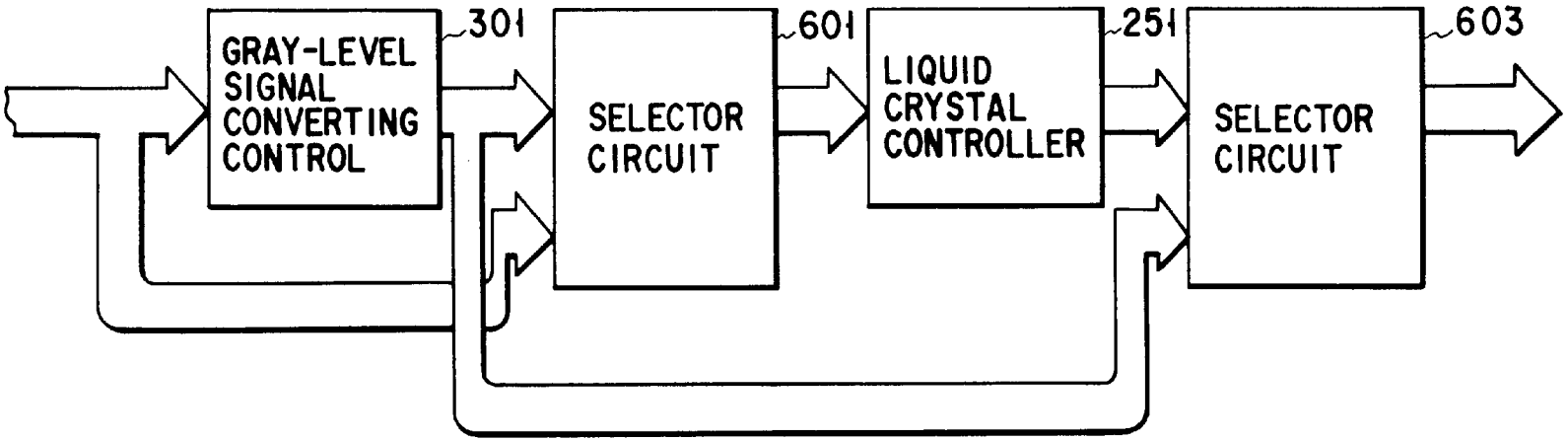
FIGS. 14(*a*)–(*b*) are diagrams showing a modification of the liquid crystal display shown in FIG. 1.
Figure 14B:
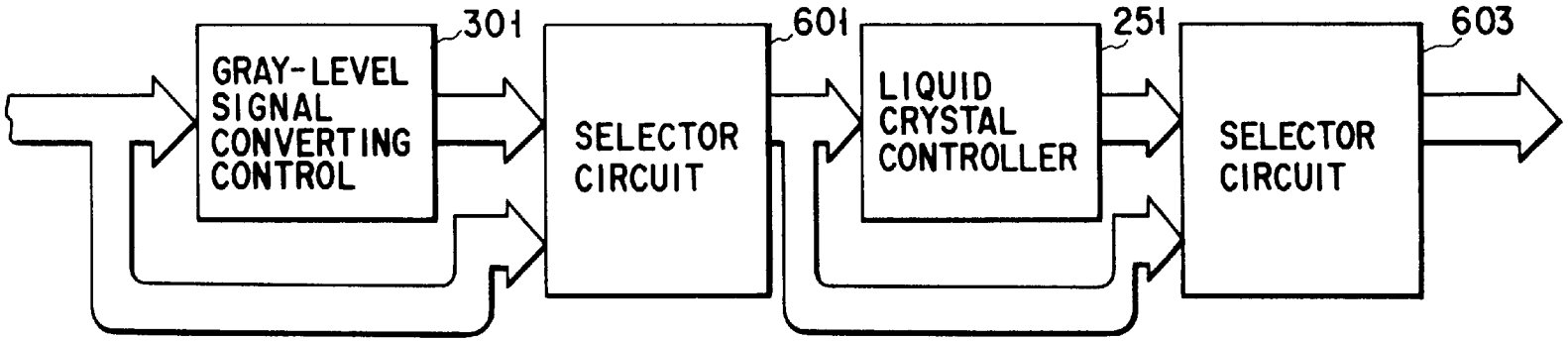

In the structure shown in FIG. 14(*a*), for example, the selector circuits 601 and 603 are changed over, thereby outputting the external input gray-level data through the liquid crystal controller 251 if the gray-level display data external input consists of four bits. In other words, the liquid crystal display 1 can display multi-gray level images, no matter whether the gray-level display data external input consists of four bits or six bits.

The first embodiment described above is an active-matrix liquid crystal display. The present invention can be applied to other various types of displays and works effectively.

In the first embodiment described above, the selection control means selects and outputs one of preset voltages based on input multi-gray level display data if the data corresponds to an intermediate voltage level between the preset voltages, based on an output of the first gray-level pattern generating circuit or the second gray-level pattern generating circuit. The first embodiment can, therefore, display multi-gray level images by using less voltages than otherwise. This renders it possible to manufacture the display at lower cost or to reduce the size of the display. Since one of the preset voltages is selected based on the output of the first or second gray-level pattern generating circuit, either controlled a different number of frame (F) periods, the number of frame (F) periods is prevented from increasing. Hence, multi-gray level images can be displayed without lowering their quality or causing flicker on them.

An active-matrix liquid crystal display according to the second embodiment of the present invention will be described below, with reference to the accompanying drawings. The liquid crystal display is designed to display an image at 64 ($=2^6$) gray levels.

Figure 15:
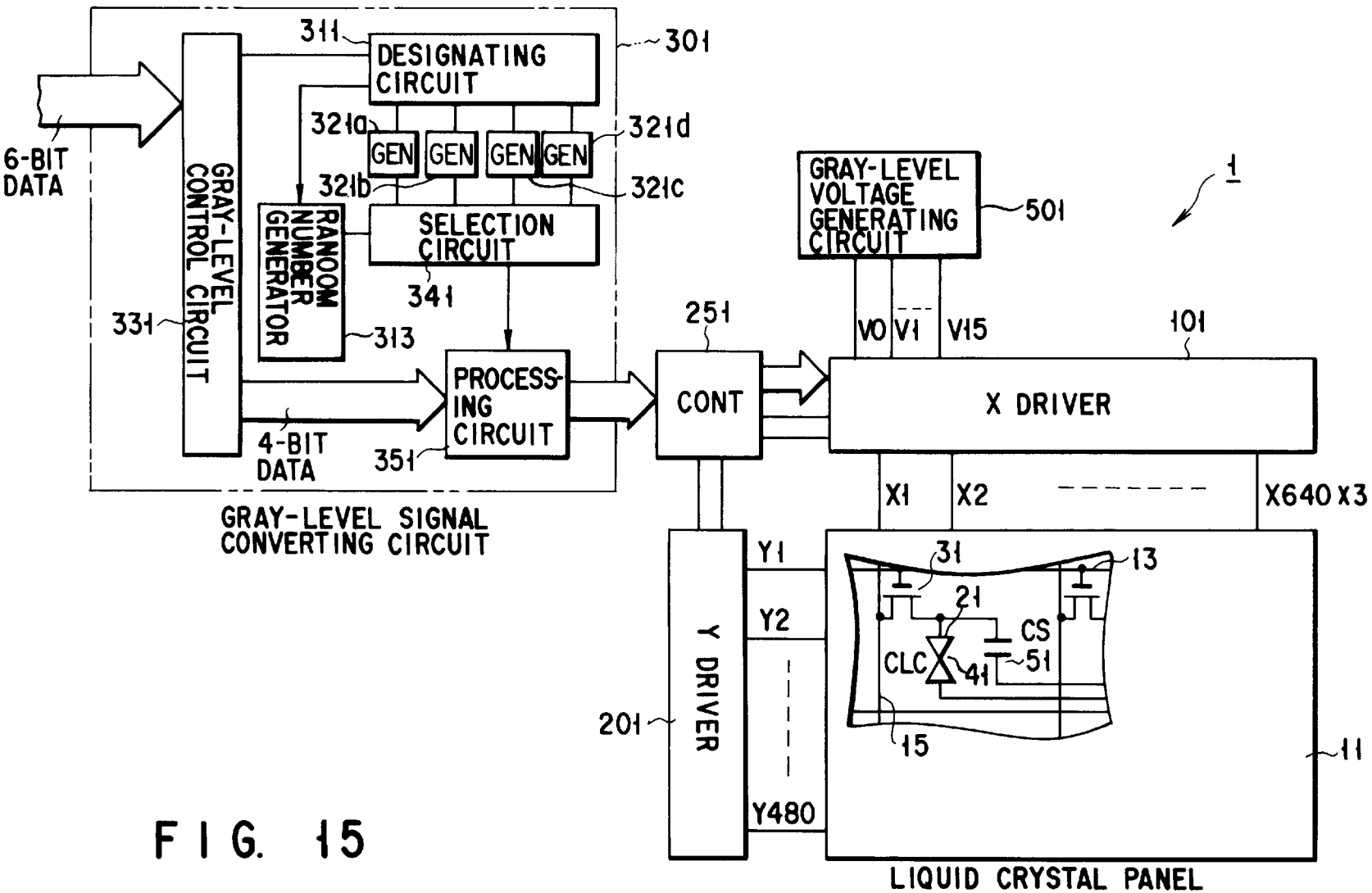
FIG. 15 is a diagram schematically showing a liquid crystal display according to a second embodiment of the present invention.

As shown in FIG. 15, this liquid crystal display 1 comprises a liquid crystal panel 11 capable of displaying a color image and having a matrix of pixels arrayed in (640×3) rows and 480 columns, an X driver 101 and Y driver 201 electrically connected to the liquid crystal panel 11, a liquid crystal controller 251 for controlling the X driver 101 and the Y driver 201, a gray-level signal converting circuit 301 for converting 6-bit gray-level display data externally input, to a 4-bit gray-level display data and for outputting the 4-bit gray-level display data to the liquid crystal controller 251, and a gray-level voltage generating circuit 501 for generating 16 gray-level voltages (V0, V1, V2, . . . V15), each having a square waveform and inverted in polarity with respect to a reference voltage in every one-frame (F) period as shown in FIG. 3 referred to in describing the first embodiment, and for outputting the 16 gray-level voltages to the X driver. In the second embodiment, frame-inversion driving is employed. However, this driving scheme may be used in combination with line-inversion driving or the like in order to prevent flicker and the like. If this is the case, square-wave voltages, each inverted in polarity with respect to the reference voltage, not only in every one-frame (F) period but also in every horizontal scanning-line period, may be used as gray-level voltages (V0, V1, V2, . . . V15).

The liquid crystal panel 11 is of so-called active-matrix type. A TFT 31 is provided for each of its pixel electrodes 21. A scanning pulse (VG) is supplied from the Y driver 201 formed of a shift register to a scanning line 13 connected to the TFT 31, setting the TFT 31 in conducting state for a predetermined time. The gray-level voltage applied from a signal line 15 connected to the X driver 101 is transferred into the pixel electrode 21 through the TFT 31. The voltage is held for a one-frame (F) period in a liquid-crystal capacitance (Clc) and also in an auxiliary capacitance (Cs) juxtaposed with the liquid-crystal capacitance by virtue of a capacitance line 51, so as to form an image.

As shown in FIG. 2, the X driver 101 comprises a shift register 111 for sequentially transferring the 4-bit gray-level display data input to it, in response to a shift clock signal (CK) and a start pulse (ST), decoders 113 for converting an output from the shift register 111, selection circuits 115 for selecting and outputting one of the 16 gray-level voltages (V0, V1, . . . V15) in accordance with the outputs of the decoders 113, and latch circuits 117 for holding the outputs from the selection circuits 115 for a predetermined period of time.

The gray-level signal converting circuit 301 incorporated in the liquid crystal display 1 will now be described.

The gray-level signal converting circuit 301 comprises a gray-level control circuit 331 for converting the externally input 6-bit gray-level display data to a 4-bit gray-level display data, which will serve to select any one of the 16 gray-level voltages (V0, V1, . . . V15) preset in the gray-level voltage generating circuit 501.

The circuit 301 further comprises a processing circuit 351. If the 4-bit gray-level display data obtained by the conversion corresponds to one of the gray-level voltages preset in the gray-level voltage generating circuit 501, the circuit 351 will output the data without processing it. If the 4-bit gray-level display data corresponds an intermediate gray level between the gray-level voltages preset in the gray-level voltage generating circuit 501, the circuit 351 will process the data to obtain the intermediate gray level and will then output the data thus processed.

The processing circuit 351 is connected by a selection circuit 341 to a first gray-level pattern generating circuit 321*a*, a second second gray-level pattern generating circuit 321*b*, a third gray-level pattern generating circuit 321*c*, and a fourth gray-level pattern generating circuit 321*d*.

The selection circuit 341 is designed to select one of the first to fourth gray-level pattern generating circuits 321*a*, 321*b*, 321*c* and 321*d* in accordance with an output from a random number generating circuit 313 when the externally input 6-bit gray-level display data corresponds to the intermediate gray level between the gray-level voltages preset in the gray-level voltage generating circuit 501. The random number generating circuit 313 generates a random number during every six-frame (F) period. The selector circuit 341 selects the first gray-level pattern generating circuit 321*a* when the random number generated by the circuit 313 is {0}, the second gray-level pattern generating circuit 321*b* when the random number is {1}, the third gray-level pattern generating circuit 321*c* when the random number is {2}, and the fourth gray-level pattern generating circuit 321*d* when the random number is {3}.

The first to fourth gray-level pattern generating circuits 321*a*, 321*b*, 321*c* and 321*d* serve to divide the display pixel region of the liquid crystal panel 11 into 80 (rows)×320 (columns) blocks, each of which is formed of adjacent 36 pixels arranged in six rows and six columns (forming a 6×6 square matrix) as shown in FIG. 16, and one unit to be controlled. The first to fourth gray-level pattern generating circuits 321*a*, 321*b*, 321*c* and 321*d* control each unit of control during one display period which consists of six consecutive frame (F) periods. Hence, each gray-level pattern is formed of six tables, each comprised of 36 gray-level auxiliary data items so as to represent one gray level. Each of the gray-level pattern generating circuits 321*a*, 321*b*, 321*c* and 321*d* stores five gray-level patterns of this type.

The gray-level pattern generating circuits 321*a*, 321*b*, 321*c* and 321*d* are connected to a designating circuit 311 which comprises a 6-frame counter for selecting one of the first to sixth tables in each gray-level pattern and a 6-line counter and 6-column counter for obtaining gray-level auxiliary data items from the table, each data item corresponding to a pixel.

In the gray-level signal converting circuit 301, thus constructed, the gray-level control circuit 331 converts the externally input 6-bit gray-level display data to 4-bit gray-level display data. If the 6-bit display data corresponds to one of the gray-level voltages preset in the gray-level voltage generating circuit 501, the 4-bit gray-level display data is output to the X driver 101 through the liquid crystal controller 251, without being processed by the processing circuit 351. If the 4-bit display data corresponds to a gray level intermediate between the gray-level voltages preset in the gray-level voltage generating circuit 501, the processing circuit 351 processes the data, based on the gray-level auxiliary data items stored in the gray-level pattern generating circuits 321*a*, 321*b*, 321*c* and 321*d* selected by the selector circuit 341, The 4-bit gray-level display data, thus processed, is output to the X driver 101 through the liquid crystal controller 251.

A method of providing an intermediate gray level in the liquid crystal display 1 of the second embodiment will be explained in detail. In the liquid crystal display having 16 square-wave gray-level voltages (V0, V1, V2, . . . V15), an image can be displayed at 16 gray levels by selecting one of the gray-level voltages (V0, V1, V2, . . . V15). In order to display the image at 64 gray levels by using 16 square-wave gray-level voltages (V0, V1, V2, . . . V15), the liquid crystal display 1 operates as will be described below.

To provide a ⅙ gray level between a gray-level voltage (Vi) (i=0, 1, 2, . . . 14) and the next gray-level voltage (Vi+1), the gray-level voltage (Vi) is selected during five of six consecutive frame (F) periods, and the next gray-level voltage (Vi+1) is selected during the remaining one (F) period. To provide a ⅔ gray level between a gray-level voltage (Vi) and the next gray-level voltage (Vi+1), the gray-level voltage (Vi) during four of six consecutive frame (F) periods, and the next gray-level voltage (Vi+1) is selected during the remaining two frame (F) periods. To provide a ⅓ gray level between a gray-level voltage (Vi) and the next gray-level voltage (Vi+1), the gray-level voltage (Vi) is selected during three of six consecutive frame (F)

periods, and the next gray-level voltage (Vi+1) is selected during the remaining three frame (F) periods. To provide a 4/6 gray level between a gray-level voltage (Vi) and the next gray-level voltage (Vi+1), the gray-level voltage (Vi) is selected during two of six consecutive frame (F) periods, and the next gray-level voltage (Vi+1) is selected during the remaining four frame (F) periods. To provide a 5/6 gray level between a gray-level voltage (Vi) and the next gray-level voltage (Vi+1), the gray-level voltage (Vi) is selected during one of six consecutive frame (F) periods, and the next gray-level voltage (Vi+1) is selected during the remaining five frame (F) periods.

Since the control of the frame (F) periods is effected in combination with the 16 gray-level voltages (V0, V1, . . . V15), it is theoretically possible to provide 91 gray levels as shown in FIG. 17. Of these 91 gray levels, 64 gray levels which achieve particularly desirable display condition are selected in the second embodiment to display an image at 64 gray levels. The second embodiment uses the 1/6 and 5/6 gray levels (logic gray level 2 and 6 shown in FIG. 17) between the gray-level voltage (V0) and the gray-level voltage (V1), and the 1/6 gray level (logic gray level 8 shown in FIG. 17) between the gray-level voltage (V1) and the gray level voltage (V2), for the purpose of displaying an image, and does not use the other 1/6 and 5/6 gray levels, either being between the other gray-level voltage (Vi) and the gray-level voltage (Vi+1), for the purpose of displaying an image. The 1/6 gray level and the 5/6 gray level are utilized in only a region where they can hardly be recognized in some cases. Were they used in any other region, flicker should be observed.

The gray-level patterns used in the second embodiment will be described in detail, one by one. Selection of a gray-level pattern is based on the concept of a magic square. A magic square is an N×N matrix of integers of 1 to $N^2$, where the sum of the integers of each row and each column is the same. On the other hand, a perfect magic square is an N×N matrix of integers of 1 to $N^2$, where the sum of the integers of each row, and each column and each diagonal is the same.

Gray-level patterns used in the second embodiment are formed of 6×6 matrices. These matrices are formed from magic squares since a perfect magic square does not exists in any (4r+2)×(4r+2) matrix (r is a positive integer greater than 0).

FIG. 18 shows an auxiliary magic square. This auxiliary magic square is formulated from a magic square of a 6×6 matrix by assigning number 1 to part of the matrix where numbers 1 to 6 are positioned, number 2 to part of the matrix where numbers 7 to 12 are positioned, number 3 to part of the matrix where numbers 13 to 18 are positioned, number 4 to part of the matrix where numbers 19 to 24 are positioned, number 5 to part of the matrix where numbers 25 to 31 are positioned, and number 36 to part of the matrix where numbers 31 to 36 are positioned.

Any one of the gray-level patterns is selected from the auxiliary magic square thus formulated, in the following way.

To set a pixel at a 1/6 gray level between the gray-level voltage (Vi) and the next gray-level voltage (Vi+1), it suffices to select the gray-level voltage (Vi+1) during only one of six consecutive frame (F) periods and the gray-level voltage (Vi) during the remaining five frame (F) periods. Thus, as shown at (a) in FIG. 19, gray-level auxiliary data data {1} is allocated to part of the matrix (FIG. 18) where number 1 is positioned, and gray-level auxiliary data {0} is allocated to part of the matrix (FIG. 18) where the remaining numbers are positioned, thereby forming the first of the six tables which are required to provide the 1/6 gray level of the first gray-level pattern. Also, as illustrated in FIG. 19(*b*), gray-level auxiliary data {1} is allocated to part of the matrix (FIG. 18) where number 2 is positioned, and gray-level auxiliary data {0} is allocated to part of the matrix (FIG. 18) where the remaining numbers are positioned, thereby forming the second of the six tables which are required to provide the 1/6 gray level of the first gray-level pattern. Further, gray-level auxiliary data {1} is allocated to part of the matrix where number 3 is positioned, and gray-level auxiliary data {0} is allocated to part of the matrix where the remaining numbers are positioned, thus forming the third of the six tables which are required to provide the 1/6 gray level of the first gray-level pattern. Still further, gray-level auxiliary data {1} is allocated to part of the matrix where number 4 is positioned, and gray-level auxiliary data {0} is allocated to part of the matrix where the remaining numbers are positioned, thereby forming the fourth of the six tables which are required to provide the 1/6 gray level of the first gray-level pattern. Similarly, gray-level auxiliary data {1} is allocated to part of the matrix where number 5 is positioned, and gray-level auxiliary data {0} is allocated to part of the matrix where the remaining numbers are positioned, thereby forming the fifth of the six tables which are required to provide the 1/6 gray level of the first gray-level pattern. Also, gray-level auxiliary data {1} is allocated to part of the matrix where number 6 is positioned, and gray-level auxiliary data {0} is allocated to part of the matrix where the remaining numbers are positioned, forming the sixth of the six tables which are required to provide the 1/6 gray level of the first gray-level pattern.

The first to sixth tables, thus formed, are sequentially repeated during six frame (F) periods which define one display period, thereby providing the 1/6 gray level between the gray-level voltage (Vi) and the next gray-level voltage (Vi+1).

To set a pixel at a 2/6 gray level between the gray-level voltage (Vi) and the next gray-level voltage (Vi+1), it suffices to select the gray-level voltage (Vi+1) during two of six consecutive frame (F) periods and the gray-level voltage (Vi) during the remaining four frame (F) periods. Gray-level auxiliary data data {1} is allocated to part of the matrices (FIG. 18) where numbers 1 and 2 are positioned, and gray-level auxiliary data {0} is allocated to part of the the matrix (FIG. 18) where the remaining numbers are positioned, thereby forming the first of the six tables which are required to provide a 2/6 gray level of the first gray-level pattern. Further, gray-level auxiliary data {1} is allocated to part of the matrix (FIG. 18) where numbers 3 and 4 are positioned, respectively, and gray-level auxiliary data {0} is allocated to part of the matrix (FIG. 18) where the remaining numbers are positioned, thereby forming the second of the six tables which are required to provide the 2/6 gray level of the first gray-level pattern. Similarly, the third to sixth of the six tables which are required to provide the 2/6 gray level of the first gray-level pattern are formed.

Moreover, there are formed in similar method the first to sixth tables (FIGS. 20(*a*)–(*f*)) required to set a pixel at the 2/6 gray level intermediate between the gray-level voltage (Vi) and the next gray-level voltage (Vi+1); the first to sixth tables (FIGS. 21(*a*)–(*f*)) required to set a pixel at the 3/6 gray level intermediate between the gray-level voltage (Vi) and the next gray-level voltage (Vi+1); the first to sixth tables (FIG. 22) required to set a pixel at the 4/6 gray level intermediate between the gray-level voltage (Vi) and the next gray-level v (Vi+1); and the first to sixth tables (FIGS. 23(*a*)–(*f*)) required to set a pixel at the 5/6 gray level intermediate between the gray-level voltage (Vi) and the next gray-level voltage (Vi+1 ).

The gray-level patterns shown in FIGS. 19(*a*)–(*f*) to 23(*a*)–(*f*) thus formed, are stored in the first gray-level pattern generating circuit 321*a*.

Three other groups of gray-level patterns formed based on other magic squares are stored in the second, third and fourth gray-level pattern generating circuits 321*b*, 321*c* and 321*d*, respectively.

FIGS 24(*a*)–(*f*) illustrates the gray-level pattern which is stored in the second gray-level pattern generating circuit 321*b* to provide the 2/6 gray level. FIG. 25 shows the gray-level pattern which is stored in the third gray-level pattern generating circuit 321*c* to provide the 2/6 gray level. FIGS. 26(*a*)–(*f*) depicts the gray-level pattern which is stored in the fourth gray-level pattern generating circuit 321*d* to provide the 2/6 gray level.

Various gray-level patterns are stored in the second, third and fourth gray-level pattern generating circuits 321*b*, 321*c* and 321*d* which are formed of RAMs.

Figure 27:
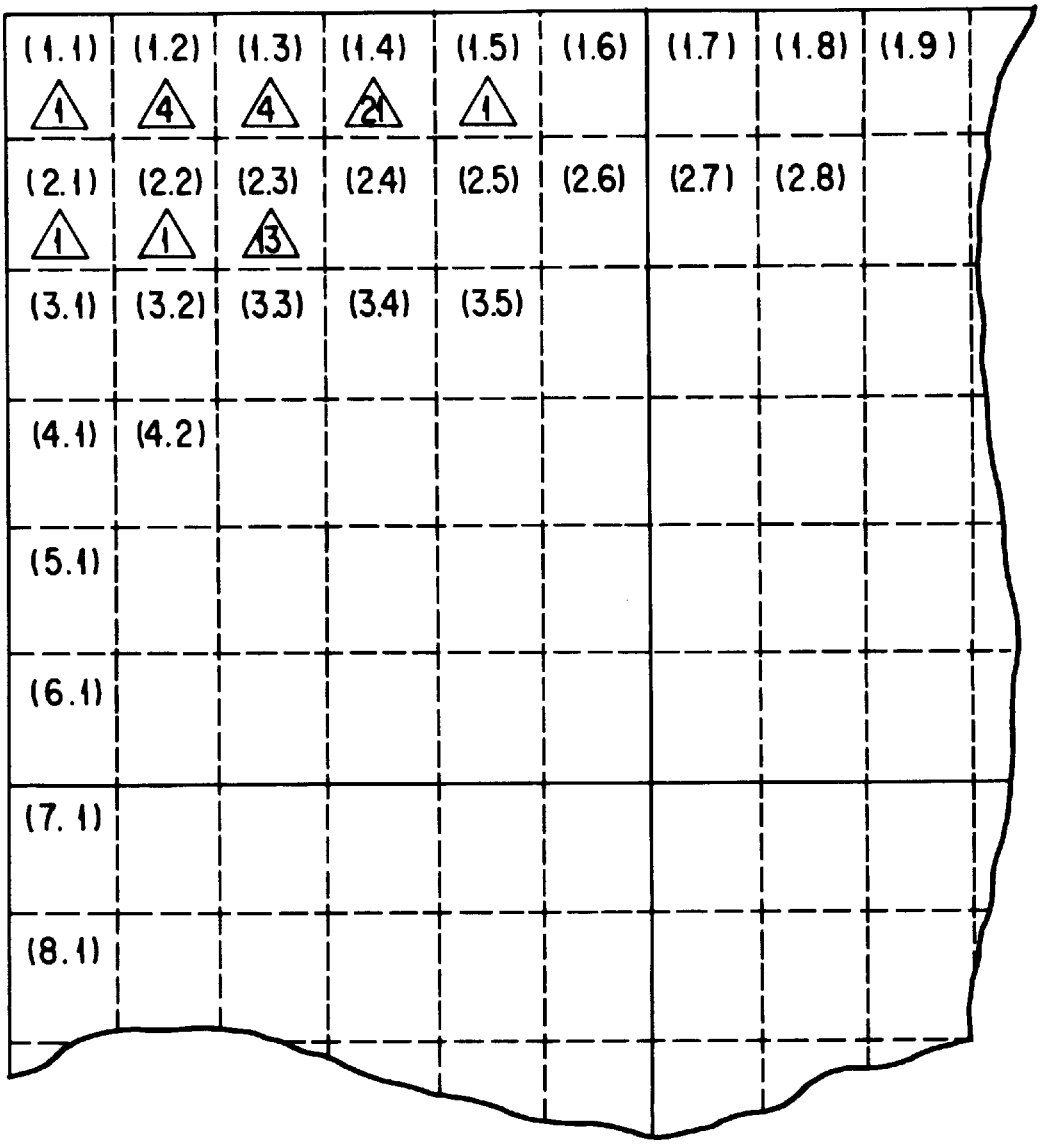
FIG. 27 is a diagram representing an example of a display state of the liquid crystal display shown in FIG. 15.

FIG. 27 is a diagram representing an example of a display state of the liquid crystal panel. How the second embodiment operates to obtain the display state will be explained.

To set the pixel (1,1) at the first gray level, 6-bit gray-level display data {000000} corresponding to the first gray level is input. The gray-level control circuit 331 converts the 6-bit gray-level display data {000000} to 4-bit gray-level display data {0000} representing 16 gray-level voltages (V0, V1, . . . V15). The 6-bit gray-level display data {000000} for providing the first gray level corresponds to the gray-level voltage (V0), i.e., one of the 16 gray-level voltages (V0, V1, . . . V15). Therefore, the 4-bit gray-level display data is output to the liquid crystal controller 251, without being processed by the processing circuit 351. The X driver selects the gray-level voltage (V0) in accordance with the 4-bit gray-level display data {0000}, whereby a drive voltage is applied to the pixel (1,1). The pixel (1,1) is thereby set at the first gray level.

To set the pixel (1,2) at the fourth gray level, 6-bit gray-level display data {000011} corresponding the fourth gray level is input. The gray-level control circuit 331 converts the 6-bit gray-level display data {000011} to 4-bit gray-level display data {0000} representing 16 gray-level voltages (V0, V1, . . . V15). The 6-bit gray-level display data {000011} for providing the fourth gray level corresponds to a 3/6 gray level between the gray-level voltage (V0) and the next gray-level voltage (V1).

The random number generating circuit 313 generates random numbers {0} to {3} from an output of the gray-level control circuit 331. In accordance with these random numbers the selector circuit 341 selects one of the gray-level pattern generating circuits 321*a*, 321*b*, 321*c* and 321*d*, which corresponds to the 3/6 gray level. Assume that the random number generating circuit 313 generates {0}, whereby the first gray-level pattern generating circuit 321*a* is selected. Then, designating circuit 311 causes the the gray-level pattern generating circuit 321*a* outputs the data representing the first line and second column of the first frame and defining the pixel (1,2). Namely, the circuit 321*a* outputs the gray-level auxiliary data {1} shown at (a) in FIG. 21. The processing circuit 351 adds the gray-level auxiliary data {1} read from the first gray-level pattern generating circuit 321*a*, to the 4-bit gray-level display data {0000}. The 4-bit gray-level display data {0001} output from the processing circuit 351 is supplied to the X driver 101 through the liquid crystal controller 251. The X driver 101 selects and outputs the gray-level voltage (V1) in accordance with the 4-bit gray-level display data {0001}. To display the pixel at the fourth gray level for the second frame, as for the first, the gray-level auxiliary data {0} shown in FIG. 21(*b*) is added to the 4-bit gray-level display data {0000}. The gray-level voltage (V0) is selected and output in accordance with the resultant 4-bit gray-level data {0000}.

To display the pixel at the fourth gray level for the third frame, as for the first and second frames, the gray-level auxiliary data {1} shown in FIG. 21(*c*) is added to the 4-bit gray-level display data {0000}. The gray-level voltage (V1) is selected and output in accordance with the resultant 4-bit gray-level data {00001}. Similarly, to display the pixel at the fourth gray level for the fourth, fifth and sixth frames, the gray-level voltage (V0) or the gray-level voltage (V1) is selected and output in accordance with the gray-level auxiliary data item shown in FIGS. 2(*d*), (*e*) or (*f*).

In the case described above, the 6-bit gray-level display data {000011} is input for the four consecutive frame (F) periods in order to set the pixel (1,2) at the fourth gray level. Nonetheless, a different 6-bit gray-level display data may be input for each frame (F) period to display a moving image.

It will now be explained a case where 6-bit gray-level display data {000100}, which corresponds to the 4/6 gray level intermediate between the gray-level voltage (V0) and the gray-level voltage (V1), is input during the second frame (F) period. The gray-level control circuit 331 converts this 6-bit gray-level display data {000100} to 4-bit gray-level display data corresponding to 16 gray-level voltages (V0, V1, . . . V15), in the same way as described above. The 6-bit gray-level display data {000100} is to provide the fifth gray level which is an intermediate gray level corresponding to none of the 16 gray-level voltages (V0, V1, . . . V15). It therefore needs to be controlled by the first gray-level pattern generating circuit 321*a*. The processing circuit 351 adds the gray-level auxiliary data {1} shown in FIG. 22(*b*) and provided for the first line and second column of the second frame, to the 4-bit gray-level display data {0000}. The resultant 4-bit gray-level display data {0001} is output to the X driver 101 through the liquid crystal controller 251. Based on the 4-bit gray-level display data {0001}, the X driver 101 selects and outputs the gray-level voltage (V1).

When a moving image is displayed, the 6-bit gray-level display data input for one pixel is changed for each frame (F) period. In this case, some gray levels set by using the 16 gray-level voltages (V0, V1, . . . V15) will be incorrect. However, the incorrect gray levels can hardly be recognized visually. For this reason, as described above, the display control for each frame (F) period is effected based on the 6-bit gray-level display data input.

After display has been performed during six consecutive frame (F) periods which define one display period, the random number generating circuit 313 generates random numbers {0} to {3} again in accordance with an output from the gray-level control circuit 331. One of the gray-level pattern generating circuits 321*a* is selected in accordance with these random numbers. Intermediate gray levels are provided on the basis of the gray-level patterns stored in the selected gray-level pattern generating circuit.

As described above in detail, the second embodiment of the invention can provide 64 gray levels by applying only 16 square-wave gray-level voltages (V0, V1, V2, . . . V15). Furthermore, flicker can be prevented despite that a pixel is set at an intermediate gray level during one display period consisting of six consecutive frame (F) periods. This is because the gray-level patterns stored in the gray-level pattern generating circuits 321*a,* 321*b,* 321*c* and 321*c* have been formed based on magic squares.

In the second embodiment, one of the gray-level pattern generating circuits 321*a,* 321*b,* 321*c* and 321*c* is selected in accordance with the random numbers {0} to {3} generated by the random number generating circuit 313. Hence, flicker will be more reliably prevented from occurring due to the frequency of switching the gray-level pattern, which may be recognized by human eye.

In the second embodiment, each pixel is displayed at an intermediate gray level during one display period consisting of six consecutive frame (F) periods, by using a gray-level pattern comprised of 36 gray-level auxiliary data items arranged in the form of a 6×6 matrix. Instead, a gray-level pattern comprised of 49 gray-level auxiliary data items arranged in the form of a 7×7 matrix may be utilized. Still alternatively, the displaying scheme may be combined with the scheme of displaying each pixel at an intermediate gray level during one display period consisting of four consecutive frame (F) periods, by applying a gray-level pattern comprised of 16 gray-level auxiliary data items arranged in the form of a 4×4 matrix. When the two display schemes are employed in combination, it is desirable to use a ¼ gray level, a ⅔ gray level and a ¾ gray level which are provided during a 4-frame (F) display period, and also a ⅔ gray level and a ⅚ gray level which are provided during a 6-frame (F) display period.

In the second embodiment described above, 16 gray-level voltages (V0, V1, . . . V15) are applied. This invention is not limited to this scheme. Rather, the 16 gray-level voltages may be used in combination with other various gray-level voltages, in which case the display operates effectively, too.

In the second embodiment, the pixels are controlled in units, each being a square array of 36 pixels. However, each unit to be controlled need not be a square array of pixels.

Moreover, in the second embodiment, either of two adjacent preset gray-level voltages is selected and output during consecutive frame (F) periods in order to provide a gray level which is an intermediate level between the two adjacent preset voltages levels (V0, V1, . . . V15). Nonetheless, two adjacent gray-level voltages need not always be selected. Rather, the gray-level voltages (V0) and (V2), the gray-level voltages (V0) and (V3), or the like may be selected to display a pixel at an intermediate gray level between the gray-level voltages (V1) and (V2). Alternatively, the display data may be controlled so as to select two or more gray-level voltages during a plurality of frame (F) periods. The second embodiment can, therefore, display multi-gray level images by using less voltages than otherwise.

The second embodiment described above is an active-matrix liquid crystal display. The present invention can be applied to other various types of displays and works effectively.

In the second embodiment described above, the selection control means selects and outputs one of various gray-level patterns based on input multi-gray level display data when the multi-gray level display data corresponds to an intermediate voltage between the preset voltages. One of the preset voltages is selected and output in accordance with the gray-level pattern selected and output. The second embodiment can, therefore, display multi-gray level images by using less voltages than otherwise. In addition, multi-gray level images can be displayed without lowering their quality or causing flicker-on them.

An active-matrix liquid crystal display according to the third embodiment of the present invention will be described below, with reference to the accompanying drawings. The liquid crystal display is designed to display an image at 64 ($=2^6$) gray levels.

Figure 28:
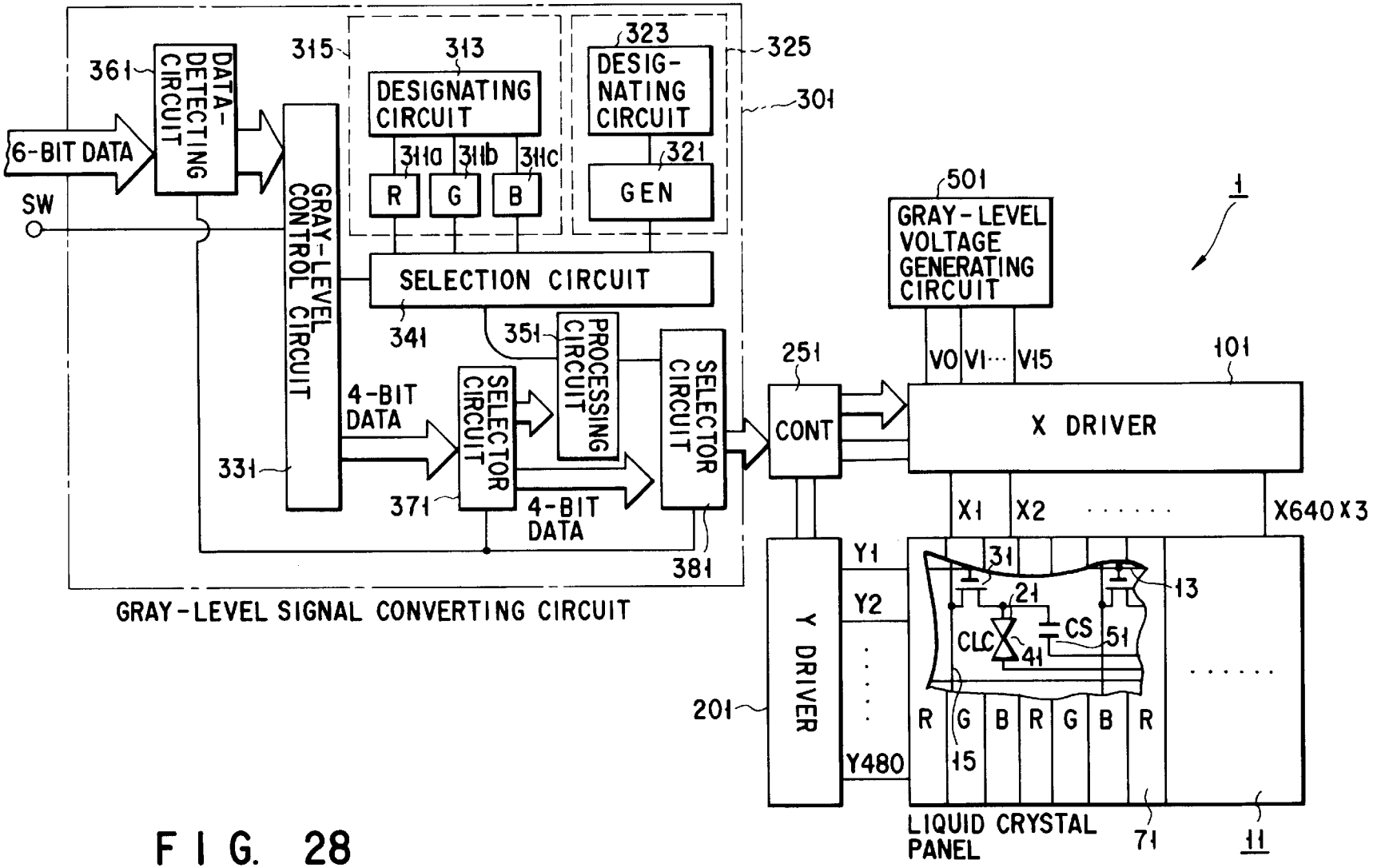
FIG. 28 is a diagram schematically showing a liquid crystal display according to a third embodiment of the present invention.

As shown in FIG. 28, this liquid crystal display 1 is a color display. It comprises a liquid crystal panel 11 having a matrix of pixels array in (640×3) rows and 480 columns, each pixel consisting of three color components, a red (R) component, a green (G) component and a blue (B) component, an X driver 101 and Y driver 201 electrically connected to the liquid crystal panel 11, a liquid crystal controller 251 for controlling the X driver 101 and the Y driver 201, a gray-level signal converting circuit 301 for converting 6-bit gray-level display data externally input, to a 4-bit gray-level display data and for outputting the 4-bit gray-level display data to the liquid crystal controller 251, and a gray-level voltage generating circuit 501 for generating 16 gray-level voltages (V0, V1, V2, . . . V15), each having a square waveform and inverted in polarity with respect to a reference voltage in every one-frame (F) period as shown in FIG. 3 referred to in describing the first embodiment, and for outputting the 16 gray-level voltages to the X driver. In the third embodiment, frame-inversion driving is employed. This driving scheme may be used in combination with line-inversion driving or the like in order to prevent flicker and the like. If this is the case, square-wave voltages, each inverted in polarity with respect to the reference voltage, not only in every one-frame (F) period but also in every horizontal scanning-line period, may be used as gray-level voltages (V0, V1, V2, . . . V15).

The liquid crystal panel 11 is of so-called active-matrix type. It has stripe-shaped red (R), green (G) and blue (B) filters 71 which extend parallel to signal lines 15. A TFT 31 is provided for each of its pixel electrodes 21. A scanning pulse (VG) is supplied from the Y driver 201 formed of a shift register to a scanning line 13 connected to the TFT 31, setting the TFT 31 in conducting state for a predetermined time. The gray-level voltage applied from a signal line 15 connected to the X driver 101 is transferred into the pixel electrode 21 through the TFT 31. The voltage is held-for a one-frame (F) period in a liquid-crystal capacitance (Clc) and also in an auxiliary capacitance (Cs) juxtaposed with the liquid-crystal capacitance by virtue of a capacitance line 51, so as to form an image.

As shown in FIG. 2, the X driver 101 comprises a shift register 111 for sequentially transferring the 4-bit gray-level display data input to it, in response to a shift clock signal (CK) and a start pulse (ST), decoders 113 for converting an output from the shift register 111, selection circuits 115 for selecting and outputting one of the 16 gray-level voltages (V0, Vi, . . . V15) in accordance with the outputs of the decoders 113. The X driver 101 further comprises latch circuits 117 for holding the outputs from the selection circuits 115 for a predetermined period of time.

The gray-level signal converting circuit 301 incorporated in the liquid crystal display 1 will now be described.

The gray-level signal converting circuit 301 comprises a gray-level control circuit 331 for converting the externally input 6-bit gray-level display data to a 4-bit gray-level display data, which will serve to select any one of the 16 gray-level voltages (V0, V1, . . . V15) preset in the gray-level voltage generating circuit 501.

The circuit 301 further comprises a processing circuit 351. If the 4-bit gray-level display data obtained by the conversion corresponds to one of the gray-level voltages preset in the gray-level voltage generating circuit 501, the circuit 351 will output the data without processing it. If the 4-bit gray-level display data corresponds an intermediate gray level between the gray-level voltages preset in the gray-level voltage generating circuit 501, the circuit 351 will process the data to obtain the intermediate gray level and will then output the data thus processed.

The processing circuit 351 is connected by a selection circuit 341 to a dot gray-level control circuit 315 and a pixel gray-level control circuit 325 which are designed to provide an intermediate gray level between the gray-level voltages preset in the gray-level voltage generating circuit 501.

The dot gray-level control circuit 315 has three dot gray-level pattern generating circuits, i.e., a red (R) dot gray-level pattern generating circuit 311*a,* a green (G) dot gray-level pattern generating circuit 311*b,* and a blue (B) dot gray-level pattern generating circuit 311*c.* The pixel gray-level control circuit 325 has a pixel gray-level pattern generating circuit 321.

Figure 29A:
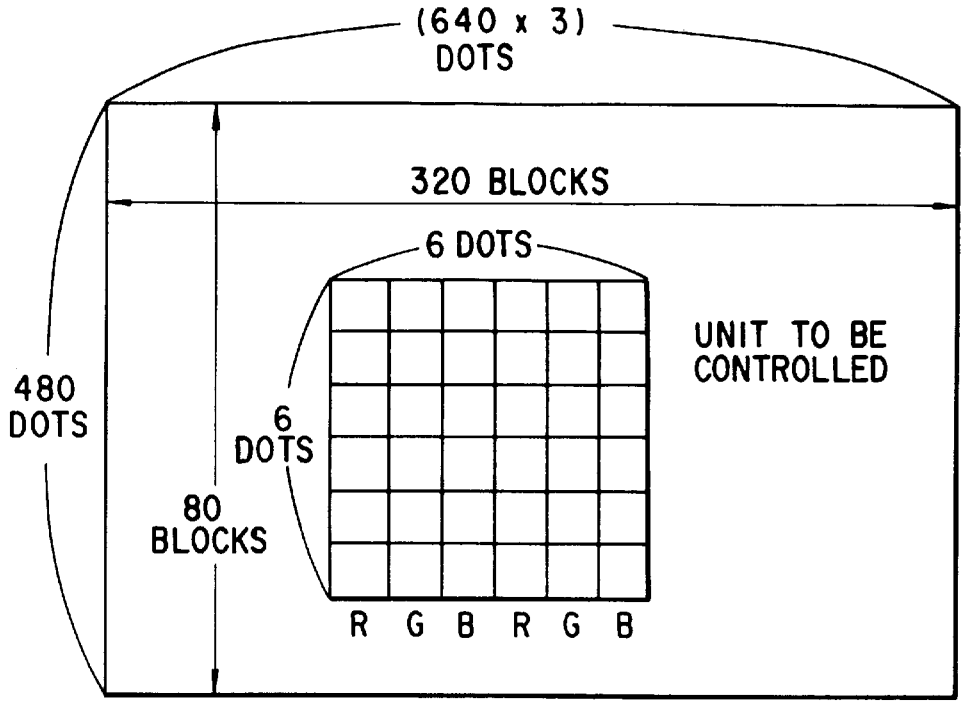
FIGS. 29(*a*)–(*b*) are diagrams depicting a unit of dots and a unit of pixels, which are controlled in the liquid crystal display shown in FIG. 28.
Figure 29B:
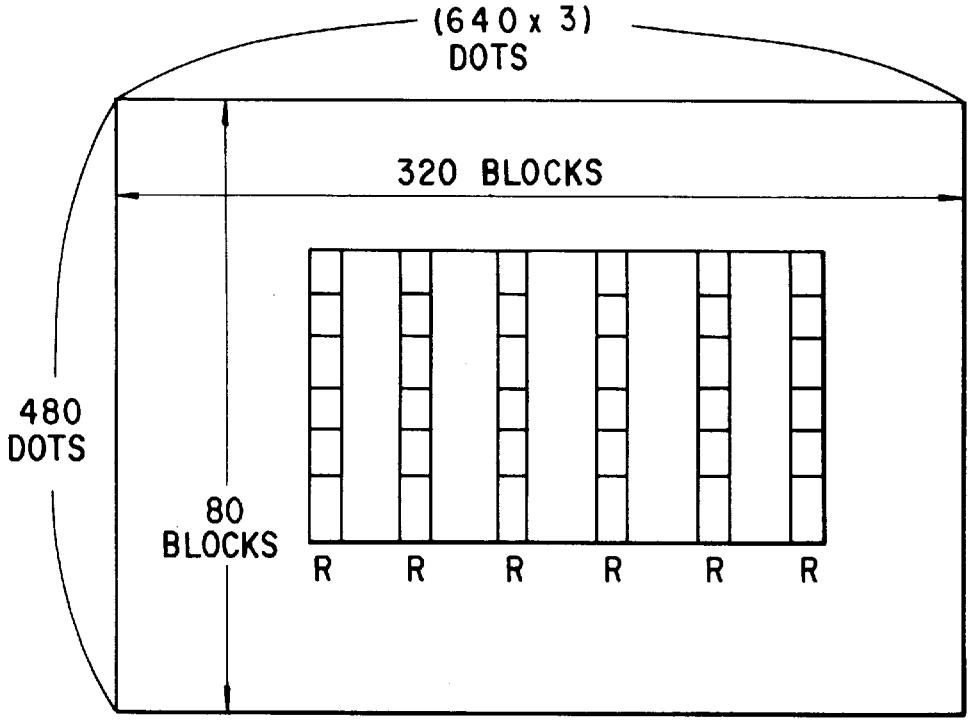

The red (R) dot gray-level pattern generating circuit 311*a* serves to control the display pixel region of the liquid crystal panel 11, in units of 6×6 square matrices each of which consists of adjacent 36 red (R) dots arranged in six rows and six columns, or in units of 80 (rows)×107 (columns) blocks, as is illustrated in FIG. 29(*a*). Similarly, the green (G) dot gray-level pattern generating circuit 311*b* serves to control the display pixel region of the liquid crystal panel 11, in units of 6×6 square matrices each of which consists of adjacent 36 green (B) dots arranged in six rows and six columns, or in units of 80 (rows)×107 (columns) blocks. The blue (B) dot gray-level pattern generating circuit 311*c* serves to control the display pixel region of the liquid crystal panel 11, in units of 6×6 square matrices each of which consists of adjacent 36 blue (B) dots arranged in six rows and six columns, or in units of 80 (rows)×107 (columns) blocks. The dot gray-level pattern generating circuits 311*a,* 311*b* and 311*c* control each dot unit during one display period which consists of six consecutive frame (F) periods.

It follows that each gray-level pattern for providing one gray level is formed of six tables shown in at in FIGS. 30(*a*)–(*f*), each comprised of 36 gray-level auxiliary data items corresponding to the dot units to represent one gray level. Each of the dot gray-level pattern generating circuits 311*a,* 311*b* and 311*c* stores five gray-level patterns of this type.

The dot gray-level control circuit 315 comprises a first designating circuit 313 which comprises 6-frame counter for selecting one of the first to sixth tables in each gray-level pattern stored in each of the dot gray-level pattern generating circuits 311*a,* 311*b* and 311*c,* and a 6-line counter and 6-column counter for obtaining gray-level auxiliary data items from the table, each data item corresponding to a pixel.

The pixel gray-level pattern generating circuit 321 serves to control the display pixel region of the liquid crystal panel 11, in units of 6×6 square matrices each of which consists of adjacent 36 pixels arranged in six rows and six columns, or in units of 80 (rows)×320 (columns) blocks, as is illustrated in FIG. 29(*a*).

Hence, each gray-level pattern for providing one gray level is formed of six tables shown in FIGS. 30(*a*)–(*f*), each comprised of 36 gray-level auxiliary data items corresponding to pixel units and each representing one gray level. A pixel gray-level pattern generating circuit 321 stores five gray-level patterns of this type.

The pixel gray-level control circuit 325 comprises a second designating circuit 323 which comprises a 6-frame counter for selecting one of the first to sixth tables in each gray-level pattern stored in each of the pixel gray-level pattern generating circuit 321, and a 6-line counter and 6-column counter for obtaining gray-level auxiliary data items from the table, each data item corresponding to a pixel.

The dot gray-level pattern generating circuits 311*a,* 311*b* and 311*c,* and the pixel gray-level pattern generating circuit 321 may be comprised of either ROMs or RAMS. In the third embodiment, they are comprised of ROMs.

In the gray-level signal converting circuit 301, thus constructed, the gray-level control circuit 331 converts the externally input 6-bit gray-level display data to 4-bit gray-level display data. If the 6-bit display data corresponds to one of the gray-level voltages preset in the gray-level voltage generating circuit 501, the 4-bit gray-level display data is output to the X driver 101 through the liquid crystal controller 251, without being processed by the processing circuit 351. If the 4-bit display data corresponds to an intermediate gray level between the gray-level voltages preset in the gray-level voltage generating circuit 501, the processing circuit 351 processes the data based on the gray-level auxiliary data items stored in one of the gray-level pattern generating circuit 315 and 325 which is selected by the selector circuit 341 to obtain the intermediate gray level. The 4-bit gray-level display data, thus processed, is output to the X driver 101 through the liquid crystal controller 251.

The gray-level signal converting circuit 301 comprises a text data-detecting circuit 361 which determines whether the 6-bit gray-level display data externally input is text data or not before it output the data to the gray-level control circuit 331. The circuit 301 further comprises two selector circuits 371 and 381. The selector circuits 371 and 381 are provided to outputs the 4-bit gray-level signal directly to the liquid crystal controller 251, not through the processing circuit 351, if the 6-bit gray-level display data is text data. The term "text data" used here generally means data representing either characters or figures such as lines.

A method of providing an intermediate gray level in the liquid crystal display 1 of the third embodiment will be explained in detail.

In the liquid crystal display having 16 square-wave gray-level voltages (V0, V1, V2, . . . V15), an image can be displayed at 16 gray levels by selecting one of the gray-level voltages (V0, V1, V2, . . . V15). To display the image at 64 gray levels by using 16 square-wave gray-level voltages (V0, V1, V2, . . . V15), the liquid crystal display 1 operates as will be described below.

To provide a 1/6 gray level which is an intermediate level between a gray-level voltage (Vi) (i=0, 1, 2, . . . 14) and the next gray-level voltage (Vi+1), the gray-level voltage (Vi) is selected during five of six consecutive frame (F) periods, and the next gray-level voltage (Vi+1) is selected during the remaining one (F) period. To provide a 2/6 gray level which is an intermediate level between a gray-level voltage (Vi) (i=0, 1, 2, . . . 14) and the next gray-level voltage (Vi+1), the gray-level voltage (Vi) is selected during four of six consecutive frame (F) periods, and the next gray-level voltage (Vi+1) is selected during the remaining two frame (F) periods. To provide a 3/6 gray level which is an intermediate level between a gray-level voltage (Vi) (i=0, 1, 2, gray-level voltage (Vi) is selected during three of six consecutive frame (F) periods, and the next gray-level voltage (Vi+1) is selected during the remaining three frame (F) periods. To provide a 4/6 gray level which is an intermediate level between a gray-level voltage (Vi) (i=0, 1, 2, . . . 14) and the next gray-level voltage (Vi+1), the gray-level voltage (Vi) is selected during two of six consecutive frame (F) periods, and the next gray-level voltage (Vi+1) is selected during the remaining four frame (F) periods. To provide a 5/6 gray level which is an intermediate level between a gray-level voltage (Vi) (i=0, 1, 2, . . . 14) and the next gray-level voltage (Vi+1), the gray-level voltage (Vi) is selected during one of six consecutive frame (F) periods, and the next gray-level voltage (Vi+1) is selected during the remaining five frame (F) periods.

Since the control of the frame (F) periods is effected in combination with the 16 gray-level voltages (V0, V1, . . . V15), it is theoretically possible to provide 91 gray levels in the third embodiment, as shown in FIG. 17 and as explained in conjunction with the second embodiment. Of these 91 gray levels, 64 gray levels which achieve particularly desirable display condition are selected in the third embodiment to display an image at 64 gray levels.

The third embodiment uses the 1/6 and 5/6 gray levels (logic gray levels 2 and 6 shown in FIG. 17) between the gray-level voltage (V0) and the gray-level voltage (V1), and the 1/6 gray level (logic gray level 8 shown in FIG. 17) between the gray-level voltage (V1) and the gray level voltage (V2), for the purpose of displaying an image, and does not use the other 1/6 and 5/6 gray levels, either being an intermediate level between the other gray-level voltage (Vi) and the gray-level voltage (Vi+1), for the purpose of displaying an image. The 1/6 gray level and the 5/6 gray level are utilized in only a region where they can hardly be recognized in some cases. Were they used in any other region, flicker should be observed.

The gray-level patterns used in the third embodiment will be described in detail, one by one. Selection of a gray-level pattern is based on the concept of a magic square. A magic square is an N×N matrix of integers of 1 to $N^2$, where the sum of the integers of each row and each column is the same. On the other hand, a perfect magic square is an N×N matrix of integers of 1 to $N^2$, where the sum of the integers of each row, each column and each diagonal is the same.

Gray-level patterns used in the third embodiment are formed of 6×6 matrices. These matrices are formed from magic squares since a perfect magic square does not exists in any (4r+2)×(4r+2) matrix (r is a positive integer greater than 0).

Therefore, of the gray-level patterns used in the first embodiment, the 4×4 matrices are formulated based on a perfect magic square, while the 6×6 matrices based on a magic square.

Any one of the gray-level patterns is selected in the following way, from the auxiliary magic squares (i.e., 6×6 matrices) shown in FIG. 18 and used also in the second embodiment.

To set a pixel at a 1/6 gray level which is an intermediate level between the gray-level voltage (Vi) and the next gray-level voltage (Vi+1), it suffices to select the gray-level voltage (Vi+1) during only one of six consecutive frame (F) periods and the gray-level voltage (Vi) during the remaining five frame (F) periods. As shown in FIG. 30(*a*), gray-level auxiliary data data {1} is allocated to part of the matrix (FIG. 18) where number 1 is positioned, and gray-level auxiliary data {0} is allocated to part of the matrix (FIG. 18) where the remaining numbers are positioned, thereby forming the first of the six tables which are required to provide the 1/6 gray level of the first gray-level pattern. Also, as illustrated in FIG. 30(*a*), gray-level auxiliary data {1} is allocated to part of the matrix (FIG. 18) where number 2 is positioned, and gray-level auxiliary data {0} is allocated to part of the matrix (FIG. 18) where the remaining numbers are positioned, thereby forming the second of the six tables which are required to provide the 1/6 gray level of the first gray-level pattern. Further, gray-level auxiliary data {1} is allocated to part of the matrix where number 3 is positioned, and gray-level auxiliary data {0} is allocated to part of the matrix where the remaining numbers are positioned, thus forming the third of the six tables which are required to provide the 1/6 gray level of the first gray-level pattern. Still further, gray-level auxiliary data {1} is allocated to part of the matrix where number 4 is positioned, and gray-level auxiliary data {0} is allocated to part of the matrix where the remaining numbers are positioned, thereby forming the fourth of the six tables which are required to provide the 1/6 gray level of the first gray-level pattern. Similarly, gray-level auxiliary data {1} is allocated to part of the matrix where number 5 is positioned, and gray-level auxiliary data {0} is allocated to part of the matrix where the remaining numbers are positioned, thereby forming the fifth of the six tables which are required to provide the 1/6 gray level of the first gray-level pattern. Also, gray-level auxiliary data {1} is allocated to part of the matrix where number 6 is positioned, and gray-level auxiliary data {0} is allocated to part of the matrix where the remaining numbers are positioned, forming the sixth of the six tables which are required to provide the 1/6 gray level of the first gray-level pattern.

The first to sixth tables, thus formed, are sequentially repeated during six frame (F) periods which define one display period, thereby providing the 1/6 gray level which is an intermediate level between the gray-level voltage (Vi) and the next gray-level voltage (Vi+1).

To set a pixel at a 2/6 gray level which is an intermediate level between the gray-level voltage (Vi) and the next gray-level voltage (Vi+1), it suffices to select the gray-level voltage (Vi+1) during two of six consecutive frame (F) periods and the gray-level voltage (Vi) during the remaining four frame (F) periods. Gray-level auxiliary data data {1} is allocated to part of the matrix (FIG. 18) where numbers 1 and 2 are positioned, and gray-level auxiliary data {0} is allocated to part of the matrix (FIG. 18) where the remaining numbers are positioned, thereby forming the first of the six tables which are required to provide a 2/6 gray level of the first gray-level pattern. Further, gray-level auxiliary data {1} is allocated to part of the matrix (FIG. 18) where numbers 3 and 4 are positioned, and gray-level auxiliary data {0} is allocated to part of the matrix (FIG. 18) where the remaining numbers are positioned, thereby forming the second of the six tables which are required to provide the 2/6 gray level of the first gray-level pattern. Similarly, the third to sixth of the six tables which are required to provide the 2/6 gray level of the first gray-level pattern are formed.

Moreover, there are formed in similar method the first to sixth tables (FIGS. 31(*a*)–(*f*)) required to set a pixel at the 2/6 gray level which is an intermediate level between the gray-level voltage (Vi) and the next gray-level voltage (Vi+1); the first to sixth tables (FIGS. 32(*a*)–(*f*)) required to set a pixel at the 3/6 gray level which is an intermediate level between the gray-level voltage (Vi) and the next gray-level voltage (Vi+1); the first to sixth tables (FIGS. 33(*a*)–(*f*)) required to set a pixel at the 4/6 gray level which is an intermediate level between the gray-level voltage (Vi) and the next gray-level voltage (Vi+1); and the first to sixth tables (FIGS. 34(*a*)–(*f*)) required to set a pixel at the 5/6 gray level which is an intermediate level between the gray-level voltage (Vi) and the next gray-level voltage (Vi+1).

The gray-level patterns shown in FIGS. 30(*a*)–(*f*) to 34(*a*)–(*f*), thus formed, are stored in the red(R)-dot gray-level pattern generating circuit 311*a*.

Two other groups of gray-level patterns formed based on other magic squares are stored in the green(G)-dot gray-level pattern generating circuits 311*b* and the blue(B)-dot gray-level pattern generating circuit 311*c*, respectively.

Further, pixel gray-level patterns formed based on still other magic squares are stored in the pixel gray-level pattern generating circuit 321.

FIGS. 35(*a*)–9*f*illustrate the gray-level pattern which is stored in the green(G)-dot gray-level pattern pattern generating circuit 321*b* to provide the ⅔ gray level. FIG. 36 shows the gray-level pattern which is stored in the blue(B)-dot gray-level pattern generating circuit 311*c* to provide the ⅔ gray level. FIGS. 37(*a*)–(*f*) depict the gray-level pattern which is stored in the pixel gray-level pattern generating circuit 321 to provide the ⅔ gray level.

How the liquid crystal display 1 of the third embodiment operates will now be described in detail.

First it will be explained how red(R)-dot, green(G)-dot and blue(B)-dot gray levels are minutely controlled based on the dot gray-level pattern generating circuit 315 in order to display moving images.

As shown in FIG. 28, a switching signal (SW) is externally input so that intermediate gray levels may be controlled based the dot gray-level pattern generating circuit 315. In response to the switching signal SW, the gray-level control circuit 331 controls the selector circuit 341, which selects and outputs gray-level auxiliary data items from the dot gray-level pattern generating circuit 315.

To set the red(R) pixel (1,1) at the first gray level, 6-bit gray-level display data {000000} corresponding to the first gray level is input during the first frame (F) period, as illustrated in FIG. 28. The 6-bit gray-level display data {000000} is input to the gray-level control circuit 331 through the text data-detecting circuit 361. The gray-level control circuit 331 converts the 6-bit gray-level display data {000000} to 4-bit gray-level signal {0000} representing 16 gray-level voltages (V0, V1, . . . V15). Since the 6-bit gray-level display data {000000} is not text data, the 4-bit gray-level signal {0000} is supplied via the first selector circuit 371 to the processing circuit 351.

The 6-bit gray-level display data {000000} corresponds to a gray-level voltage (V0), i.e., one of the preset 16 gray-level voltages (V0, V1, . . . V15). Hence, the 4-bit gray-level signal {0000} is output to the X driver 101 through the second selector circuit 381 and the liquid crystal controller 251, without being processed by the processing circuit 351. The X driver 101 selects and outputs the gray-level voltage (V0) in accordance with the 4-bit gray-level data {0000}.

To set the green(G) pixel (1,8) at the third gray level, 6-bit gray-level display data {000010} corresponding to the third gray level is input during the first frame (F) period. The 6-bit gray-level display data {000010} is input to the gray-level control circuit 331 through the text data-detecting circuit 361. The gray-level control circuit 331 converts the 6-bit gray-level display data {000010} to 4-bit gray-level signal {0000} representing 16 gray-level voltages (V0, V1, . . . V15). Since the 6-bit gray-level display data is not text data, the 4-bit gray-level signal {0000} is supplied via the first selector circuit 371 to the processing circuit 351. Since the 6-bit gray-level display data {000010} for providing the third gray level corresponds to none of the preset 16 gray-level voltages (V0, V1, . . . V15), the 4-bit gray-level signal {0000} is processed by the processing circuit 351 in the following manner.

As shown in FIG. 17, the third gray level corresponds to a ⅔ gray level which is an intermediate level between the gray-level voltage (V0) and the gray-level voltage (V1). The control is performed based on the dot gray-level pattern generating circuit 315, and the green(G) pixel (1,8) corresponds to the gray-level auxiliary data for the first line and third column of the green(G)-dot gray-level pattern.

The first designating circuit 313 reads the gray-level auxiliary data {0} for the first line and third column of the first table shown in FIG. 35(*a*), and outputs this data to the processing circuit 351 through the processing circuit 351. The circuit 351 adds the gray-level data {0} read from the green(G)-dot gray-level pattern generating circuit 311*b*, to the 4-bit gray-level display data {0000}. The 4-bit gray-level display data {0000} output from the processing circuit 351 is supplied to the X driver 101 through the liquid crystal controller 251. The X driver 101 selects and outputs the gray-level voltage (V0) in accordance with the 4-bit gray-level display data {0000}.

To provide the third gray level during the second frame period as during the first frame period, the processing circuit 351 adds the gray-level auxiliary data {1} for the first line and the third column to the 4-bit gray-level display data, and the gray-level voltage (V1) is selected and output in accordance with the resultant 4-bit gray-level display data {0001}.

To provide the third gray level during the third to sixth frame (F) periods, the processing circuit 351 adds the gray-level auxiliary data items shown in FIGS. 35(*c*)–(*f*), each to the 4-bit gray-level display data. Thus, an image is displayed in accordance with the outputs of the processing circuit 351.

As indicated above, to provide the same gray level during the first to sixth frame (F) periods, the gray-level voltage (V1) is selected and output during the second and fifth frame (F) periods, and the gray-level voltage (V0) is selected and output during the first, third, fourth and sixth frame (F) periods. As a result, the third gray level is provided which corresponds to the ⅔ gray level between the gray-level voltage (V0) and the gray-level voltage (V1).

When a moving image is displayed, the 6-bit gray-level display data is input for one pixel is changed for each frame (F) period. For example, a 6-bit gray-level display data which corresponds to a gray level different from the third gray level may be input to the blue (B) pixel (1,8) during the second frame (F) period.

In this case, it suffices to display each pixel during each frame (F) period in accordance with the 6-bit gray-level display data input, irrespective of the display operation performed during the preceding frame (f) period. This is because, a gray level, if any, that cannot be defined by the 16 gray-level voltages (V0, V1, . . . V15) can hardly be recognized visually.

As described above in detail, the third embodiment of the invention can provide 64 gray levels by applying 16 gray-level voltages (V0, V1, V2, . . . V15). In the liquid crystal display 1 according to the third embodiment, 36 pixels provided for each color are used as one gray-level unit, and an image is displayed at gray levels in accordance with the gray-level patterns formed based on magic squares. Hence, flicker does not occur even if all pixels are displayed at the same gray level. The display can therefore display high-quality moving images.

In the above description, it has been explained how any embodiment operates when a 6-bit gray-level display data is input which is not text data. It will now be explained how the embodiment operates when the 6-bit gray-level display data input is text data.

Assume that a 6-bit gray-level display data {000011} which is text data corresponding to the fourth gray level is input to the red (R) pixel (1,1).

The 6-bit gray-level display data {000011} input is supplied to the gray-level control circuit 331 through the text data-detecting circuit 361. The gray-level control circuit 331 converts the 6-bit gray-level display data {000011} to a 4-bit gray-level signal {0000} corresponding to 16 gray-level voltages (V0, V1, . . . V15), in the same way as described above. The 6-bit gray-level display data {000011} corresponds to a 3/6 gray level between the gray-level voltage (V0) and the next gray-level voltage (V1). Since the 6-bit gray-level display data {000011} is text data, the 4-bit gray-level signal {0000} is output from the first selector circuit 371 to the liquid crystal controller 251 through the second selector circuit 381, not through the processing circuit 351, in accordance with the output of the text data-detecting circuit 361. In accordance with this 4-bit gray-level signal, the X driver 101 selects and outputs the gray-level voltage (V0).

As indicated above, in the liquid crystal display 1 according to the third embodiment, it is determined whether the processing circuit 351 needs to process the 4-bit gray-level signal, in accordance with whether the externally input 6-bit gray-level display data is text data or not. If the input display data is text representing characters or the like on which flicker may likely occur, a gray-level voltage which corresponds to a gray level similar to the one represented by the input 6-bit gray-level display data will be selected in accordance with the 4-bit gray-level signal. Therefore, a high-quality image, free of flicker or the like, can be displayed even if 6-bit gray-level display data items some of which are text data and the others of which are non-text data.

It will now be explained how the pixel gray-level control circuit 325 of the liquid crystal display 1 according to the third embodiment controls gray levels in order to display images which have quality suitable for OA (Office Automation) use.

First, as shown in FIG. 28, a switching signal (SW) is externally input to the gray-level control circuit 331 so that the pixel gray-level control circuit 325 may controls the gray levels. The selector circuit 341 is thereby set to output only the gray-level auxiliary data supplied from the pixel gray-level control circuit 325.

To set the red (R) pixel (1,1) at the third gray level which is not text data, during the first frame (F) period, 6-bit gray-level display data {000010} corresponding to the third gray level is input to the gray-level control circuit 331. The gray-level control circuit 331 converts the 6-bit gray-level display data {000010} to a 4-bit gray-level signal {0000} in the same manner as described above. The 6-bit gray-level display data {000010} corresponds to a 2/6 gray level which corresponds to none of the 16 preset gray-level voltages (V0, V1, . . . V15), namely to an intermediate gray level between the gray-level voltage (V0) and the gray-level voltage (V1). It must therefore be controlled by the pixel gray-level control circuit 325. Thus, the pixel gray-level pattern generating circuit 321 incorporated in the pixel gray-level control circuit 325 selects and outputs the gray-level auxiliary data {1} for the first line and first column of the gray-level pattern which is shown in FIG. 37 and which corresponds to the 2/6 gray level.

The processing circuit 351 adds the gray-level auxiliary data {1} to the 4-bit gray-level signal {0000}. The 4-bit gray-level data {0001} output from the processing circuit 351 is output to the X driver 101 through the liquid crystal controller 251. In accordance with the 4-bit gray-level data {0001}, the X driver 101 selects and outputs the gray-level voltage (V1).

To provide the third gray level during the second frame (F) period, as during the first frame (F) period, the processing circuit 351 adds the gray-level auxiliary data {0} for the first line and first column of the gray-level pattern shown in FIG. 37(*b*), to the 4-bit gray-level signal {0000}. Based on the resultant 4-bit gray-level data {0000}, the gray-level voltage (V0) is selected and output.

Further, during the third to sixth frame (F) periods, a preset gray-level voltage, either V0 or V1, is selected and output in a similar way.

If the 6-bit gray-level display data {000010} corresponding to the third gray level is input during six consecutive frame (F) periods, the third gray level will be provided during the six frame (F) period which define one display period.

Figure 38:
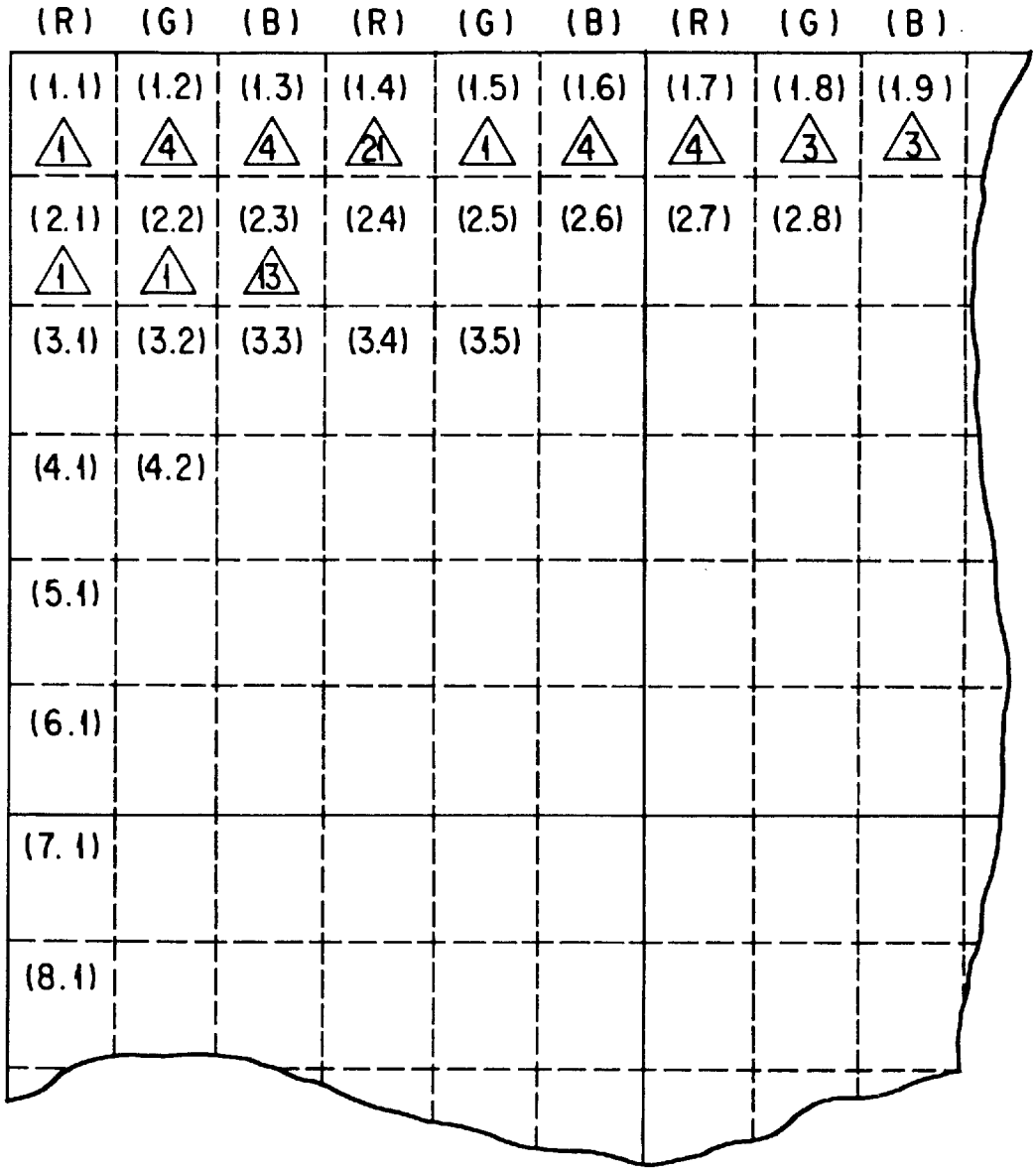
FIG. 38 is a diagram representing an example of a display state of the liquid crystal display shown in FIG. 28.

To set the green (G) pixel (1,8) at the third gray level which is not text data, during the first frame (F) period as shown in FIG. 38, 6-bit gray-level display data {000010} corresponding to the third gray level is input to the gray-level control circuit 331 through text data-detecting circuit 361. The gray-level control circuit 331 converts the 6-bit gray-level display data {000010} to a 4-bit gray-level signal {0000} in the same manner as described above. The 6-bit gray-level display data {000010} corresponds to a 2/6 gray level which corresponds to none of the 16 preset gray-level voltages (V0, V1, . . . V15), namely to an intermediate gray level between the gray-level voltage (V0) and the gray-level voltage (V). It must therefore be controlled by the pixel gray-level control circuit 325. Hence, the gray-level auxiliary data {1} for the first line and second column of the gray-level pattern stored in the pixel gray-level pattern generating circuit 323, which is shown in FIG. 37(*a*) and which corresponds to the 2/6 gray level is output in accordance with the output from the gray-level control circuit 331. The processing circuit 351 adds the gray-level auxiliary data {1} supplied from the pixel gray-level pattern generating circuit 323.

The 4-bit gray-level data {0001} is output to the X driver 101 through the liquid crystal controller 251.

Based on this 4-bit gray-level data {0001}, the gray-level voltage (V1) is selected and output.

In the above description, it has been explained how the pixel gray-level control circuit 325 controls intermediate gray levels when the input 6-bit gray-level display data is not text data. When the input 6-bit gray-level display data is text data, it suffices to output the 4-bit gray-level data to the liquid crystal controller 251, without processing it by means of the processing circuit 351, as in the case of controlling intermediate gray levels in the dot gray-level pattern generating circuit 315.

As described above in detail, the liquid crystal display 1 according to the third embodiment can provide 64 gray levels by using a relatively small number of gray-level voltages. The power consumption of the liquid crystal display can be reduced, and the manufacturing cost thereof can be lowered.

Moreover, since intermediate gray levels are provided from gray-level patterns formed on the basis of magic squares, the display can display images without lowering their quality or causing flicker on them.

In the liquid crystal display 1 according to the third embodiment, it is determined whether the processing circuit 351 needs to process the 4-bit gray-level signal, in accordance with whether the externally input 6-bit gray-level display data is text data or not. Therefore, a gray-level voltage which corresponds to a gray level similar to the one represented by the input 6-bit gray-level display data will be selected in accordance with the 4-bit gray-level signal, in order to display text such as characters or the like on which flicker may likely occur. A high-quality image, free of flicker or the like, can be displayed even if 6-bit gray-level display data items some of which are text data and the others of which are non-text data.

The third embodiment is designed to control an intermediate gray level for each color dot or each pixel, in accordance with a switching signal or in accordance with the type of the image to be displayed. For example, to display a moving image, it is desirable to control gray levels in accordance with an output of the dot gray-level pattern generating circuit 315. On the other hand, to display a still image or text data, it is desirable to control gray levels in accordance with an output of the pixel gray-level control circuit 325.

In the embodiment described above, each pixel is displayed at an intermediate gray level during one display period consisting of six consecutive frame (F) periods, by using a gray-level pattern which is a 6×6 matrix. Instead, a gray-level pattern which is a 7×7 matrix may be utilized. Still alternatively, the scheme of displaying each pixel during one display period consisting of six consecutive frame (F) periods, by using a gray-level pattern which is a 6×6 matrix, may be combined with the scheme of displaying each pixel at an intermediate gray level during one display period consisting of four consecutive frame (F) periods, by applying a gray-level pattern which is a 4×4 matrix.

When the 4-frame (F) period control scheme and the 6-frame (F) period control scheme are employed in combination, it is desirable to use a ¼ gray level, a ⅔ gray level and a ¾ gray level which are provided during a 4-frame (F) display period, and also to use a ⅔ gray level and a ⅚ gray level which are provided during a 6-frame (F) display period.

This is because a gray level ranging from ¼ gray level to ¾ gray level should better be utilized in order to display images having high quality.

In the third embodiment described above, 16 gray-level voltages (V0, V1, . . . V15) are applied. This invention is not limited to this scheme. Rather, the 16 gray-level voltages may be used in combination with other various gray-level voltages.

In the third embodiment, each gray-level pattern is a square array of entities which correspond to pixels. Nonetheless, the gray-gray pattern need not be a square array of entities.

Furthermore, in the third embodiment, either of two adjacent preset gray-level voltages is selected and output during consecutive frame (F) periods in order to provide a gray level which is an intermediate level between the two adjacent preset voltage levels. It is unnecessary, nonetheless, always to select two adjacent gray-level voltages. Rather, the gray-level voltages (V0) and (V2), the gray-level voltages (V0) and (V3), or the like may be selected to display a pixel at a intermediate gray level between the gray-level voltages (V1) and (V2). Alternatively, the display data may be controlled so as to select two or more gray-level voltages during a plurality of frame (F) periods. This method of controlling the display data can easily achieved by using gray-level auxiliary data items which are preset in each gray-level pattern and each of which consists of two or more bits. The third embodiment can, therefore, display images at more gray levels than otherwise.

The third embodiment described above is an active-matrix liquid crystal display. The third embodiment may be applied to a projection-type display. With a projection-type display which comprises a red (R) liquid crystal panel, a green (G) liquid crystal panel and a blue (B) liquid crystal panel, it is possible to control the liquid crystal panels independently, thereby to control gray levels for pixels of each color. The liquid crystal panels may be controlled, associated with one another, to control the gray-level for each pixel. Further, the present invention can be applied to other various types of displays and works effectively.

In summary, the third embodiment can, therefore, display flicker-free, high-quality multi-gray level images, by using a small number of voltages.

An active-matrix liquid crystal display according to the fourth embodiment of the invention will be described below, with reference to the accompanying drawings. The liquid crystal display is designed to display an image at 32 ($=2^5$) gray levels.

Figure 39:
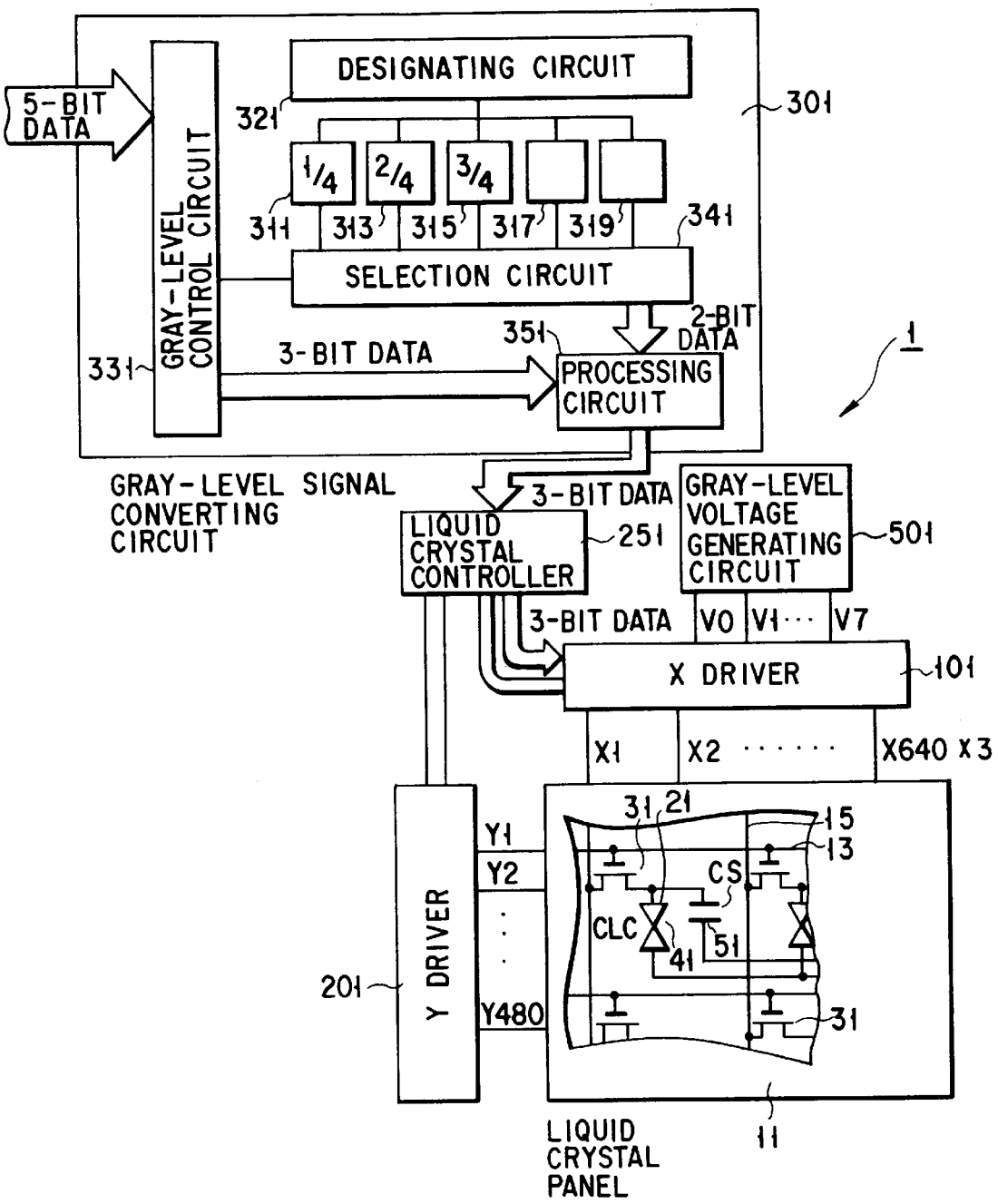
FIG. 39 is a diagram schematically showing a liquid crystal display according to a fourth embodiment of the present invention.
Figure 41:
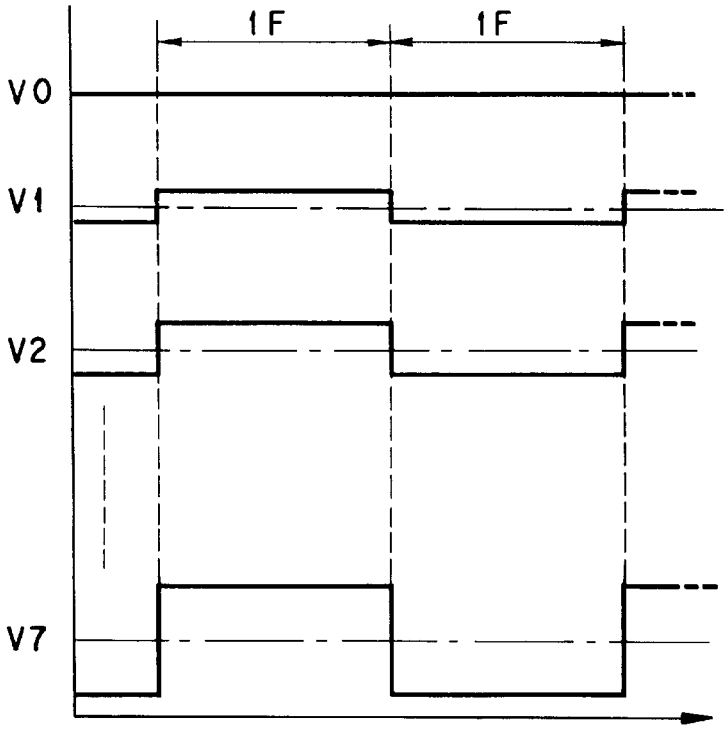
FIG. 41 is a diagram illustrating the waveforms of gray-level voltages generated by the gray-level voltage generating circuit shown in FIG. 39.

As shown in FIG. 39, this liquid crystal display 1 comprises a liquid crystal panel 11 having a matrix of pixels arrayed in (640×3) rows and 480 columns, an X driver 101 and Y driver 201 electrically connected to the liquid crystal panel 11, a liquid crystal controller 251 for controlling the X driver 101 and the Y driver 201, a gray-level signal converting circuit 301 for converting 5-bit gray-level display data externally input, to a 3-bit gray-level display data and for outputting the 3-bit gray-level display data to the liquid crystal controller 251, and a gray-level voltage generating circuit 501 for generating eight gray-level voltages (V0, V1, V2, . . . V7), each having a square waveform and inverted in polarity with respect to a reference voltage in every one-frame (F) period as shown in FIG. 41, and for outputting the eight gray-level voltages to the X driver 101. In the fourth embodiment, frame-inversion driving is employed. This driving scheme may be used in combination with line-inversion driving or the like in order to prevent flicker and the like. If this is the case, square-wave voltages, each inverted in polarity with respect to the reference voltage, not only in every one-frame (F) period but also in every horizontal scanning-line period, may be used as gray-level voltages (V0, V1, V2, . . . V7).

The liquid crystal panel 11 is of so-called active-matrix type. A TFT 31 is provided for each of its pixel electrodes 21. A scanning pulse (VG) is supplied from the Y driver 201 formed of a shift register to a scanning line 13 connected to the TFT 31, setting the TFT 31 in conducting state for a predetermined time. The gray-level voltage applied from a signal line 15 connected to the X driver 101 is transferred into the pixel electrode 21 through the TFT 31. The voltage is held for a one-frame (F) period in a liquid-crystal capacitance (Clc) and also in an auxiliary capacitance (Cs) juxtaposed with the liquid-crystal capacitance by virtue of a capacitance line 51, so as to form an image.

Figure 40:
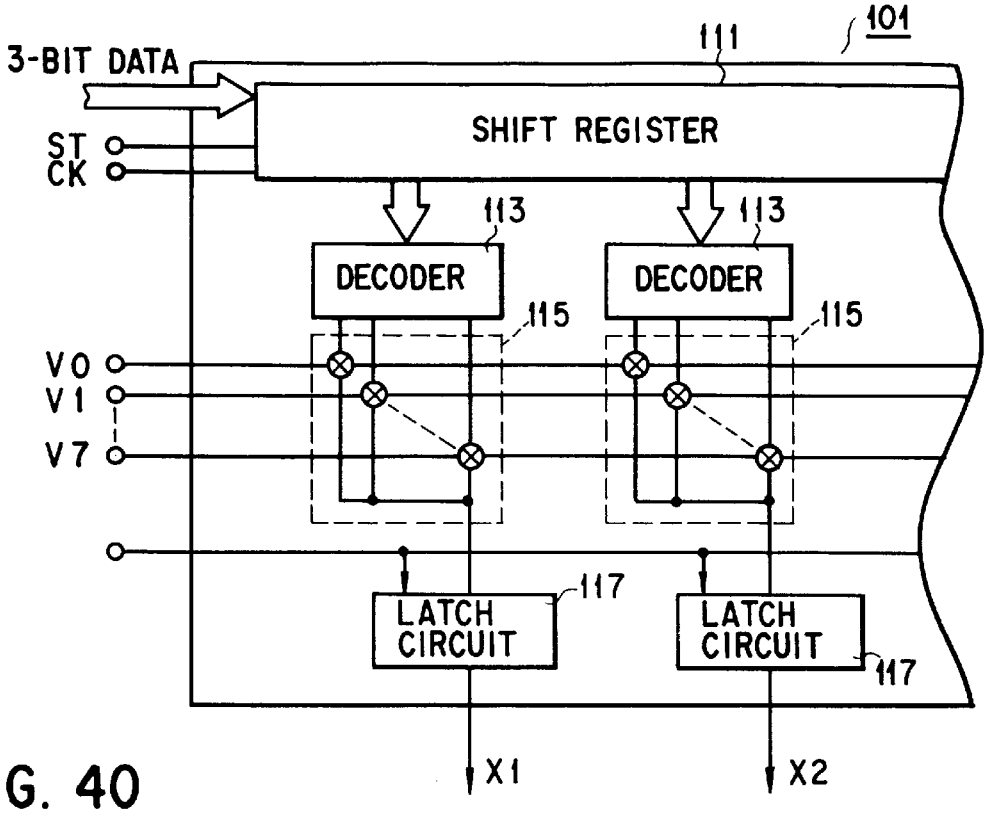
FIG. 40 is a diagram schematically illustrating the X driver shown in FIG. 39.

As shown in FIG. 40, the X driver 101 comprises a shift register 111 for sequentially transferring the 3-bit gray-level display data input to it, in response to a shift clock signal (CK) and a start pulse (ST), decoders 113 for converting an output from the shift register 111, selection circuits 115 for selecting and outputting one of the eight gray-level voltages (V0, V1, . . . V7) in accordance with the outputs of the decoders 113. The X driver 101 further comprises latch circuits 117 for holding the outputs from the selection circuits 115 for a predetermined period of time.

The gray-level signal converting circuit 301 incorporated in the liquid crystal display 1 will now be described.

The gray-level signal converting circuit 301 comprises a gray-level control circuit 331 for converting the externally input 5-bit gray-level display data to a 3-bit gray-level display data, which will serve to select any one of the eight gray-level voltages (V0, V1, . . . V7) preset in the gray-level voltage generating circuit 501.

The circuit 301 further comprises a processing circuit 351. If the 3-bit gray-level display data obtained by the conversion corresponds to one of the gray-level voltages preset in the gray-level voltage generating circuit 501, the circuit 351 will output the data without processing it. If the 3-bit gray-level display data corresponds an intermediate gray level between the gray-level voltages preset in the gray-level voltage generating circuit 501, the circuit 351 will process the data to obtain the intermediate gray level and will then output the data thus processed.

The gray-level signal converting circuit 301 is connected by a selection circuit 341 to first to fifth gray-level pattern generating circuits 311, 313, 315, 317 and 319 which are designed to process the 3-bit gray-level display data. The selection circuit 341 is designed to select one of the first to fifth gray-level pattern generating circuit 311, 313, 315, 317 and 319 in accordance with an output from the gray-level control circuit 331 when the externally input 5-bit gray-level display data corresponds to the intermediate gray level between the gray-level voltages preset in the gray-level voltage generating circuit 501.

Figure 42:
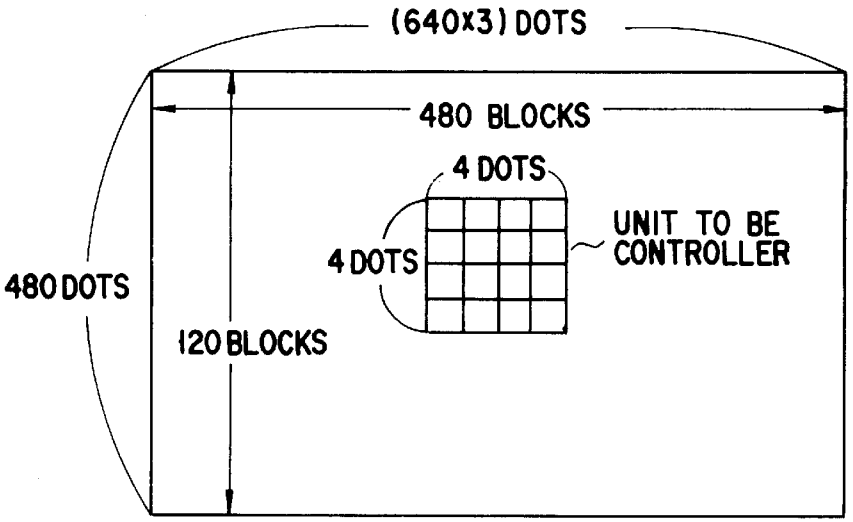
FIG. 42 is a diagram representing a unit to be controlled by the gray-level pattern generating circuit shown in FIG. 39.
Figure 43:
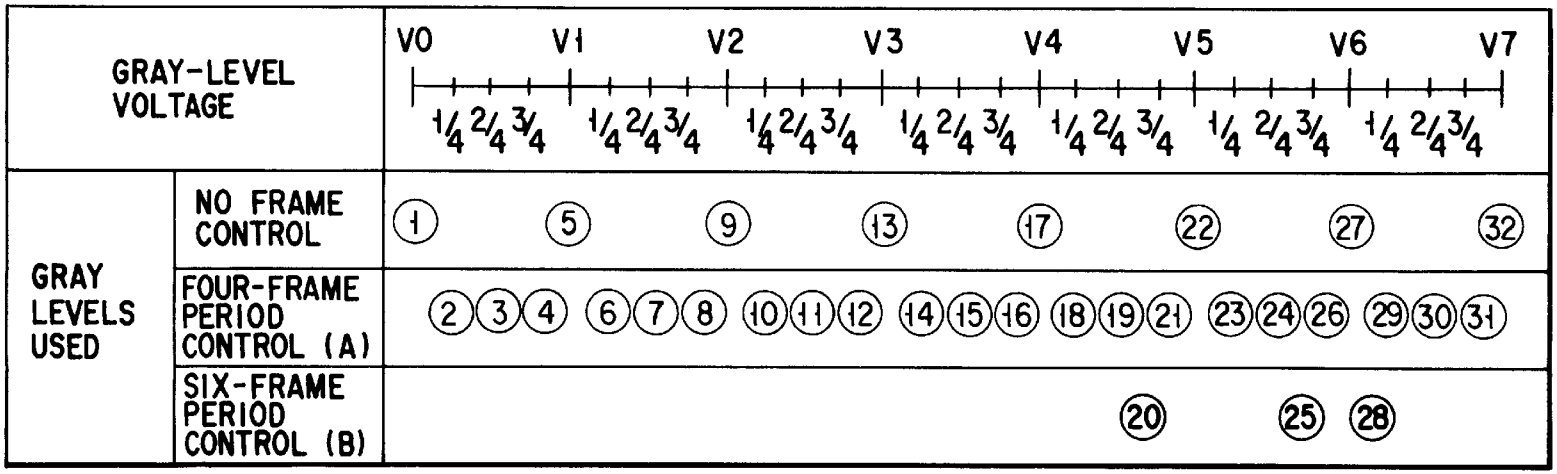
FIG. 43 is a diagram explaining the principle of a multi-gray level display operation of the liquid crystal display shown in FIG. 39.

Each of the gray-level pattern generating circuit 311, 313, 315, 317 and 319 serves to divide the display pixel region of the liquid crystal panel 11 into 120 (rows)×480 (columns) blocks, each of which is formed of adjacent 16 pixels arranged in four rows and four columns (forming a 4×4 square matrix) as shown in FIG. 42, and a unit to be controlled. Each gray-level pattern generating circuit controls each first unit of control during a first display period which consists of four consecutive frame (F) periods.

Each gray-level pattern is therefore formed of four tables shown in FIGS. 44(*a*)–(*d*), each comprised of 2-bit sixteen gray-level auxiliary data items each representing a gray level. The first gray-level pattern generating circuit 311 stores the gray-level pattern for providing a ¼ gray level, which is shown in FIGS. 44(*a*)–(*d*). The second gray-level pattern generating circuit 313 stores the gray-level pattern for providing a ¾ gray level, which is shown in FIGS. 44(*a*)–(*d*). The third gray-level pattern generating circuit 315 stores the gray-level pattern for providing a ¾ gray level, which is shown in FIG. 44. The fourth gray-level pattern generating circuit 317 stores the gray-level pattern for providing the 20th and 25th gray levels, which is shown in FIG. 45. The fifth gray-level pattern generating circuit 319 stores the gray-level pattern for providing the 28th gray levels, which is shown in FIG. 45.

Each of the gray-level pattern generating circuit 311, 313, 315, 317 and 319 is connected to a designating circuit 321 which comprises a 4-frame counter for selecting one of the first to fourth tables in each gray-level pattern shown in FIGS. 44(*a*)–(*d*) and 45(*a*)–(*d*), and a 4-line counter and 4-column counter for obtaining 2-bit gray-level auxiliary data items from the table, each data item corresponding to a pixel.

In the gray-level signal converting circuit 301, thus constructed, the gray-level control circuit 331 converts the externally input 5-bit gray-level display data to 3-bit gray-level display data. If the 3-bit display data corresponds to one of the gray-level voltages preset in the gray-level voltage generating circuit 501, it is output to the X driver 101 through the liquid crystal controller 251, without being processed by the processing circuit 351. If the 3-bit display data corresponds to an intermediate gray level between the gray-level voltages preset in the gray-level voltage generating circuit 501, the processing circuit 351 processes the data based on the gray-level auxiliary data items stored in the selected one of the gray-level pattern generating circuits 311, 313, 315, 317 and 319 to obtain the intermediate gray level. The 3-bit gray-level display data, thus processed, is output to the X driver 101 through the liquid crystal controller 251.

A method of providing an intermediate gray level in the liquid crystal display 1 of the fourth embodiment will be explained in detail. In the liquid crystal display having 8 square-wave gray-level voltages (V0, V1, V2, . . . V7), an image can be displayed at 8 gray levels. In order to display the image at 8 gray levels by using 8 square-wave gray-level voltages (V0, V1, V2, . . . V7), the liquid crystal display 1 operates as will be described below.

To provide a ¼ gray level intermediate between a gray-level voltage (Vi) (i=0, 1, 2, . . . 6) and the next gray-level voltage (Vi+1), the gray-level voltage (Vi) is selected during three of four consecutive frame (F) periods, and the next gray-level voltage (Vi+1 ) is selected during the remaining one frame (F) period. To provide a ¾ gray level an intermediate between a gray-level voltage (Vi) and the next gray-level voltage (Vi+1), the gray-level voltage (Vi) is selected during two of four consecutive frame (F) periods, and the next gray-level voltage (Vi+1) is selected during the remaining two frame (F) periods. To provide a ¾ gray level intermediate between a gray-level voltage (Vi) and the next gray-level voltage (Vi+1), the gray-level voltage (Vi) is selected during one of four consecutive frame (F) periods, and the next gray-level voltage (Vi+1) is selected during the remaining three frame (F) periods.

Since the control of the frame (F) periods is effected in combination with the eight gray-level voltages (V0, V1, . . . V7), it is possible to provide 29 gray levels.

Furthermore, in order to display images at 32 gray levels, three more gray levels are provided in the fourth embodiment, by the following method.

To provide the 20th gray level which is an intermediate level between the 19th and 21st gray levels, two adjacent gray-level voltages (V4) and (V5) are not used, but gray-level voltages (V3) and (V6). Similarly, to provide the 25th gray level which is an intermediate level between the 24th and 26th gray levels, gray-level voltages (V4) and (V7), and to provide the 28th gray level which is an intermediate level between the 27th and 29th gray levels, gray-level voltages (V5) and (V7). One of the two gray-level voltages used is selected during two of four consecutive frame (F) periods, and the other is selected during the remaining two of the four consecutive frame (F) periods.

Since the control of the frame (F) periods is effected in combination with the eight gray-level voltages (V0, V1, . . . V7) in various combination, it is possible to provide 32 gray levels.

The gray-level patterns used in the fourth embodiment will be described in detail, one by one. Selection of a gray-level pattern is based on the concept of a perfect square in the fourth embodiment.

A perfect magic square is an N×N matrix of integers of 1 to $N^2$, where the sum of the integers of each row, each column and each diagonal is the same. On the other hand, a magic square is an N×N matrix of integers of 1 to $N^2$, where the sum of the integers of each row and each column is the same.

Any matrix other than a (4r+2)×(4r+2) matrix (r is a positive integer greater than 0) can be a perfect magic square. Therefore, each gray-level pattern is formulated based on a perfect magic square in the fourth embodiment. To formulate the gray-level patterns each of which is a (4r+2)×(4r+2) matrix, e.g., a 6×6 matrix, the concept of a magic square may be applied.

A perfect magic square of the type shown in FIG. 6 relating to the first embodiment can be formulated from auxiliary magic squares each of which is a 4×4 matrix of integers of 1 to 4 and where the sum of the integers of each row, each column, and each diagonal is the same. More specifically, as shown in FIG. 7, it can be obtained from two different auxiliary magic squares A and B, by applying the equation of [4×(a−1)+B], where a and b are the numbers assuming the same position in the auxiliary magic squares A and B.

Each of the gray-level patterns is selected from the perfect magic square thus formulated, in the following way.

To set a pixel at a ¼ gray level between the gray-level voltage (Vi) and the next gray-level voltage (Vi+1), it suffices to select the gray-level voltage (Vi+1) during only one of four consecutive frame (F) periods and the gray-level voltage (Vi) during the remaining three frame (F) periods. Thus, as shown in FIG. 8(*a*), gray-level auxiliary data {01} is allocated to part of the matrix where numbers 1 to 4 are positioned, and gray-level auxiliary data {00} to the remaining numbers of the matrix, thereby forming the first of the four tables which are required to provide a ¼ gray level of the first gray-level pattern. Also, as illustrated in FIG. 8(*a*), gray-level auxiliary data {01} is allocated to part of the matrix where numbers 5 to 8 are positioned, and gray-level auxiliary data {00} to the remaining numbers of the matrix, thereby forming the second of the four tables which are required to provide a ¼ gray level of the first gray-level pattern. Further, gray-level auxiliary data {01} is allocated to part of the matrix where numbers 9 to 12 are positioned, and gray-level auxiliary data {00} to the remaining numbers of the matrix, thereby forming the third of the four tables which are required to provide a ¼ gray level of the first gray-level pattern. Still further, gray-level auxiliary data {01} to numbers 13 to 16 included in a matrix, and gray-level auxiliary data {00} to the remaining numbers of the matrix, thereby forming the last of the four tables which are required to provide a ¼ gray level of the first gray-level pattern. Shown in FIG. 8(*b*) are diagonals approximated to the numbers to which the gray-level auxiliary data {01} has been allocated.

The first to fourth tables, thus formed, are sequentially repeated during four frame (F) periods which define one display period, thereby providing a ¼ gray level between the gray-level voltage (Vi) and the next gray-level voltage (Vi+1). In the fourth embodiment, the tables are rearranged such that the axis of each group rotates 90° during each frame period. To be more precise, the tables are rearranged in the order of: the first table, the second table, the fourth table, and the third table. As a result, as shown in FIGS. 44(*a*)–(*d*), a gray-level pattern is generated which is required to provide a ¼ gray level between the gray-level voltage (Vi) and the next gray-level voltage (Vi+1). Since the four tables are rearranged so as to determine the order of selecting the tables such that each table may have an axis different from that of the table which can be selected during the next frame (F) period, the gray level is more stabilized, reducing the flicker on the image displayed at that gray level.

To set a pixel at a ¾ gray level between the gray-level voltage (Vi) and the next gray-level voltage (Vi+1), it suffices to select the gray-level voltage (Vi+1 ) during two of four consecutive frame (F) periods and the gray-level voltage (Vi) during the remaining two frame (F) periods. Then, as shown in FIG. 9, gray-level auxiliary data {01} is allocated to part of the matrix where numbers 1 to 8 are positioned, gray-level auxiliary data {00} is allocated to part of the matrix where the remaining numbers are positioned, thereby forming the first of the four tables which are required to provide a ¾ gray level of the first gray-level pattern. Also, gray-level auxiliary data {01} is allocated to part of the matrix where numbers 9 to 15 are positioned, and gray-level auxiliary data {00} to the remaining numbers of the matrix, thereby forming the second of the four tables which are required to provide a ¾ gray level of the first gray-level pattern. Similarly, the third and fourth of the four tables required to provided a ¾ gray level of the first gray-level pattern are formed. As a result, there is formed a gray-level pattern for providing a ¾ gray level between the gray-level voltage (Vi) and the next gray-level voltage (Vi+1) which are shown in FIG. 9. The first to fourth tables, thus formed, are sequentially repeated during four frame (F) periods which define one display period, thereby providing a ¾ gray level between the gray-level voltage (Vi) and the next gray-level voltage (Vi+1).

To set a pixel at a ¾ gray level between the gray-level voltage (Vi) and the next gray-level voltage (Vi+1), it suffices to select the gray-level voltage (Vi+1) during three of four consecutive frame (F) periods and the gray-level voltage (Vi) during the remaining one frame (F) period. Hence, a gray-level pattern is obtained by inverting the gray-level auxiliary data items of the four tables for providing a ¼ gray level, which are shown in FIGS. 44(*a*)–(*d*). The first to fourth tables, thus formed, are sequentially repeated during four frame (F) periods which define one display period, thereby providing a ¾ gray level between the gray-level voltage (Vi) and the next gray-level voltage (Vi+1).

To provide the 20th gray level between the 19th and 22nd gray levels, it suffices to select one of the gray-level voltages (V3) and (V6) during the two of four consecutive frame (F) periods and select the other of the gray-level voltages during the remaining two frame (F) periods. To provide the 25th gray level between the 24th and 26th gray levels, it suffices to select one of the gray-level voltages (V4) and (V7) during the two of four consecutive frame (F) periods and select the other of the gray-level voltages during the remaining two frame (F) periods. To provide the 28th gray level between the 27th and 29th gray levels, it suffices to select one of the gray-level voltages (V5) and (V7) during the two of four consecutive frame (F) periods and select the other of the gray-level voltages during the remaining two frame (F) periods.

The 20th and 24th gray levels are provided in the following manner. As shown in FIG. 9, gray-level auxiliary data {11} is allocated to part of the matrix where numbers 1 to 8 are positioned, gray-level auxiliary data {00} is allocated to part of the matrix where the remaining numbers are positioned, thereby forming the first of the four tables which are required to provide the fourth gray-level pattern. Further, gray-level auxiliary data {11} is allocated to part of the matrix where numbers 9 to 16 are positioned, gray-level auxiliary data {00} is allocated to part of the matrix where the remaining numbers are positioned, thereby forming the second of the four tables which are required to provide the fourth gray-level pattern.

Still further, the third and fourth of the four tables are formed in a similar way.

The 28th gray level is provided in the following manner. Gray-level auxiliary data {10} is allocated to part of the matrix where numbers 1 to 8 are positioned, gray-level auxiliary data {00} is allocated to part of the matrix where the remaining numbers are positioned, thereby forming the first of the four tables which are required to provide the fourth gray-level pattern.

Further, gray-level auxiliary data {10} is allocated to part of the matrix where numbers 9 to 16 are positioned, gray-level auxiliary data {00} is allocated to part of the matrix where the remaining numbers are positioned, thereby forming the second of the four tables which are required to provide the fourth gray-level pattern. Still further, the third and fourth of the four tables are formed in a similar way.

Since the gray-level pattern consists of 4×4 matrices which are perfect magic squares, the frame (F) period or periods for selecting the gray-level voltage (Vi) and the frame (F) period or periods for selecting the next gray-level voltage (Vi+1) are uniformly dispersed to set a plurality of adjacent pixels at a gray level between the gray-level voltage (Vi) and the next gray-level voltage (Vi+1). This prevents flicker and the like.

The gray-level patterns, thus formed, are stored in the gray-level pattern generating circuits 311, 313, 315, 317 and 319 which are formed of RAMS. The gray-level pattern generating circuits 311, 313, 315, 317 and 319 which may be formed of ROMs.

Figure 46:
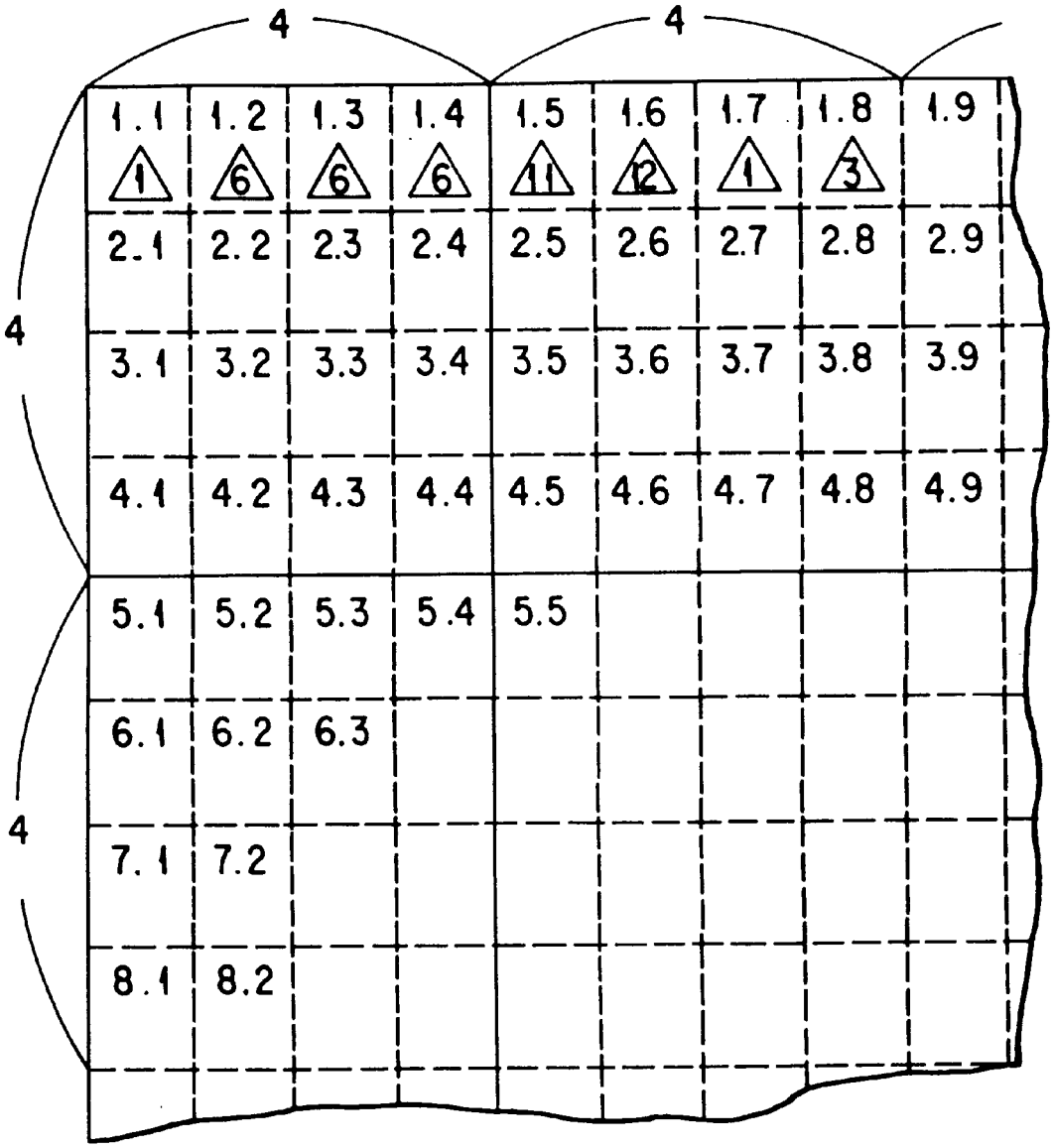
FIG. 46 is a diagram representing an example of a display state of the liquid crystal display shown in FIG. 39.

FIG. 46 is a diagram representing an example of a display state of the liquid crystal panel 11. How the liquid crystal display 1 operates to obtain the display state will be explained.

To set the pixel (1,1) at the first gray level, 5-bit gray-level display data {00000} corresponding to the first gray level is input to the gray-level signal converting circuit 301. In the gray-level signal converting circuit 301, the gray-level control circuit 331 converts the 5-bit gray-level display data {00000} to 3-bit gray-level display data {000} corresponding to the eight gray-level voltages (V0, V1, . . . V7). The 5-bit gray-level display data {00000} for providing the first gray level corresponds to the gray-level voltage (V0), i.e., one of the eight gray-level voltages (V0, V1, . . . V7). The 3-bit gray-level display data {000} is output to the liquid crystal controller 251, without being processed by the processing circuit 351. The X driver selects the gray-level voltage (V0) in accordance with the 3-bit gray-level display data {000}, whereby a drive voltage is applied to the pixel (1,1). The pixel (1,1) is thereby set at the first gray level.

To set the pixel (1,2) at the sixth gray level, 5-bit gray-level display data {00101} corresponding the sixth gray level is input to the gray-level signal converting circuit 301. The gray-level control circuit 331 converts the 5-bit gray-level display data {00101} to 3-bit gray-level display data {001} corresponding to the eight gray-level voltages (V0, V1, . . . V7). The 5-bit gray-level display data {00101} for providing the sixth gray level corresponds to an intermediate ¼ gray level (FIG. 42) between the gray-level voltage (V1) and the next gray-level voltage (V2). This 5-bit gray-level display data therefore needs to be controlled by the first gray-level pattern generating circuit 311. The selection circuit 341 selects the first gray-level pattern generating circuit 311. The designating circuit 321 reads gray-level auxiliary data {00} from, the first table for ¾ gray-level shown in FIG. 44(*a*). The gray-level auxiliary data {00} corresponds to the pixel (1,2) and designates the first line and the second column of the first table. The the processing circuit 351 adds the gray-level auxiliary data {00} read from the first gray-level pattern generating circuit 311, to the 3-bit gray-level display data {001}. The 3-bit gray-level display data {001} is supplied from the processing circuit 351 to the X driver 101 through the liquid crystal controller 251. The X driver 101 selects and outputs the gray-level voltage (V0) in accordance with the 3-bit gray-level display data {001}.

To set the pixel at the sixth gray level, too, during the second frame (F) period, as during the first frame (F) period, gray-level auxiliary data {00} is read from the second table for the ¼ which is shown in FIG. 44(*b*), and is added to the 3-bit gray-level auxiliary data {001} by the processing circuit 351. In accordance with the resultant 3-bit gray-gray display data {001}, the X driver 101 selects and outputs the gray-level voltage (V1).

To set the pixel at the sixth gray level, too, during the third frame (F) period, as during the first frame (F) period, gray-level auxiliary data {01} is read from the third table for the ¼ which is shown in FIG. 44(*c*), and is added to the 3-bit gray-level auxiliary data {001} by the processing circuit 351. In accordance with the resultant 3-bit gray-gray display data {001}, the X driver 101 selects and outputs the gray-level voltage (V2).

To set the pixel at the sixth gray level, too, during the fourth frame (F) period, as during the first frame (F) period, gray-level auxiliary data {00} is read from the fourth table for the ¼ which is shown in FIG. 44(*d*), and is added to the 3-bit gray-level auxiliary data {001} by the processing circuit 351. In accordance with the resultant 3-bit gray-gray display data {001}, the X driver 101 selects and outputs the gray-level voltage (V1).

In the case where 5-bit gray-level display data {00101} is input to provide the sixth gray level, four consecutive frame (F) periods are used as one display period. A pixel can thereby be displayed at the sixth gray level.

To set, for example, the pixel (1,3) adjacent to the pixel (1,2) at the fourth gray level, a gray-level pattern is selected such that the frame (F) period for selecting the gray-level voltage (V1) and the frame period for selecting the gray-level voltage (V2) are well balanced for adjacent pixels such as the pixel (2,1) and the pixel (1,3). This prevents flicker and the like.

In the case described above, the 5-bit gray-level display data {00101} for providing the sixth gray level is input at any time during the four consecutive frame (F) periods in order to select the pixel (1,2). Nonetheless, a different 5-bit gray-level display data may be input during each frame (F) period to display a moving image.

It will now be explained how the 20th gray level is provided during the second frame (F) period when 5-bit gray-level display data {10011} is input. The gray-level control circuit 331 converts this 5-bit gray-level display data {10011} to 3-bit gray-level display data {011} corresponding to eight gray-level voltages (V0, V1, . . . V7), in the same way as described above. The 5-bit gray-level display data {10011} is to provide the 20th gray level which is an intermediate gray level and which corresponds to none of the eight gray-level voltages (V0, V1, . . . V7). It therefore needs to be controlled by fourth first gray-level pattern generating circuit 317. The processing circuit 351 adds the gray-level auxiliary data {11} read from the second table (FIG. 45) for the 20th gray level, to the 3-bit gray-level display data {011}. In accordance with the 3-bit gray-level display data {110} obtained by the addition, the X driver 101 outputs the gray-level voltage (V6).

When a moving image is displayed, the 5-bit gray-level display data input for one pixel is changed for each frame (F) period to set one pixel at a gray level. In this case, each gray level can hardly be recognized visually. For this reason, the display control for each frame (F) period is effected based on the 5-bit gray-level display data input.

It will now be explained how the pixel (1,5) is set at the eleventh gray level as shown in FIG. 46. The 5-bit gray-level display data {01010} corresponding to the eleventh gray level is converted to 3-bit gray-level display data {010} in the same way as described above. Since the 3-bit gray-level display data is an intermediate gray level corresponding to none of the eight gray-level voltages (V0, V1, . . . V7), it must be controlled by the second gray-level pattern generating circuit 313. The processing circuit 351 therefore adds to the 3-bit gray-level display data {101}, the gray-level auxiliary data {01} having been provided for the first line and first column of the first table of the ¾ gray-level pattern shown in FIG. 44(*a*). The 3-bit gray-level display data {011} generated by the circuit 351 is output to the X driver 101 through the liquid crystal controller 251. The X driver 101 selects and outputs the gray-level voltage (V3) based on the 3-bit gray-level display data {011}.

To set the pixel (1,5) at the fifth gray level during the second frame (F) period, the processing circuit 351 adds gray-level auxiliary data {01} which has been provided for the first line and the fifth column of the second table which forms the ¾ gray-level pattern shown in FIG. 44(*b*). The X driver 101 selects and outputs the gray-level voltage (V3) based on the 3-bit gray-level display data {011}.

As cam be seen from the above description, the liquid crystal display 1 of the fourth embodiment of the invention, can provide 32 gray levels by using 16 voltage levels of eight square-wave gray-level voltages (V0, V1, V2, . . . V7). Furthermore, in the fourth embodiment, each gray-level pattern is formed of tables in each of which 2-bit gray-level auxiliary data are allocated to the matrix thereof so that the ON/OFF control thereof is performed based on the concept of a magic square or a perfect magic square. The fourth embodiment can, therefore, display multi-gray level images which have high quality and which have no flicker on them.

In the embodiment described above, eight gray-level voltages (V0, V1, . . . V7) are applied. This invention is not limited to this scheme. Rather, the 16 gray-level voltages may be used in combination with other various gray-level voltages.

Moreover, in the fourth embodiment, not only eight gray-level voltages (V0, V1, . . . V7) are used in combination with a display control for four consecutive frame (F) periods. The invention is not limited to this mode. Each unit data comprised of a 5×5 matrix may be controlled during five consecutive frame (F) periods, or each unit data comprised of a 7×7 matrix may be controlled during seven consecutive frame (F) periods. Further, the display data items can be controlled during five or seven consecutive frame (F) periods, as well as four consecutive frame (F) periods, so that multi-gray level images may be displayed by using less gray-level voltages than otherwise. For example, if a unit data comprised of a 5×5 matrix is controlled during five consecutive frame (F) periods, as well as during four consecutive frame (F) periods, ⅖ gray level, ⅗ gray level and the like will be provided which are intermediate gray levels between a gray-level voltage (Vi) and the next gray-level voltage (Vi+1).

As indicated above, the fourth embodiment has the liquid crystal panel 11 which has a square array of pixels. Needless to say, the square array of pixels may be replaced by a delta array of pixels.

In the fourth embodiment, either of two adjacent preset gray-level voltages is selected and output during consecutive frame (F) periods in order to provide a gray level between the two adjacent preset voltage levels. Nonetheless, two adjacent gray-level voltages need not always be selected. Needless to say, three or more gray-level voltages may be selected and output during a plurality of consecutive frame (F) periods. For instance, to control a data unit comprised of a 4×4 matrix during four consecutive frame (F) periods, the gray-level voltage (V0) may be selected during the first frame (F) period and the fourth frame (F) period, the gray-level voltage (V1) may be selected during the second frame (F) period, and the gray-level voltage (V2) is selected during the third frame (F) period, thereby to provide an intermediate gray level between the gray-level voltages (V0) and (V1).

In the fourth embodiment, each of the gray-level pattern generating circuits 311, 313, 315, 317 and 319 controls the display pixel region of the liquid crystal panel 11, in units of 4×4 square matrices, each consisting of 16 pixels as shown in FIG. 42. Each of these units to control need not be a square array of pixels. Instead, it may be formed of pixels arranged in any other pattern, such as the one illustrated in FIG. 13 and used in the first embodiment.

The 5-bit gray-level display data externally input to the fourth embodiment is converted to 3-bit gray-level display data by the gray-level signal converting circuit 301 before it is input to the liquid crystal controller 251. Alternatively, selector circuits 601 and 603 may be provided in such a manner as shown in FIG. 14(*a*)–(*b*), thereby to input the gray-level display data externally input directly or indirectly through the gray-level signal converting circuit 301, to the liquid crystal controller 251.

This makes it unnecessary to design several types liquid crystal displays, each based on the number of bits constituting the externally input gray-level display data.

In the structure shown in FIG. 14(*a*), for example, the selector circuits 601 and 603 are changed over, thereby outputting the externally input gray-level data through the liquid crystal controller 251 if the gray-level display data externally input consists of three bits. In other words, the liquid crystal display 1 can display multi-gray level images, no matter whether the gray-level display data externally input consists of three bits or five bits.

The fourth embodiment described above is an active-matrix liquid crystal display. The present invention can be applied to other various types of displays and works effectively.

Figure 47:
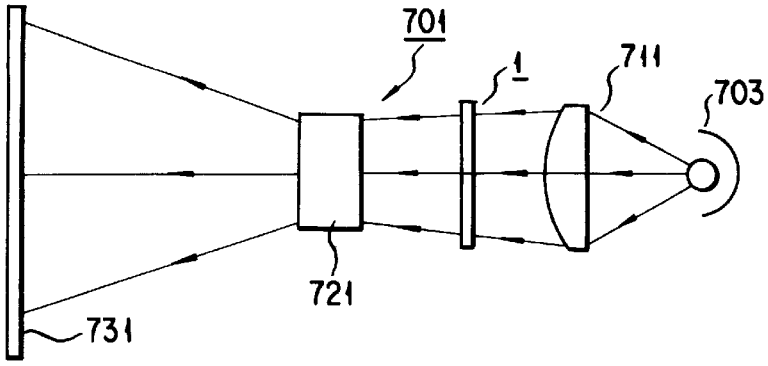
FIG. 47 is a diagram schematically depicting a liquid crystal projector incorporating the liquid crystal display shown in FIG. 39.
Figure 48:
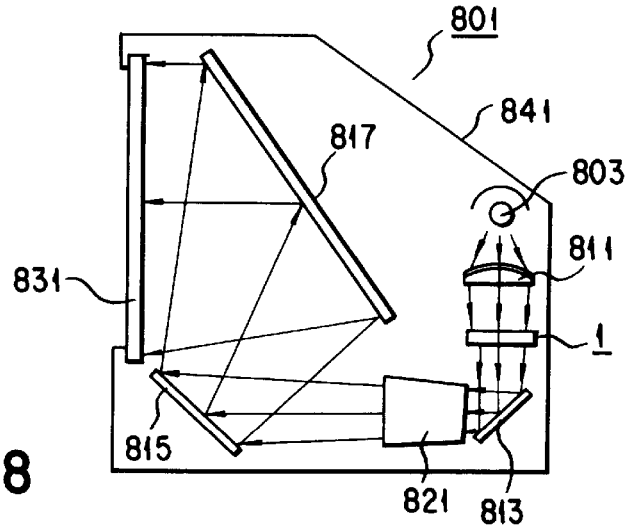
FIG. 48 is a diagram schematically depicting another liquid crystal projector incorporating the liquid crystal display shown in FIG. 39.

The embodiment described above is an active-matrix liquid crystal display of direct-view type. They operate more effectively if incorporated in a liquid crystal projector 701 of front-projection type shown in FIG. 47 or a liquid crystal projector 801 of back-projection type shown in FIG. 48.

The liquid crystal projector 701 comprises a light source 703, a light-collecting lens 711 for collecting light emitted from the light source 703, an active-matrix liquid crystal display 1 for modulating the light which has passed through the lens 711, and a light-projecting lens 721 for projecting the light modulated by the display 1 onto a screen 731. The liquid crystal display 1 may be of the the type which controls transmission and scattering of light by using polymer-dispersed liquid crystal and which slightly differs from the structure illustrated in FIG. 47.

The liquid crystal projector 801 comprises a light source 803, a light-collecting lens 811 for collecting light emitted from the light source 803, an active-matrix liquid crystal display 1 for modulating the light which has passed through the lens 711, a first reflector 813 for guiding the light modulated by the display 1 to a light-projecting lens 821, second reflectors 815 and 817 for guiding the modulated light which has passed through the light-projecting lens 821 to a screen 831, and a housing 841 containing the liquid crystal display 1 and the like.

Figure 49:
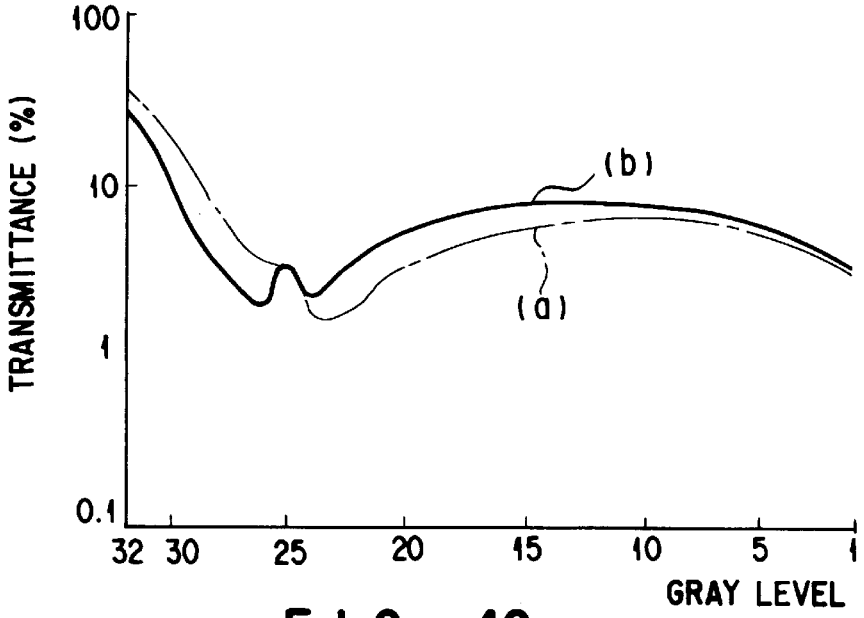
FIG. 49 is a graph illustrating the relationship between transmittance of a pixel and the gray level applied to the pixel, and therefore showing the view-angle dependency of liquid crystal.

The reason whey the liquid crystal display 1 operates effectively if incorporated in a liquid crystal projector 701 or 801 will now be explained. In the liquid crystal display 1, the gray level displayed and the transmittance correspond to each other at an angle of about ±10° to the normal to the display plane, as indicated by the curve (a) shown in FIG. 49. On the other hand, the transmittance does not correspond to the gray level at an angle of about ±20°, as indicated by the curve (b) shown in FIG. 49. In the liquid crystal projectors 701 and 801, the gray level is reliably displayed because the light which has passed through the light-collecting lens 711 passes trough the liquid crystal display 1 and also because the light from the light source is not applied at an angle of more than 15° to the normal.

As described above, the liquid crystal display according to this embodiment operates efficiently, particularly in a liquid crystal projector.

In summary, the fourth embodiment can, therefore, display multi-gray level images, by using a small number of voltages. This is because the selection control means is controlled to select and output a predetermined in accordance with the output of a gray-level pattern generating circuit selected based on the input multi-gray level display data when this data represents none of the gray levels corresponding to preset voltages. Hence, it is possible to manufacture the display at lower cost or to reduce the size of the display.

As has been described in detail, the first to fourth embodiment can display images based on gray-level display data which corresponds to none of preset gray-level voltages, by using gray-level patterns selected in accordance with a magic square or a perfect magic square. Therefore, the embodiments can reliably prevent display inconvenience such as flicker. The advantages described above become more prominent if a plurality of gray-level patterns are used in combination.

Since a first gray-level pattern generating circuit for generating a first gray-level pattern which acquires a gray level during m frame periods (m is a positive integer not less than 2) is used in combination with a second gray-level pattern generating circuit for generating a second gray-level pattern which acquires another gray level during n frame periods (n is a positive integer greater than m), display inconvenience such as flicker can be readily prevented without increasing the display period. In particular, since the first or second gray-level pattern is selected in accordance with a magic square or a perfect magic square, the advantages described above become more prominent.

The liquid crystal display 1 according to each of the first to fourth embodiments has an X driver which selects and outputs one of the gray-level voltages applied from the gray-level signal converting circuit 301 in accordance with gray-level display data. The X driver is not limited to this type. It may be a DAC (Digital-to-Analog Converter) type in which each X driver divides an externally applied reference voltage by using resistors or capacitors, thus providing a plurality of gray-level voltages, and selects and outputs one of these gray-level voltages in accordance with the gray-level display data.

The use of the DAC type reduces the number of input wires required as compared with the case where the gray-level voltage generating circuit 501 is used, is though the circuit size of each X driver increases a little.

The liquid crystal displays according to the first to fourth embodiments, described above, are of the type wherein the X driver 101 and the Y driver 201 are independently located outside the liquid crystal panel 11 and are connected to the liquid crystal panel 11. Instead, the X driver 101 and the Y driver 201 may be formed integral with the liquid crystal panel 11 by the use of polycrystalline silicon or the like. This alteration of design eliminates the cumbersome work of connecting the drivers 101 and 201 to the liquid crystal panel 11.

Industrial Applicability

As has been described above, the present invention can display multi-gray level images of high quality, without causing flicker on the images.

We claim:

1. A multi-gray level display apparatus comprising:

a display panel having a plurality of pixels, each pixel being driven by at least one voltage selected from a group of preset voltages in accordance with multi-gray level display data for the pixel;

a first gray-level pattern generating circuit generating a first gray-level pattern for acquiring a gray level during m frame periods (where m is an integer not less than 2);

a second gray-level pattern generating circuit generating a second gray-level pattern for acquiring another gray level during n frame periods (where n is an integer greater than m);

display data converting means for converting input k-bit multi-gray level display data to i-bit multi-gray level display data (where k is a positive integer greater than j); and an operation circuit for generating a result by performing an operation on the j-bit multi-gray level display data in accordance with the first gray-level pattern when the k-bit multi-gray level display data corresponds to a display gray level based on the first gray-level pattern, and in accordance with the second gray-level pattern when the k-bit multi-gray level display data corresponds to a display gray level based on the second gray-level pattern, and for outputting the result, wherein said first gray-level pattern generating circuit generates a first gray-level pattern which controls a plurality of pixels included in a first controllable unit so that a gray level is provided during m frame periods, and said second gray-level pattern generating circuit generates a second gray-level pattern which controls a plurality of pixels included in a second controllable unit so that another gray level is provided during an n-frame period, and wherein said first gray-level pattern generating circuit controls m×m pixels included in the first controllable unit, and said second gray-level pattern generating circuit controls n×n pixels included in the second controllable unit.

2. The multi-gray level display apparatus according to claim 1, wherein said first gray-level pattern of said first gray-level pattern generating circuit includes m first tables each consisting of m×m gray-level auxiliary data items, and said second gray-level pattern of said second gray-level pattern generating circuit includes n second tables each consisting of n×n gray-level auxiliary data items.

3. The multi-gray level display apparatus according to claim 2, wherein said operation circuit selects said m first tables in a sequence where a different axis is obtained for each selection.

4. The multi-gray level display apparatus according to claim 2, wherein said operation circuit selects said n second tables in a sequence where a different axis is obtained for each selection.

5. The multi-gray level display apparatus comprising:

a display panel having a plurality of pixels, each pixel being driven by at least one voltage selected from a group of preset voltages in accordance with multi-gray level display data for the pixel;

a first gray-level pattern generating circuit generating a first gray-level pattern for acquiring a gray level during m frame periods (where m is an integer not less than 2);

a second gray-level pattern generating circuit generating a second gray-level pattern for acquiring another gray level during n frame periods (where n is an integer greater than m);

display data converting means for converting input k-bit multi-gray level display data to i-bit multi-gray level display data (where k is a positive integer greater than j); and an operation circuit that generates a result by performing an operation on the j-bit multi-gray level display data in accordance with the first gray-level pattern when the k-bit multi-gray level display data corresponds to a display gray level based on the first gray-level pattern, and in accordance with the second gray-level pattern when the k-bit multi-gray level display data corresponds to a display gray level based on the second gray-level pattern, and that outputs the result, wherein said first gray-level pattern generating circuit generates a first gray-level pattern which controls a plurality of pixels included in a first controllable unit so that a gray level is provided during m frame periods, and said second gray-level pattern generating circuit generates a second gray-level pattern which controls a plurality of pixels included in a second controllable unit so that another gray level is provided during an n-frame period, and wherein said first and second gray-level patterns are formed based on one of a magic square and a perfect magic square.

6. The multi-gray level display apparatus comprising:

a display panel having a plurality of pixels, each pixel being driven by at least one voltage selected from a group of preset voltages in accordance with multi-gray level display data at every frame;

a first gray-level pattern generating circuit generating a first gray-level pattern for acquiring a first gray level during m frame periods (where m is an integer not less than 2);

a second gray-level pattern generating circuit generating a second gray-level pattern for acquiring a second gray level during m frame periods, where the second gray-level pattern differs from the first gray-level pattern;

display data converting means for converting input k-bit multi-gray level display data to j-bit multi-gray level display data (where k is a positive integer greater than j); and an operation circuit that performs an operation on the j-bit multi-gray level display data in accordance with one of the first and second gray-level patterns when the k-bit multi-gray level display data corresponds to a display gray level based on one of the first and second gray-level patterns, and that outputs a result of the operation, wherein said first and second gray-level pattern generating circuits control m×m pixels which are included in a controllable unit to provide a gray level during m consecutive frame periods.

7. The multi-gray level display apparatus according to claim 6, wherein said first gray-level pattern generating circuit has a plurality of first gray-level patterns each comprised of m tables each consisting of m×m gray-level auxiliary data items, and said second gray-level pattern generating circuit has a plurality of second gray-level patterns each comprised of m tables each consisting of m×m gray-level auxiliary data items.

8. A multi-gray level display apparatus comprising:

a display panel having a plurality of pixels, each pixel being driven by at least one voltage selected from a group of preset voltages in accordance with multi-gray level display data;

a first gray-level pattern generating circuit generating a first gray-level pattern for acquiring a first gray level during m frame periods (where m is an integer not less than 2) that is based on a magic square;

a second gray-level pattern generating circuit generating a second gray-level pattern for acquiring a second gray level during m frame periods that is based on another magic square;

display data converting means for converting input k-bit multi-gray level display data to j-bit multi-gray level display data (where k is a positive integer greater than j); and an operation circuit that performs an operation on the j-bit multi-gray level display data in accordance with one of the first and second gray-level patterns when the k-bit multi-gray level display data corresponds to a display gray level based on one of the first and second gray-level patterns, and that outputs a result of the operation.

9. A multi-gray level display apparatus having a plurality of preset voltages for displaying a multi-gray level image, comprising:

a display panel having a plurality of pixels, each pixel receiving at least one voltage selected from the preset voltages;

a first gray-level pattern generating circuit generating a first gray-level pattern for acquiring a first gray level during m frame periods (where m is a positive integer not less than 2);

a second gray-level pattern generating circuit generating a second gray-level pattern for acquiring a second gray level during m frame periods which differs from the first gray-level pattern;

display data converting means for converting input k-bit multi-gray level display data to j-bit multi-gray level display (where k is a positive integer greater than j) data;

a random number generating circuit that generates a random number during each m-frame period; and an operation circuit that performs an operation on the j-bit multi-gray level display data in accordance with one of the first and second gray-level patterns selected in accordance with said random number generated by the random number generating circuit when the k-bit multi-gray level display data corresponds to a display gray level based on one of the first and second gray-level patterns, and that outputs a result of the operation.

10. The multi-gray level display apparatus having a display panel including at least a plurality of red pixels, a plurality of blue pixels and a plurality of green pixels, in which one of preset voltages is selected in accordance with input multi-gray level display data for each pixel to display an image at gray levels, said apparatus comprising:

a gray-level pattern generating circuit generating a gray-level pattern for acquiring a gray level during m frame periods (where m is a positive integer not less than 2), the gray-level pattern being supplied to a group of pixels including red, blue and green pixels which are controlled as a unit; and selection control means for selecting and outputting one of the preset voltages in accordance with an output from the gray-level pattern generating circuit when the input multi-gray level display data corresponds to a gray level of the gray-level pattern, wherein said gray-level pattern generating circuit has a first gray-level pattern comprised of m tables each consisting of m x m gray-level auxiliary data items.

11. The multi-gray level display apparatus according to claim 10, wherein said gray-level auxiliary data items are formed based on one of a magic square and a perfect magic square.

12. The multi-gray level display apparatus having a display panel including at least a plurality of red pixels, a plurality of blue pixels and a plurality of green pixels, in which one of preset voltages is selected in accordance with input multi-gray level display data for each pixel to display an image at gray levels, said apparatus comprising:

a gray-level pattern generating circuit generating a gray-level pattern for acquiring a gray level during m frame periods (where m is a positive integer not less than 2), the gray-level pattern being supplied to a group of pixels including red, blue and green pixels which are controlled as a unit;

selection control means for selecting and outputting one of the preset voltages in accordance with an output from the gray-level pattern generating circuit when the input multi-gray level display data corresponds to a gray level of the gray-level pattern; and detecting means for determining whether the gray-level display data input is text data.

13. A multi-gray level display apparatus in which one of preset voltages is selected in accordance with input multi-gray level display data to display an image at gray levels, said apparatus comprising:

a display panel having a plurality of pixels;

a first gray-level pattern generating circuit generating a first gray-level pattern for acquiring a gray level during m frame periods (where m is a positive integer not less than 2);

a second gray-level pattern generating circuit generating a second gray-level pattern for acquiring another gray level during m frame periods; and selection control means for selecting and outputting at least one of the preset voltages or a preset voltage adjacent thereto in accordance with the first gray-level pattern when the input multi-gray level display data corresponds to a gray level of the first gray-level pattern, and selecting and outputting at least one of the preset voltages or a preset voltage next to the preset voltage which is adjacent to said at least one of the preset voltages in accordance with the second gray-level pattern when the input multi-gray level display data corresponds to a gray level of the second gray-level pattern.

14. The multi-gray level display apparatus according to claim 13, wherein said multi-gray level display data is a k-bit digital signal (where k is a positive integer greater than 2).

15. The multi-gray level display apparatus according to claim 14, wherein the number of said preset voltages is less than $2^{k-1}$.

16. The multi-gray level display apparatus according to claim 15, further comprising a gray-level voltage generating circuit for applying voltages the number of which is less than $2^{k-1}$.

17. The multi-gray level display apparatus according to claim 13, further comprising a light source and light-collecting means for guiding light from the light source to said display panel.

18. The multi-gray level display apparatus according to claim 13, wherein said first and second gray-level pattern generating circuits controls m×m pixels which are included in a unit to control.

19. The multi-gray level display apparatus according to claim 13, wherein said first and second gray-level pattern generating circuits have a gray-level pattern comprised of m tables each consisting of m×m gray-level auxiliary data items.

20. The multi-gray level display apparatus according to claim 18, wherein said unit to control is arranged in the form of a substantially square array.

21. The multi-gray level display apparatus according to claim 19, herein said first and second gray-level patterns are formed based on a magic square or a perfect magic square.

22. A method of displaying multi-gray level images by using a plurality of pixels in accordance with input multi-gray level display data, comprising the steps of:

selecting and outputting, when the input multi-gray level display data corresponds to a gray level of a first gray-level pattern which acquires a gray level during m frame periods (where m is a positive integer not less than 2), at least one of the preset voltages or a voltage adjacent thereto in accordance with the first gray-level pattern; and selecting and outputting, when the input multi-gray level display data corresponds to a gray level of a second gray-level pattern which acquires a gray level during m frame periods, at least one of the preset voltages or a preset voltage next to the preset voltage which is adjacent to said at least one of the preset voltages in accordance with the second gray-level pattern.

23. A multi-gray level display apparatus having a display panel including a plurality of pixels, each pixel displaying an image in accordance with input multi-gray level display data for the pixel, said apparatus comprising:

preset voltage generating circuit for generating present voltages;

a gray-level pattern generating circuit for generating a gray-level pattern which acquires a gray-level during m frame periods (where m is a positive integer not less than 2); and selection control means for selecting and outputting one of the preset voltages to the corresponding pixel in accordance with the gray-level pattern when the input multi-gray level display data corresponds to a gray-level of the gray-level pattern which controls a plurality of pixels making a unit to control, wherein a gray-level pattern generating circuit generates a gray-level pattern which controls m×m pixels which are included in a unit to control so that a gray level is provided during m frame periods.

24. The multi-gray level display apparatus according to claim 23, wherein the gray-level pattern is comprised of m tables each consisting of m×m gray-level auxiliary data items.

25. The multi-gray level display apparatus according to claim 24, wherein said selection control means selects said m first tables in a sequence where a different axis is obtained for each selection.

26. The multi-gray level display apparatus according to claim 24, wherein the unit to control is arranged in the form of a substantially square array.

27. A multi-gray level display apparatus for displaying an image at gray levels, comprising:

a display panel having a plurality of pixels which form image corresponding to one frame;

voltage supplying means for supplying preset voltages assigned to different gray levels;

selecting means for selecting one of the preset voltages in accordance with each of multi-gray level display data items which are input for the pixels and updated for each frame; and driving means for driving each of the pixels with at least one of the selected preset voltages;

wherein said selecting means includes:

determining means, enabled when the multi-gray level display data item designates an intermediate gray level between the gray levels corresponding to two of the preset voltages, for determining a sequence based on the two selected preset voltages during a plurality of frame periods with a duty ratio for acquiring the intermediate gray level; and control means for selecting one of the two preset voltages based on the sequence while the intermediate gray level is not changed due to an update of the multi-gray level display data item and for canceling the sequence when the intermediate gray level is changed due to the update of the multi-gray level display data item.

* * * * *